US005304751A

United States Patent [19]

Skalski et al.

[11] Patent Number: 5,304,751

[45] Date of Patent: * Apr. 19, 1994

[54] ELEVATOR HORIZONTAL SUSPENSIONS AND CONTROLS

[75] Inventors: Clement A. Skalski; Boris G. Traktovenko, both of Avon, Conn.

[73] Assignee: Otis Elevator Company, Farmington, Conn.

[ * ] Notice: The portion of the term of this patent subsequent to Jun. 2, 2009 has been disclaimed.

[21] Appl. No.: 21,649

[22] Filed: Feb. 16, 1993

Related U.S. Application Data

[63] Continuation of Ser. No. 731,185, Jul. 16, 1991, abandoned.

[51] Int. Cl.[5] ..... B66B 1/44

[52] U.S. Cl. ..... 187/115; 187/1 R; 187/95

[58] Field of Search ..... 187/95, 1 R, 115

[56] References Cited

U.S. PATENT DOCUMENTS

| | | | |
|---|---|---|---|
| 3,871,301 | 3/1975 | Kolm et al. . | |
| 3,939,778 | 2/1976 | Ross et al. | 105/102.1 |
| 4,215,403 | 7/1980 | Pollard et al. | 364/424.05 |
| 4,621,833 | 11/1986 | Soltis . | |
| 4,625,993 | 12/1986 | Williams et al. . | |
| 4,750,590 | 6/1988 | Otala | 187/95 |
| 4,754,849 | 7/1988 | Ando | 187/95 |
| 4,770,438 | 9/1988 | Sugasawa et al. . | |
| 4,809,179 | 2/1989 | Klinger et al. . | |
| 4,892,328 | 1/1990 | Kurtzman et al. . | |
| 4,898,257 | 2/1990 | Brandstadter . | |
| 4,899,852 | 2/1990 | Salmon et al. | 187/1 R |
| 4,909,535 | 3/1990 | Clark et al. . | |
| 5,020,639 | 6/1991 | Michel | 187/1 R |
| 5,027,925 | 7/1991 | Kahkipors | 187/115 |
| 5,086,882 | 2/1992 | Sugahara et al. | 187/95 |
| 5,086,882 | 2/1992 | Sugahara et al. | 187/95 |
| 5,117,946 | 6/1992 | Traktovenko et al. | 187/95 |

FOREIGN PATENT DOCUMENTS

| | | | |
|---|---|---|---|
| 0467673 | 1/1992 | European Pat. Off. | B66B 11/02 |
| 58-39753 | 9/1983 | Japan | B66B 7/02 |

(List continued on next page.)

OTHER PUBLICATIONS

Patent Abstracts of Japan-Kokai 3-88690.

"A Magnetic Bearing Control Approach Using Flux (List continued on next page.)

*Primary Examiner*—Steven L. Stephan
*Assistant Examiner*—Robert Nappi
*Attorney, Agent, or Firm*—Francis J. Maguire, Jr.

[57] ABSTRACT

A semi-active secondary suspension comprises a relatively large actuator for handling low-frequency forces such as those caused by uneven passenger distribution, etc., by means, for example, of a position control loop. A pair of such suspensions on opposite sides of the car or rail can be made to act in concert, for example, by actuating only one at a time. An inner loop can be added to the position control for each secondary suspension to restore its actuator to a selected preload position when not being used as an actuator. The semi-active secondary suspension is made fully active by adding a relatively small actuator for handling higher frequency dynamic forces. A roller guide embodiment has rollers pivotally mounted on links which are spring-biased toward the rail blades. The relatively large actuators are connected to the link springs to slowly increase or decrease the preload force on the spring acting on the links to counter low frequency disturbances. The relatively small actuators also act on the links to ensure that high frequency disturbances are quickly countered thereby ensuring a substantially vibration-free ride. Suspensions comprising slide guides, electromagnets, etc. are shown.

23 Claims, 20 Drawing Sheets

FOREIGN PATENT DOCUMENTS

| | | | |
|---|---|---|---|
| 3-3884 | 1/1991 | Japan | B66B 7/06 |
| 3-51281 | 3/1991 | Japan | B66B 5/02 |
| 3-51285 | 3/1991 | Japan | B66B 11/02 |
| 3-88687 | 4/1991 | Japan | B66B 7/04 |
| 3-88690 | 4/1991 | Japan | B66B 11/02 |
| 0033184 | 8/1981 | PCT Int'l Appl. | B66B 7/04 |
| 2181275 | 4/1987 | United Kingdom | G05B 19/42 |

OTHER PUBLICATIONS

Feedback" NASA Tech. Memorandum 100672, N. J. Groom, Mar. 1989.

Patent Abstracts of Japan–Kokai 3–3884.

*Development of an Inertial Profilometer,* E. L. Brandenburg, et al, Distributed by National Technical Information Service, U.S. Department of Commerce, Nov. 1974.

*Inertial Profilometer as a Rail Surface Measuring Instrument,* T. J. Rudd and E. L. Bradenburg, published by American Society of Mechanical Engineers, New York, NY, Sep. 1973.

*Journal of Dynamic Systems, Measurement and Control, Transactions of the ASME*"Performance of Magnetic Suspensions for High Speed Vehicles Operating Over Flexible Guideways" by C. A. Skalski Jun. 1974.

| FIG. 24A | FIG. 24B |
|---|---|

ELEVATOR HORIZONTAL SUSPENSIONS AND CONTROLS

This is a continuation of copending application Ser. No. 07/731,185 filed on Jul. 16, 1991, abandoned.

CROSS REFERENCE TO RELATED APPLICATIONS

The subject matter disclosed herein may be disclosed and claimed in commonly owned copending application U.S. Ser. No. 07/739,631 filed on the same data as this application and also may similarly be related to commonly owned applications having U.S. Ser. Nos. 07/555,130; 07/555,131, 07/555,132; 07/555,133; 07/555,135; 07/555,140; 07/668,544; and 07/668,546.

TECHNICAL FIELD

This invention relates to elevators and, more particularly, to horizontal suspensions and control systems therefor.

BACKGROUND OF THE INVENTION

An elevator cab assembly will typically comprise a passenger cab which is mounted in a rectangular frame. The cab assembly moves up and down in the elevator hoistway along guide rails which are mounted on opposite walls of the hoistway.

Japanese Kokai Publication No. 3-23185, published Jan. 31, 1991, discloses a system for stabilizing an elevator cab as it is moving along guide rails in a hoistway, which guide rails possess a varying compliancy. The system includes transverse beams above and below the cab assembly. Rail guides are mounted on the ends of the transverse beams by means of vibration-proof rubber pads. The beams are also connected to the cab assembly by vibration-proof rubber pads. A contoured guide piece is fixed to the hoistway wall which mimics the compliancy values of the rails, and contact sensors are mounted on the beams to slide over the guide piece. Motion of the contact sensors is monitored by a control which operates actuators operable to laterally shift the beams in response to movement of the contact sensors. The rail guide will thus be moved laterally relative to the cab assembly as the rail compliancy varies. A problem found in this teaching concerns the fact that if the beam is moved to the left to shift the left-hand rail guides in response to variations in compliancy of the left-hand rail, then the right-hand rail guides must necessarily move in the same direction as the left-hand rail guides. The objective of moving the rail guides toward a rail as rail compliancy increases, and away from the rail as rail compliancy decreases is thus only attainable on one of the rails, and the opposite rail guide movement occurs at the other opposite side rail. The use of the guide piece is also cumbersome, and its ability to mirror rail compliancy is problematic, at best. Kokai 3-51280, published 5 Mar. 1991, shows other aspects of the same system.

Another approach shown in Kokai 3-51279, published 5 Mar. 1991, uses actuable horizontal ropes strung on pulleys from corner to corner on diagonals across the cab's roof and converging at a point above the cab to control the tilt of the cab.

DISCLOSURE OF THE INVENTION

As disclosed in the assignee's copending applications cross-referenced above, elevators traveling vertically in hoistways are subject to both direct car forces, such as load imbalances and wind gusts, and to rail-induced forces, all of which can cause horizontal accelerations of the car. As further disclosed therein, these forces occur at various frequencies, which must be understood before being in a position to effectively counter same. Furthermore, imbalances caused by gross forces can be handled slowly in a position control loop such as shown in copending application Ser. No. 07/555,130. Such forces may include load imbalances which can be either static or dynamic depending on whether the passengers are standing still or moving in the car. The smaller forces required to counteract higher frequency forces must be handled rapidly in an acceleration loop such as shown in the same application. To build a wholly magnetic actuator, such as shown in co-pending application Ser. No. 07/555,130 (and related applications cross referenced therein), or a slide guide capable of handling all of the above described forces, requires much expensive material.

In accordance with a first aspect of the present invention, a secondary suspension may be controlled in an outer position loop which controls the position of the car with respect to a primary suspension (or rail) to keep the car centered in the hoistway and in an inner position loop which controls the position of an actuator of the secondary suspension, with respect to the car, to maintain at least a selected force on the primary suspension.

In positioning actuators in opposition (on opposite sides of the car for side to side stabilization or on opposite sides of a rail for front to back stabilization), we realized, if not properly coordinated, we could create a problem in the actuators possibly working at cross purposes. Therefore, we have devised a control technique which uses an outer loop responsive to a sensed signal indicative of the degree of centering of the car in the hoistway (e.g., the car's position with respect to a rail, primary suspension, or some other referent indicative thereof) to command an actuator to center the car in the hoistway and which uses an inner loop responsive to a sensed signal indicative of the actuator's position with respect to the car to control the position of the actuator to maintain at least a selected preload force on the primary.

To a large degree, the horizontal vibration problem in the prior passive suspension art is attributable to grounding of the primary suspension onto the car, e.g., using passive roller guides, grounding onto the pivot stops. Thus, in further accord with this first aspect of the present invention, by counteracting force imbalances on an elevator car in the above described manner, i.e., by keeping the car centered in the hoistway, touching or grounding the primary suspension (roller, slide guide, electromagnetic bearing, etc.) to the elevator car through the secondary suspension (that which connects the primary suspension to the car) is automatically prevented. Such counteraction is thus automatically accomplished within positional limits by controlling the secondary suspension by means of the centering control loop. In this case, for each axis, one or more springs and position adjusters may be considered the secondary suspension. The measured car position signal is steered to actuate one or the other of a pair of opposed actuators. While one actuator is being actuated, the other is being retracted by means of the inner loop to a selected zero or centered position which maintains a selected preload force on the primary in the car centered position.

This aspect of the present invention may relate to a guidance assembly for an elevator having a primary suspension such as a roller, sliding shoe, electromagnetic bearing, or the like, for guiding the car along a hoistway rail, and having a secondary suspension connected between the primary suspension and the elevator car, which is automatically adjustable within limits in response to relatively low frequency forces, such as uneven passenger loading and hoistway wind gusts, which impose intensified guide rail thrust forces on one or more of the car's guidance assemblies.

Such assemblies may comprise, but are not limited to, rail guides having a primary suspension comprising a roller cluster and a secondary suspension comprising automatically adjustable springs for forcing the rollers against the rail. We have, for example, found springs having a spring rate of forty (40) Newtons per millimeter with a preload of approximately fifty (50) Newtons per roller to be satisfactory. Thus, such guide rollers, according to an embodiment of this aspect of the present invention, are mounted on pivotable links which are spring biased so as to urge the rollers against the guide rail blade with a predetermined thrust force. Pivot stops are associated with the links so as to limit the extent of possible pivotal movement of the links, and therefore also the guide rollers in a direction away from the guide rails. Position sensors are also associated with the links in order to obtain an indication of the position of the primary suspension (roller), i.e., the rail, with respect to the car. (It may be assumed for our purposes that the roller is incompressible). Thus, we may measure the position of the link with respect to its pedestal and use the measurement as an indication of the position of the car with respect to the rail. Automatic link position adjusters are operably connected to the position sensors so that the pivotal position of each link can be automatically adjusted to keep the car centered and the links away from the pivot stops. In this way, the pivotal position of each link relative to its respective pivot stop is automatically controlled so as not to cause grounding. This can be done in a "bang-bang" type control whenever a position sensor detects an undesirably small spacing between the link and its associated pivot stop. This will eliminate or at least limit prolonged contact between the links and their associated pivot stops during operation of the elevator. Or, it can be done in a more or less continuous (e.g., proportional) control to keep the guide fully responsive to the sensed centering control signal such as by means of a feedback loop comprising a proportional, proportional-integral (PI) or proportional-integral-derivative (PID) type control.

For a roller guide embodiment, when the elevator cab is subjected to direct car forces such as uneven passenger loading sufficient to cause an uneven thrusting of the guide rails against certain of the guide rollers, the links carrying those higher loaded guide rollers will be pivoted toward their respective pivot stops. The sensors will detect position and may continuously (e.g., proportionally) or selectively ("bang-bang") cause the adjusters to respectively maintain the affected links at the commanded positions or move them away from their pivot stops. This will establish the commanded thrust (actuator position multiplied times spring rate) or selectively thrust the affected guide rollers back against the guide rails so that the orientation of the cab in the hoistway is maintained or returned toward its natural unloaded position. When the cab is then moved up and down in the hoistway, there is little or no likelihood that the links will be thrust into prolonged contact with their stops, and rail anomalies can therefore be readily absorbed by the guide roller link springs. A secondary suspension according to this aspect of the present invention can thus be used to correct side-to-side, or front-to-back uneven passenger distribution and loading in the elevator cab.

In accordance with a second aspect of the present invention, a pair of opposed secondary suspensions on opposite sides of the elevator car (for a side-to-side horizontal suspension) or opposite faces of the rail blade (for a front-to-back horizontal suspension) are controlled with respect to each other by means of a differential signal having a magnitude and sign indicative of the difference between a pair of signals respectively indicative of the position of the car with respect to each of a corresponding pair of opposed primary suspensions. The sign of the measured differential position may, but need not, be used to steer actuation of one or the other of the opposed suspensions.

In other words, the position of each of a pair of opposed primary suspensions (e.g., both sides of a rail [for front-to-back] or a pair of opposed rails [for side-to-side]) is measured with respect to the car and combined differentially with the other for use in commanding the positions of the associated opposed secondary suspensions.

Thus, in still further accord with this second aspect of the present invention, for either front-to-back or side-to-side opposed suspensions, the opposed secondary suspensions are responsive to a car position signal according to the sign thereof. A selected deadband may be provided about the zero crossover to ensure their operations are mutually exclusive.

As mentioned, the car position signal comprises a difference signal having a magnitude indicative of the magnitude of the difference between the magnitudes of a first position sensor indicative of the position of the elevator car with respect one of the rails (or one side of a rail) and a second position sensor indicative of the position of the elevator car with respect to the other rail (or the other side of the rail). But the difference signal has a sign as well, which is indicative not merely of the overall position of the car with respect to a single selected referent such as, in the side-to-side context, merely one of the rails, but both. By measuring the position of the car with respect to both rails (which may be done by measuring the car position with respect to both of the primary suspensions) we teach automatic equalization of the gaps on either side of the car so that by means of the position control loop the car automatically becomes optimally self-centered. By ensuring that the outer position control loop is centering on a symmetrical centering signal, the available combined dynamic range of the opposed actuators is maximized. As an embodiment of this approach, we have shown the surprising combination of two novel, nonlinear position sensors to provide a symmetrical self-centering signal. Of course, a pair of more expensive linear position sensors could be used as well.

Owing to the above described steering of the differential control signal, as one suspension is actuated toward counteracting the disturbing force, the other will remain at zero or, if not already at zero, will be in the process of being zeroed. The meaning of zero, in light of the teachings of the first aspect of our invention and in the context of this second aspect of our invention, can mean that position which most nearly maintains the selected primary suspension preload. In the embodiment shown below, the zeroing of the inactive actuator is done at a much slower rate than the rate of actuation. It should be realized that the zeroing may be done faster than shown or may be done in many other ways including mechanically, by means of a restoring spring. Once the disturbing force is effectively countered, as manifested by a zero differential position signal, the active actuator remains in position for so long as the disturbing force is present. When the disturbing force is removed, the counterforce still exerted by the active actuator will drive the car in the other direction until the change in sign of the differential position signal steers control to the other actuator. At that point, the formerly active suspension will commence zeroing in response to the zero input command to its own position control loop and so on.

In accordance with a third aspect of the present invention, the secondary suspension may comprise a relatively large actuator combined with a relatively small actuator. Since we have learned that the low frequency forces which the actuator must counter are on the order of thousands of Newtons, in such an arrangement, the large actuator can be designed to handle the lower frequency forces while the high frequency forces, which we learned are on the order of hundreds of Newtons, may be handled by the small actuator.

In practice, the control of the two types of actuators will not be totally disjoint. A lag filter or other averaging technique may be used to create a relatively slow-acting, position-based control loop for controlling the relatively large actuator and will be coupled by the controlled elevator system to a relatively fast, acceleration-based control loop for controlling the relatively small actuator. In other words, by virtue of acting on the same system, there will be some blending of the forces exerted by the two force actuators which will be reflected in their respective control loops. Nonetheless, the two actuators may, but need not, be treated separately as described herein.

Thus, in still further accord with the third aspect of the present invention, the secondary suspension is controlled using an acceleration feedback loop for controlling the small actuator for counteracting high frequency forces and using a position based control loop for controlling the large actuator for counteracting low frequency forces.

For a roller guide embodiment, the large actuator may be a linear actuator such as a ball drive actuator, which has a fairly slow response but is powerful and usually not expensive. Or it may be a rotary actuator. Both types are disclosed more fully below and may be used interchangeably as dictated by design considerations. The small actuator may be an electromagnet actuator, for example, as described below.

The methods and devices here shown provide an inexpensive and effective way to provide an improved ride for an elevator. Moreover, the invention can be very effectively used on modernization contracts as well as new equipment. Thus, a modernization technique of replacing a passive guide with an semi-active guide (large actuator with a position-based control loop only) or active guide (both large and small actuators with respective position and acceleration loops), as disclosed herein, could substantially increase the capabilities of the elevator modernization business by providing an inexpensive and effective technique for improving the ride in older elevator cars.

These and other objects, features and advantages of the present invention will become more apparent in light of the following detailed description of a best mode embodiment thereof, as illustrated in the accompanying drawing.

BEST MODE EMBODIMENT OF THE INVENTION

Figure 1:
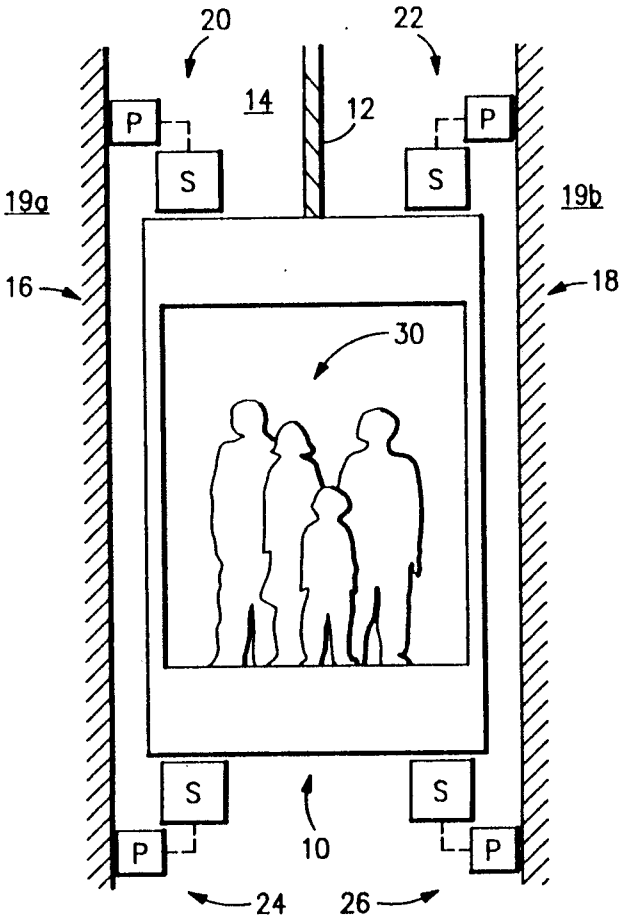
FIG.1 PRIOR ART
FIG. 1 shows an elevator car for traveling vertically in a hoistway, according to the present invention.

FIG. 1 illustrates an elevator car 10 suspended by a rope 12 for raising or lowering the car in a vertical hoistway 14, having rails 16, 18 installed on hoistway walls 19*a*, 19*b* on either side of the car 10. Horizontal suspensions 20, 22 and 24, 26, which may be guides of any type such as slide guides, electromagnetic bearings, or roller guides, may be attached at the top and bottom of said car 10, and, if roller-type guides, may have circular rollers for riding on the surface of the rails.

Although a primary suspension comprising roller guides and a secondary suspension comprising both linear and rotary actuators and springs are shown below in great detail, there are of course various other types of suspensions, many of which are specifically shown below, which may be adapted to carry out the present invention. Thus, the claims of the present invention, where not specifically limited to a particular type of suspension, are applicable, as the case may be, to primary and secondary suspensions of any type and controls therefor.

The purpose of the horizontal suspensions 20, 22, 24, 26 is to impart as smooth a ride as possible to passengers 30 inside the elevator car 10. It is, of course, known in the art to provide passive guides of various types including roller guides as disclosed in U.S. Pat. No. 3,099,334 to B. W. Tucker, Jr.

As mentioned above, among other things, we teach both a semi-active and an active secondary suspension, both of which provide a smooth ride and which prevent grounding of the primary suspension or the rail to the elevator car.

Secondary Suspension with Inner & Outer Position Loops

Figure 2B:
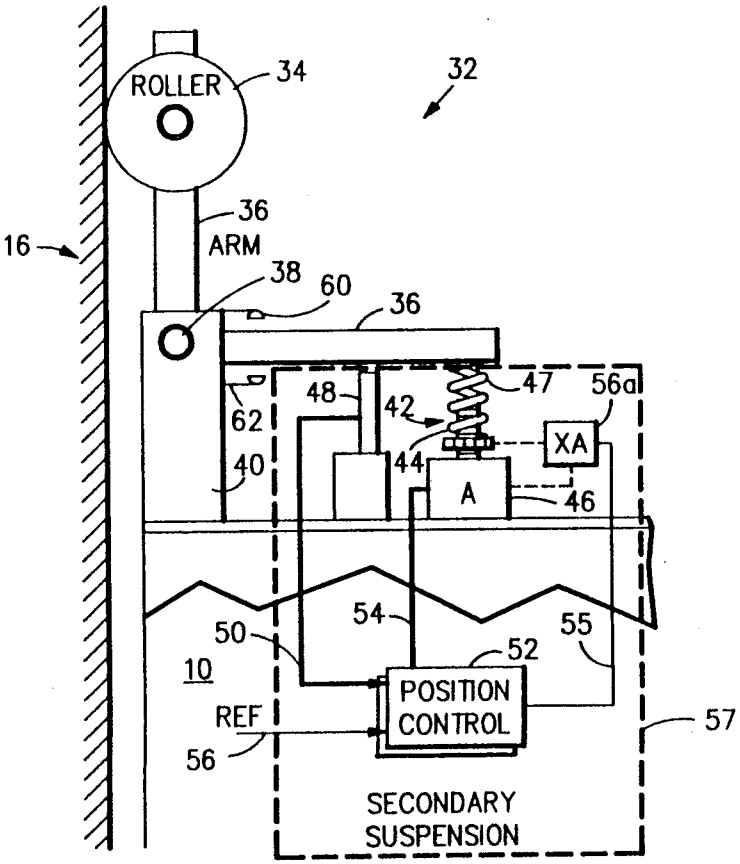
FIG. 2B shows an embodiment of the present invention in the form of a semi-active roller guide controlled by a position feedback control loop for controlling a relatively large actuator.
Figure 2A:
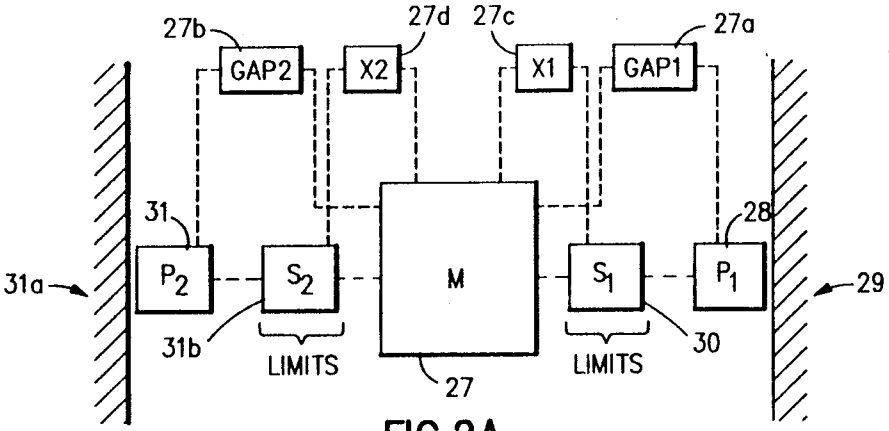
FIG. 2A is a block diagram illustration of a secondary suspension within limits, according to the present invention.

Referring now to FIG. 2A, we show an elevator car 27 having a first primary suspension 28 riding on, rolling on, or close to (e.g., by riding on an air cushion), a rail 29 and connected mechanically or electromagnetically to a secondary suspension 30 similarly attached to the car 27. On the other side of the hoistway, a second primary suspension 31 contacts or is in close proximity to a second rail 31*a* and is mechanically or electromagnetically attached to a secondary suspension 31*b* similarly attached to the car 27.

FIG. 2A is thus an illustration of an elevator car vertically suspended in a hoistway by ropes (not shown) and also horizontally suspended between hoistway rails on opposite sides of the car by a primary suspension in contact or close to contact with each of the hoistway rails and a corresponding pair of secondary suspensions attached on one side to the primary suspensions and on the other side attached to the car. In accordance with the present invention, the primary suspension may be a roller, slide guide, an electromagnetic bearing, or the like. Each secondary suspension, on the other hand, may be a semi-active or active suspension whereby, through it, the position of its associated primary suspension is controlled with respect to the car in response, e.g., to both a sensed position signal as provided by one or more sensors 27*a*, 27*b* indicative of the position of the car in the hoistway and also with respect to a corresponding pair of sensed position signals indicative of the positions of the secondary suspensions with respect to the car from a pair of sensors 27*c*, 27*d*. By using the centering position sensors 27*a*, 27*b* to center the car, each secondary suspension is automatically be controlled within limits so as to prevent grounding of the primary suspension onto one or more of the limits of the secondary suspension in order to avoid grounding the primary suspension to the car or rail. As suggested previously, we use the term "semi-active" to refer to a secondary suspension using only a closed-loop position control and the term "active" to refer to a secondary suspension using both closed-loop position and acceleration control. Although much of the detailed embodiments which follow deal with roller guides, it will be understood that since the principles disclosed are equally applicable to other types of suspensions, those claims of the present invention which do not specifically recite any particular type of suspension generally cover any type of suspension for an elevator system.

We teach also that further imbalances due to the relatively large, direct car forces can be counteracted with a relatively large force actuator (capable of exerting relatively large forces on the order of greater than 1000 Newtons) but and which may, but need not, have an inherently relatively slow response (e.g., on the order of less than 250 Newtons per second). Of course, if the actuator is inherently fast, its response can be slowed down to any desired response by means of compensation techniques as described in detail below.

Semi-Active Secondary Suspension

A "semi-active" guide 32, is shown in FIG. 2B. It may, but need not, be comprised of a roller 34 for rolling on the surface of the rail 16 or the rail 18 and which is attached to an arm 36, having a pivot point 38 attached to a base 40, which is in turn attached to the elevator car 10.

A portion of the arm 36 extends beyond the pivot point 38 and is actuable through a spring 44. This spring is driven with a ball drive actuator 46 having a screw 47 inserted therein and mounted to the base 40. A position sensor 48 senses the position of the arm 36 and provides a sensed position signal on a line 50 to a position control device 52 which in turn provides an actuator control signal on a line 54 to the actuator 46. The position control device 52 may also, but need not, be responsive to a second sensed position signal on a line 55 from a position sensor 56*a* which measures the position of the screw 47 with respect to the base 40 or actuator 46. The position sensor 56*a* may be used for position feedback in an inner position control loop, shown below in connection with FIG. 25, for maintaining at least a selected preload force on the primary suspension. In other contexts, such as in connection with the mechanically linked rollers of FIG. 16, there is no need for a position sensor 56*a*. The position sensor 56*a* may be a potentiometer, an LVDT, an optical position sensor, a position encoder, etc., or its function may be fulfilled by pulses from certain types of motors which may have been or will be fitted with a position sensing capability and used in the actuator 46 as the driver. Such a motor would be used in conjunction with one or more limit switches to enable a determination of the actuator reaching a limit of travel. The position control device 52 may also, but need not, be responsive to a position reference signal on a line 56 for comparison with the sensed position signal and thus constitutes a closed-loop position-based feedback control system for controlling the position of the arm 36. According to the teaching of the present invention, the reference signal on the line 56 may be a fixed voltage reference, or its function may be obviated by a balance or composite signal between two opposed position control loops as shown in more detail below, or some such arrangement whereby position is controlled. The spring and ball screw actuator 42, 46 along with the position sensor 48, the position control 52 and, in some circumstances (such as where opposed primary suspensions are not mechanically linked), the sensor 56*a*, comprise an automatically adjustable secondary suspension 57. In further accord with our teachings, the position of the primary suspension, e.g., the roller 34, is controlled by the control 52 within limits 60, 62 so as to prevent grounding of the primary suspension onto the car 10 through the base 40. In other words, the control ensures that the primary suspension has little or no mechanical contact with the limits. It does this in conjunction with an opposed guide on the other side of the car whereby the two guides act through their respective position controls in concert to keep the car centered in the hoistway.

The bottom horizontal suspensions such as, but not limited to, the guides 24, 26 shown in FIG. 1, may be "semiactive" guides, e.g., of the type shown in FIG. 2B, or active guides, e.g., those to be disclosed in detail below. The guides 20, 22 shown at the top of the car of FIG. 1 may be passive roller guides of the type disclosed in U.S. Pat. No. 3,099,334 to Tucker or of the type disclosed in U.S. Pat. No. 3,087,583 to Bruns or of any other passive type guide known in the art. On the other hand, all four guides 20, 22, 24, and 26 may be replaced with semi-active roller guides of the type shown in FIG. 2B, or active guides such as disclosed in detail below.

Since the actuator 46 shown in FIG. 2B may be a relatively large actuator either compensated to be of fairly slow response (e.g., on the order of slower than 250 Newtons per millimeter) or inherently slow-acting, it may not be capable of handling some of the more high frequency vibrations caused particularly by rail-induced anomalies. In the disclosure which follows, we teach active, high-frequency, vibration control using acceleration feedback, as well.

Design of Small Actuator Control

Figure 3:
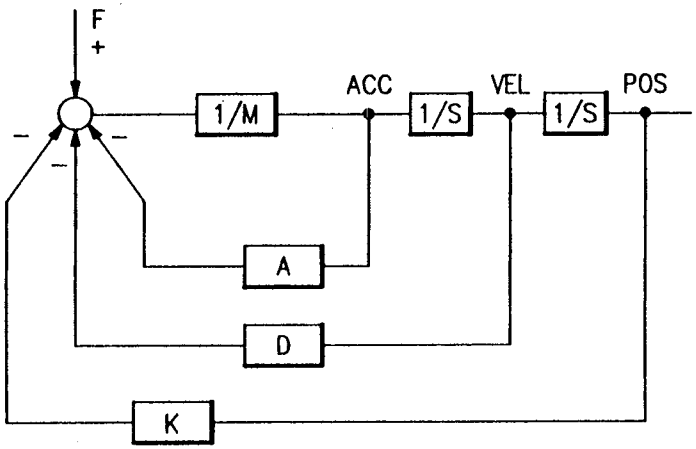
FIG.3 PRIOR ART
FIG. 3 shows a simplified vibration control, according to the present invention.
Figure 4:
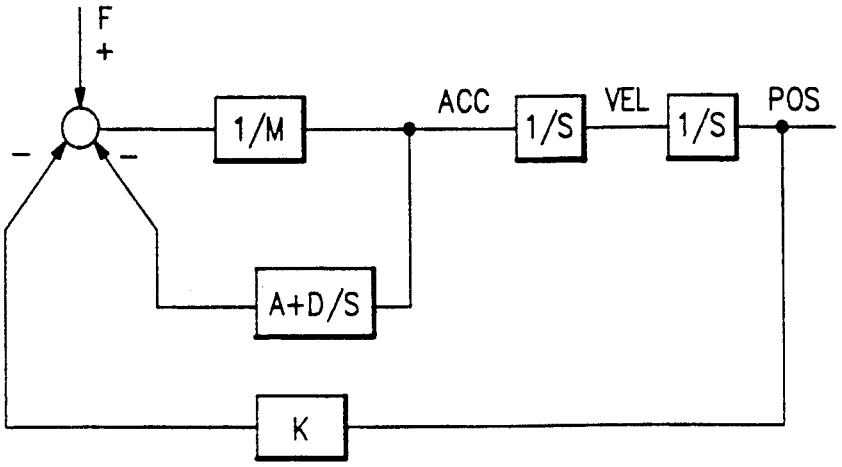
FIG.4 PRIOR ART
FIG. 4 shows a derivation of attenuation using acceleration feedback, according to the present invention.
Figure 5:
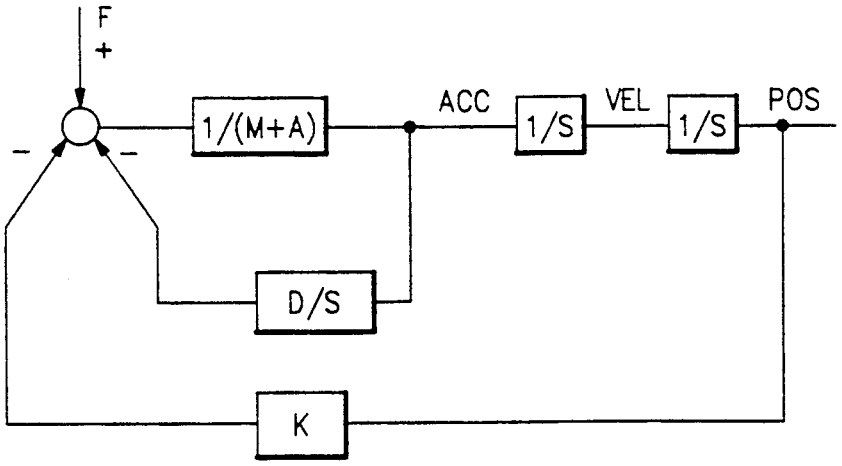
FIG.5 PRIOR ART
FIG. 5 shows synthesis of mass using acceleration feedback, according to the present invention.

In order to teach how to design such a high-frequency control system in accordance with our invention, we show in FIGS. 3, 4 and 5 preliminary control design considerations for such a system. Such block diagrams are prepared by the controls engineer during the preliminary design process in order to set the stage for subsequent hardware design. We show various hardware embodiments of our invention; but with the information provided in FIGS. 3, 4, and 5 and subsequent related diagrams, including the control concepts presented, those skilled in the art of control systems are enabled to provide various other embodiments of functionally equivalent, high-frequency controls for secondary suspensions.

FIG. 3 shows a simplified vibration control/suspension system. The output of the input summer consists of all forces acting on controlled mass M. Except for the acceleration loop, the diagram represents the classical second order linear dynamic system. A is acceleration (accelerometer) feedback. In practice, this is carried out by means of a sensed acceleration signal, processing circuitry, and a force actuator. D as shown represents mechanical damping by means, e.g., of a mechanical damper such as a viscous damper (dashpot). K is the elevator suspension's spring rate.

The designer should view the system as having an effective mass, damping ratio ($\zeta$) and natural frequency ($\omega_0$). We would like to increase the effective system mass which may be characterized as a lowering of the system's natural frequency. As a preliminary design consideration, we would like to reduce the system's natural frequency by a factor of at least 3. The ability to achieve such an objective will depend on structural resonances encountered. As a further preliminary design consideration, we would like to get the damping ratio in the range of 0.3 to 0.7. However, even if a particular embodiment fails to achieve this objective, we will still have the potential for significant electromechanical damping for improved ride quality.

FIG. 4 is the result of manipulating the block diagram of FIG. 3 to permit realization of the mechanical damping of FIG. 3 by electromechanical rather than purely mechanical means. The output of the block [A+D/S] is a force. The element A+D/S is realized in practice by the combination of an accelerometer, processing circuitry, and a force actuator. FIGS. 3 and 4 are totally equivalent from a transfer function point of view although carried out differently.

Control manipulation is carried further in FIG. 5. Here, A is combined with M to show that acceleration feedback results in an electromechanically produced mass augmentation. Thus, FIG. 5 is presented for teaching purposes to show that acceleration feedback results in electromechanically derived mass augmentation. FIG. 5 is useful in understanding the magnitude of acceleration feedback (A) in relationship to mass (M). The mass (M) of the elevator car will be subject to forces which will cause accelerations which we seek to counteract. We should like to "augment" the mass.

In a practical system, a low-pass (lag) filter would be used rather than an integrator to obtain damping. Also, pure feedback of acceleration is not practical without rolling off high frequency response to reduce high-frequency noise. In the ideal system, the accelerometer feedback transfer ratio is:

$$(As+D)/s.$$

In a non-ideal system the accelerometer and its associated network transfer function as given below could be used:

$$s(As+D)/(s+\omega_1)(s/\omega_2+1)(s+\omega_3)$$

where $\omega_1$ is a low frequency roll-off such as 0.1 rad/sec used to cut off the integration function. $\omega_2$ is on the order of 100 rad/s or higher; and $\omega_3$ is on the order of 0.1 rad/s. The term $s/(s/\omega_2+1)(s+\omega_3)$ is used roll off high frequencies and to reduce the DC gain of the accelerometer feedback to zero. $s=j\omega$, as always.

The POS/F transfer function for the block diagram of FIG. 5 is $$G=POS/F=b\ 1/((M+A)s^2+Ds+K)$$

From this it can be shown that the system natural frequency $\omega_0$ is:

$$\omega_0=(K/(M+A))^{\frac{1}{2}}$$

The damping ratio $\zeta$ is:

$$\zeta=D/(2\omega_0(M+A)).$$

From the above equations it clear that acceleration feedback A lowers the natural frequency and the damping ratio. In an elevator suspension system it is desirable to have the damping ratio greater than 0.3 to 0.7.

An example is considered now. Say we start with a passive spring-mass system having $\omega_0=10$ and no mechanical damping. It is desired to reduce $\omega_0$ by a factor of 3 and to make zeta=0.5. This condition is met by A=8M and D=9 $\omega_)$M.

For M=1000 kg, the result will be A=8000 Newton/(m/s$^2$). This is equal to 78.4 Newton/mg (it should be noted that by "mg" we are referring to "milligravitational force constant"). D will equal 90,000 Newton/(m/s). The ratio D/A will be 11.25. This is the ratio of integral to proportional gain that should be used in the accelerometer feedback loop.

Bode plots are presented next for the example just given. Also, it is shown how to modify the G=POS/F transfer function to find other important transfer functions. For the example considered here, the damping ratio for the passive system is 0.1 rather than zero to facilitate plotting. This will be equivalent to starting with a passive system with damping rather than without, as described previously. The damping ratio for the active suspension is 0.5, as before.

Figure 6:
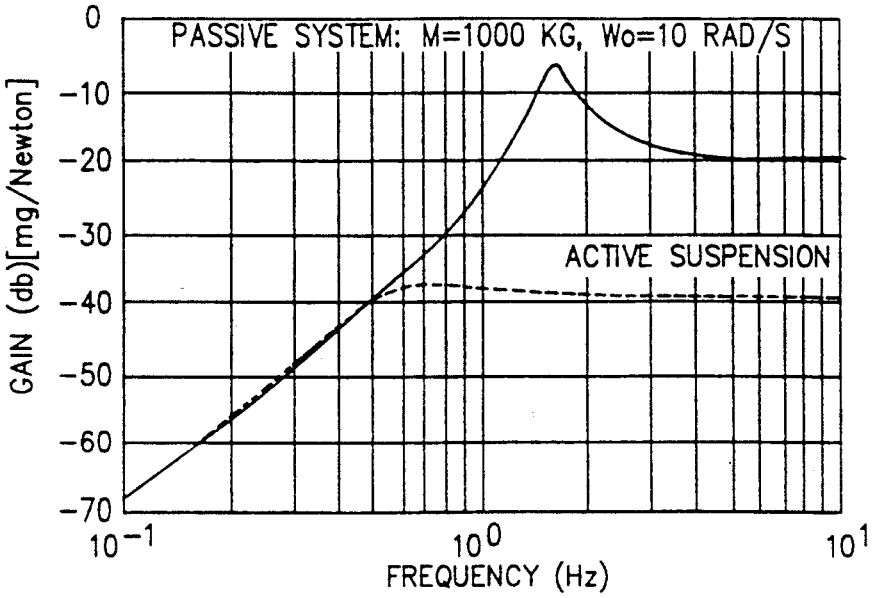
FIG.6 PRIOR ART
FIG. 6 shows direct force response with and without active vibration control, according to the invention.
Figure 7:
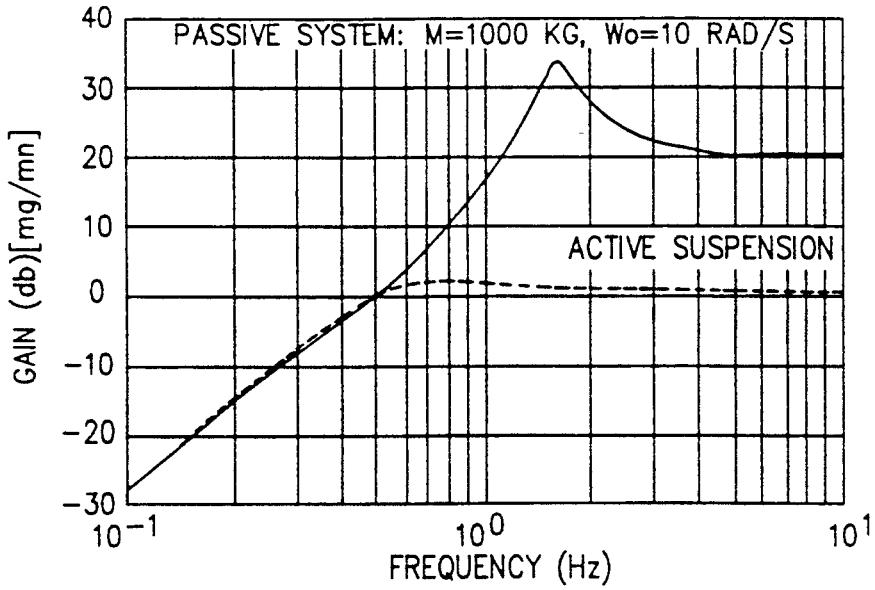
FIG.7 PRIOR ART
FIG. 7 shows response to rail position offsets, according to the invention.

First, $s^2G=G1$ is found and plotted as a function of frequency for the passive suspension and for that suspension improved by means of accelerometer feedback. G1 is the ratio of car acceleration to applied force. G1 has been expressed in the units mg/Newton and plotted in decibels (dB). FIG. 6 shows the result. The active suspension gives an appropriate 20 dB reduction in sensitivity to direct-car forces in the frequency band to 10 Hz. We teach this as a design objective for active vibration control for elevator systems. Usually, we primarily try to emphasize attenuation of most motions in the band 0.5 to 2 Hz, since human perception of horizontal vibration is believed greatest in that band. The system response to rail position offsets, which are known to be on the order of millimeters, is given by curves similar to those shown in FIG. 6 except for a scale factor. A rail position offset X causes force KX. The transfer function relating car acceleration to X is simply G1*K. $K=\omega_0^2M=100{,}000$ N/m=100 N/mm. FIG. 7 shows car acceleration caused by rail offsets. Units of mg/mm are used. The amplitude for FIG. 7 is simply 40 dB greater than that for FIG. 6. The rail deviations are on the order of several mm or less. Our objective is to attenuate vibration levels down to 0.5 mg RMS as measured through a filter having roll-offs at 0.5 and 2.0 Hz, but that objective can change according to the designer's task. Clearly, the active suspension provides great advantages over the passive suspension. An alternative is to use a softer, passive suspension but this presents problems with static imbalances, such as passenger load distribution.

Figure 8:
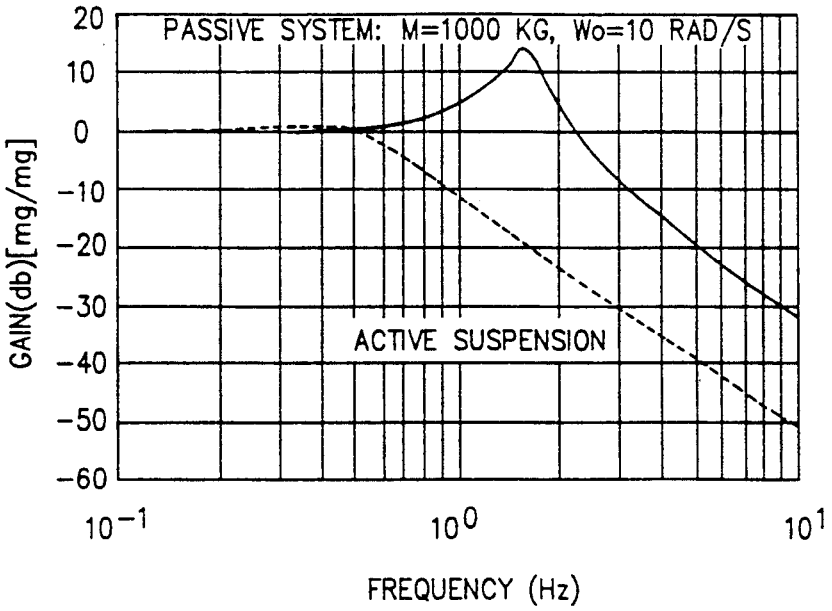
FIG.8 PRIOR ART
FIG. 8 shows attenuation of rail-induced acceleration according to the present invention.

FIG. 8 presents an alternate way of viewing system performance. Plotted is K*G. This is the ratio of car displacement to rail displacement. Also, it is equal to the ratio of car acceleration to acceleration at the rail surface. The significance of this teaching is that it illustrates the use of passive and active suspensions to attenuate rail induced accelerations. The graphs show performance improvement over a "hard ride" with the mass driven directly by the rail. These basic teachings may be used to design an improved active vibration control. A detailed example follows.

Thus, we teach that:

1. Acceleration feedback must be accompanied by an increase in damping.

2. Damping can be derived by integrating the output of an accelerometer.

3. An active vibration control can provide considerable improvement over a passive vibration control. This applies to positional disturbances such as caused by elevator guide rail anomalies and to forces acting directly on the controlled mass (elevator car).

In accordance with an important further teaching of the present invention, a relatively large actuator capable of exerting forces, e.g., greater than 1000 Newtons, which may, but need not, have a rapid response, can be combined with a relatively small actuator capable of exerting forces, e.g., less than 1000 Newtons, in one actuator. This represents an embodiment of our "active" secondary suspension invention, which may be implemented by any type of guide including a roller guide, magnetic bearing, or a sliding guide.

Active Secondary Suspension

Figure 9:
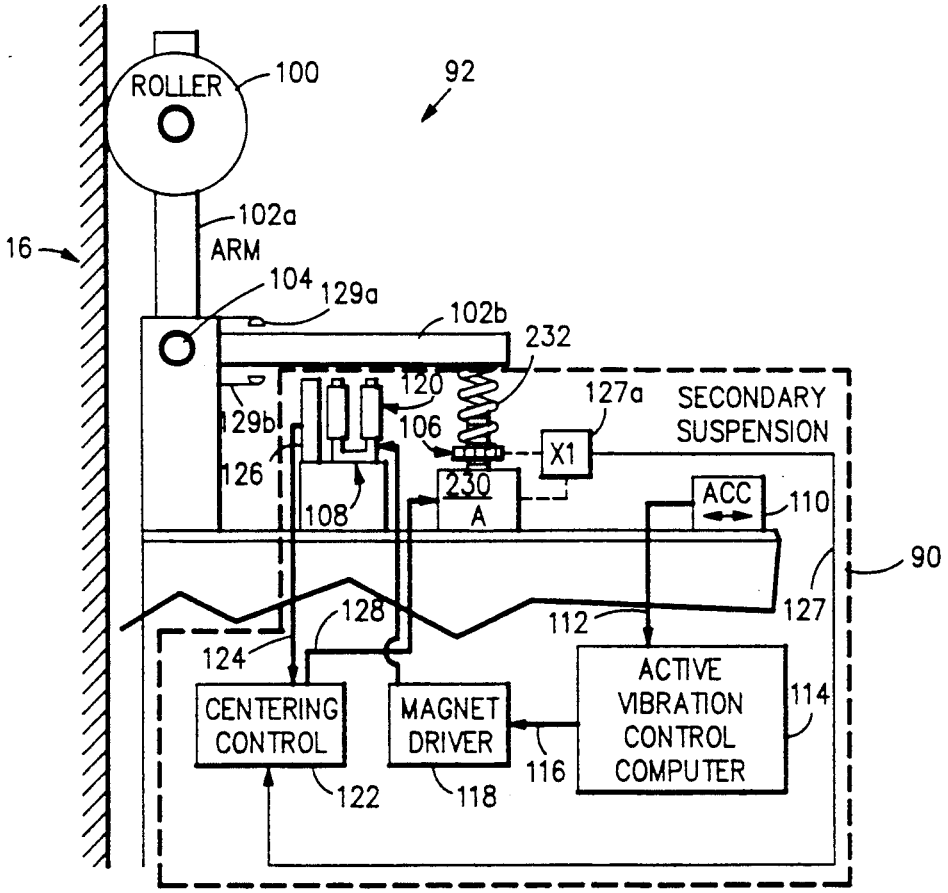
FIG. 9 shows embodiment of the secondary suspension of the present invention incorporated in an active roller guide with both a position-based feedback loop for controlling a relatively large-force actuator and an acceleration-based feedback control loop for controlling a relatively small-force actuator.

FIG. 9 is an illustration of an embodiment 90 of our secondary suspension invention for use with a roller or what we call an "active" roller guide 92. It should be understood, however, that the secondary suspension embodiment 90 shown may be used with a magnetic bearing, a slide guide, or the like, instead of a roller for the primary suspension. Keeping that in mind, a roller 100 rolls on the rail 16 or 18 and is attached to one leg 102*a* of an arm pivoted at a point 104 and having another leg 102*b* actuated by a relatively large-force actuator 106 and a relatively small-force actuator 108. Accelerometer 110 senses horizontal accelerations of the elevator car and provides a sensed signal on a line 112 to an active vibration control device 114, which may be a computer. The control device 114 provides a control signal on a line 116 which may be used to control the relatively small-force actuator 108 y means of a magnet driver 118 for the case where the actuator 108 is an electromagnet 120.

A centering control 122 may be similar to the position control 52 previously described in connection with FIG. 2B, being responsive to a sensed position signal on a line 154 from a gap sensor 126 and may also be responsive to a position signal on a line 127 from a position sensor 127*a* such as a potentiometer, optical sensor, LVDT, motor encoder, etc., for providing a control signal on a line 128 to the actuator 106 to prevent the primary suspension from grounding onto one or more limits 129*a*, 129*b* and for use in preventing opposite suspensions from "fighting" each other, as disclosed below in connection with FIG. 25.

Figure 10:
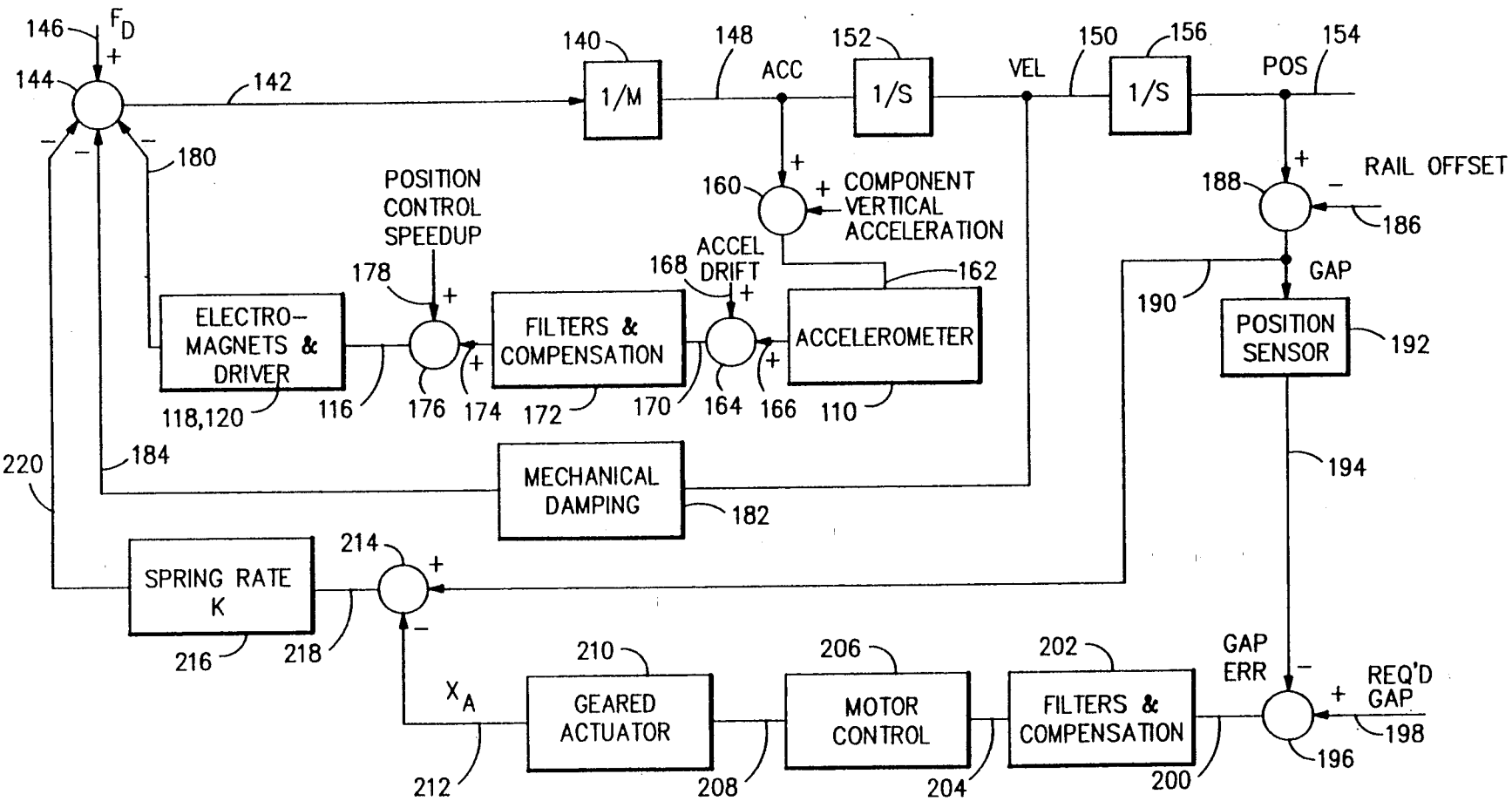
FIG.10 PRIOR ART
FIG. 10 shows a control loop for controlling an active roller guide having both relatively large- and small-force actuators, according to the present invention.

Referring now to FIG. 10, a control is illustrated for an active guide. One such control would be required for the front-to-back secondary suspensions to be described in FIG. 16.

The elevator car is indicated in a block 140 as having a mass M acted on by a plurality of summed forces acting together on a line 142 and provided by a summation point 144 which is in turn responsive to direct-car forces indicated on a line 146, among others, to be described below.

Front-to-back acceleration of the elevator car is manifested by an acceleration as indicated on a line 148, a velocity as indicated by a line 150 (as integrated by the elevator system, as indicated by a block 152), and as further manifested by a change in position of the elevator car as further integrated by the system as indicated by a block 156.

The accelerometer 110 of FIG. 9 may be used to sense the front-to-back acceleration manifested on the line 148 but, because of imperfections in the accelerometer itself, or alignment problems, it will inevitably sense a component of vertical acceleration. Such is shown being summed into a summing junction 160 along with the acceleration itself on line 148, such that the accelerometer 110 is responsive to an acceleration signal on a line 162 corrupted by a component of vertical acceleration. Similarly, the accelerometer will be subject to a drift component as indicated by a further summation in a junction 164 in which a sensed signal on a line 166 from the accelerometer is summed with a signal on a line 168 indicative of accelerometer drift. A summed signal on a line 170 is then provided to a filter and compensation network indicated by a block 172 which, of course, may be implemented in software. The nature of the signal conditioning has already been suggested in connection with FIGS. 3–5 and may be carried out in software by one skilled in the art according to the particular embodiment of this invention. A filtered and compensated signal on a line 174 is provided to a summing junction 176 to which may be added a position control speed-up signal in order to provide a sped-up signal on the line 116, for example, to the electromagnet actuator and driver 118, 120, also shown in the embodiment of FIG. 9. A counteracting force indicated by a line 180 is provided to the summing junction 144 in order to counteract the acceleration sensed by the accelerometer 110.

Mechanical damping may be provided, as indicated in a block 182, responsive to the velocity of the car as indicated on line 150, for providing a mechanical damping force as indicated on a line 184 to the summing junction 144. On the other hand, much can be incorporated in the acceleration loop by electronic signal manipulation or software, as previously explained.

A signal indicative of rail offset from a vertical referent on a line 186 is subtracted from the signal on line 154 indicative of the position of the car by a summing junction 188 which provides a gap signal on a line 190 indicative of the position of the car with respect to the surface of the rail. This may be sensed by a position sensor 192 which in turn provides a position signal on a line 194 to a summing junction 196 for subtraction from a reference signal on a line 198 indicative of a required gap magnitude. A gap error signal is provided on a line 200 to a filtering and compensation network 202, which may be a lag filter for providing, for example, a lag of 1.0 second such that a filtered, averaged or otherwise delay compensated signal on line 204 is provided to a motor control 206 which provides a motor force as indicated on a line 208 for driving an actuator 210 which in turn provides an actuation signal in the form of a positional movement as indicated on a line 212 for combination with the gap as shown on line 190 in a summing junction 214. The spring constant of the actuator spring may, for example, be on the order of 40 Newtons per millimeter. If the gain for the loop is set at around six mm/sec., we get a relatively slow rate of 6 mm/sec$\times$40 N/mm=240 N/sec. So the spring rate 216 which is responsive to a summed signal on a line 218 and Which provides a counteracting force signal on a line 220 for summation With the signals 146, 180, 184 in summing junction 144 need not be particularly fast.

Figure 11:
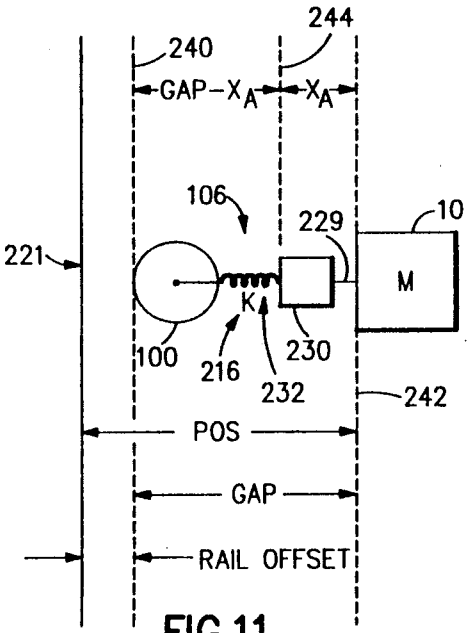
FIG.11 PRIOR ART
FIG. 11 is a schematic illustration of some of the controlled parameters illustrated in FIG. 10, according to the present invention.

FIG. 11 shows in abstract form some of the parameters represented by the signals of FIG. 10 in relation to a vertical referent 221, the car, and the actuator for one of the rollers of a front-to-back roller guide embodiment. The roller on the other side of the rail may, but need not, be directly mechanically connected to the roller 100. However, for the control of FIG. 10, we are assuming that the rollers are mechanically linked, as in FIG. 16, so that FIG. 11 should be viewed in that context, i.e., with only one position controlled (large) actuator for both rollers. If the front-to-back rollers were not directly linked as in FIG. 16, then we would use a control as shown in FIG. 25 for independently driving the two rollers in separate position-based control loops. The car 10 is in this case shown connected by a rigid connection 229 to a block 230 which represents a motor drive actuator attached to the car. The spring part of the actuator 106 is illustrated by a spring 232 which may be a rotary spring having a spring rate 216 as shown in FIG. 10. The spring is attached to the wheel 100 of FIG. 9 by means of the arm 102*a*, 102*b*. The wheel represents the primary suspension of FIG. 2A, and the spring 216 and actuator 230 represent the secondary suspension. Although the secondary suspension is shown rigidly attached to the car, it will be realized that it could be the other way around. Or, one could even omit a rigid attachment altogether by having both sides resiliently connected. In any event, such changes may easily be taken into account by merely changing around the control and diagram shown in FIGS. 10 and 11 to account for same. The principles remain the same.

The rail offset is shown schematically as a dashed line 240 offset by a distance indicative of the distance from the surface of the rail 16 to the vertical referent 221. This offset will, of course, change due to front-to-back imperfections in the installation. It is indicated by the signal on line 186 of FIG. 10. The gap signal on line 190 is shown in FIG. 11 as a distance between the line 240 and a vertical line 242 coincident with the closest vertical edge of the car 10. The position signal on line 154 of FIG. 10 is illustrated as a distance between the vertical referent 221 and the line 242 of FIG. 11.

The movement of the actuator as shown on line 212 in FIG. 10 (which resulted the gap error signal on line 200) is indicated in FIG. 11 as the distance between the line 242 and a line 244. Thus, this distance $X_A$ may be thought of as the position of the actuator which moves according to the magnitude of the gap error signal on line 200. Thus, the difference between the position of the actuator with respect to the car and the gap between the car and rail is indicated in FIG. 11 and corresponds to the distance between lines 240 and 244. It is indicated in FIG. 10 as the signal on line 218. After being subjected to a spring rate in block 216 of FIG. 10, it of course becomes transformed into a force as indicated on line 220 for summation in the summing junction 144 for counteracting front-to-back rail offsets from true vertical.

Figure 12:
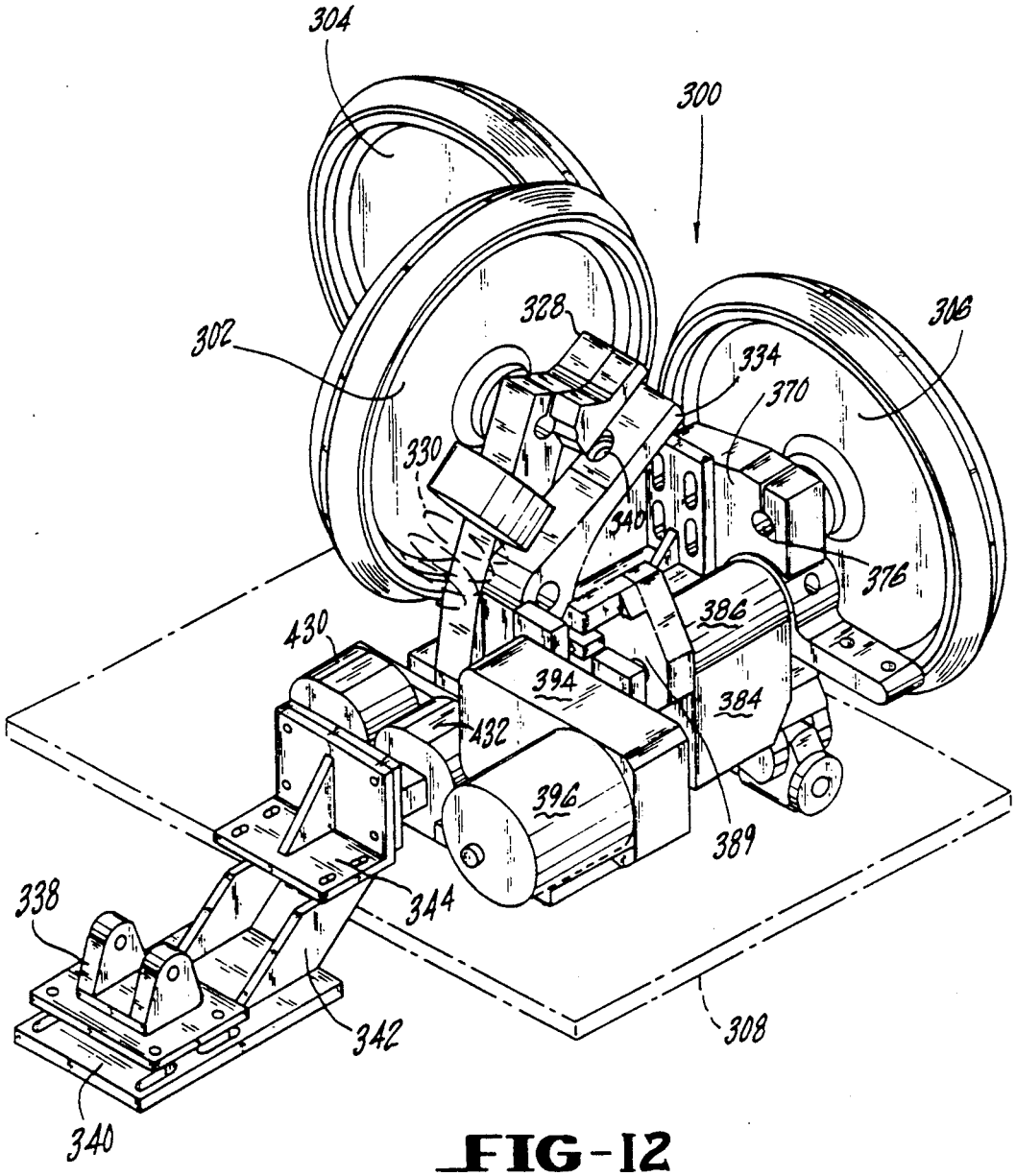
FIG. 12 is a perspective view of a primary suspension comprising a guide roller cluster which is adapted for use with an embodiment of a secondary suspension according to the present invention.
Figure 13:
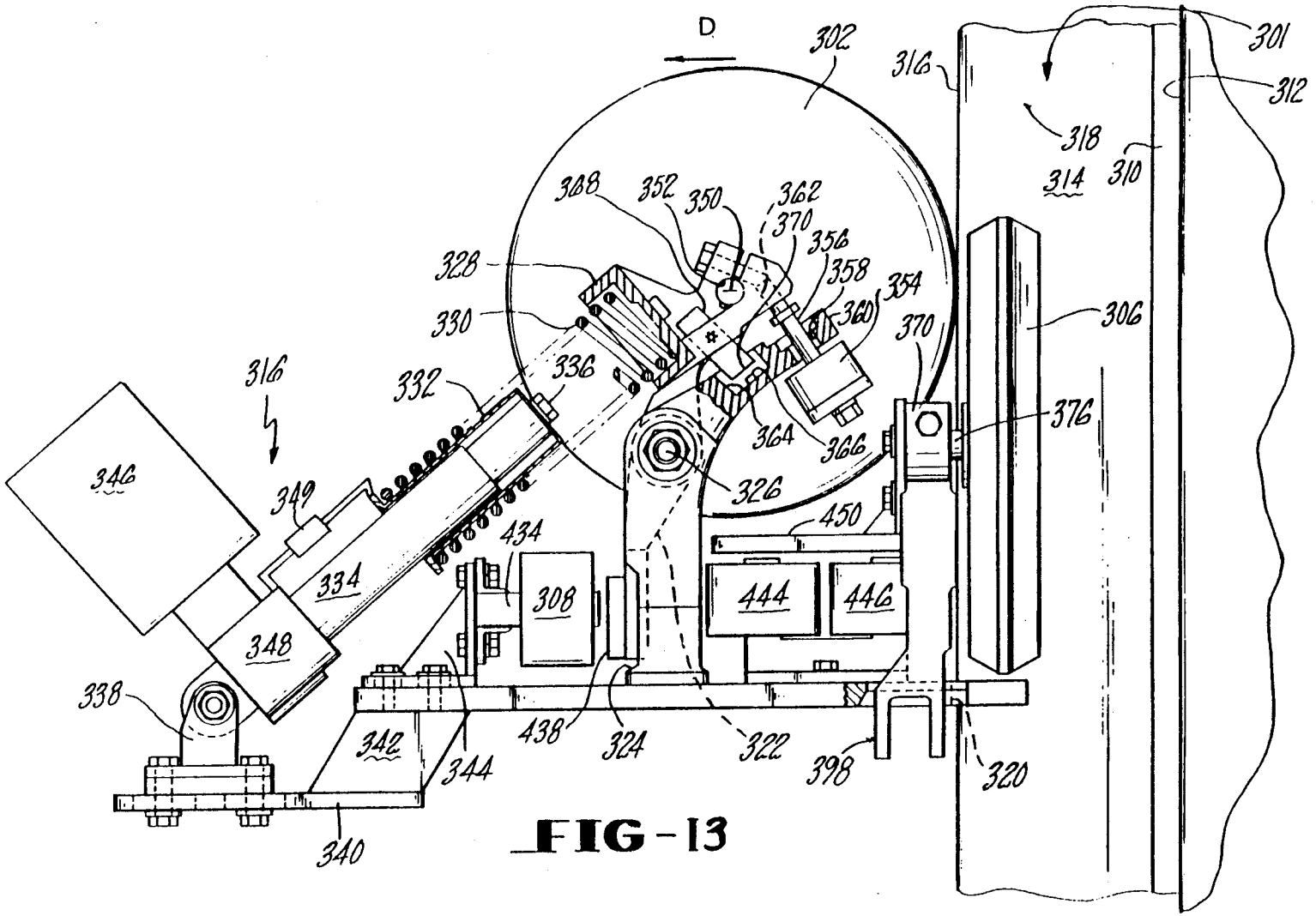
FIG. 13 is a side elevational view of the guide roller cluster of FIG. 12 showing details of the secondary suspension's side-to-side roller adjustment mechanism.

FIGS. 12 and 13 are still other illustrations of an embodiment of a secondary suspension, according to the present invention, in the form of an "active" roller guide, showing details of a primary suspension in the form of a roller cluster 300. Although one of the rollers (side-to-side) is elevated with respect to the other two, it will be appreciated that the roller cluster 300 is a relatively conventional arrangement of rollers on a rail 301. However, we are only aware of such clusters being used passively and we know of no such prior art roller cluster used with actuators. Further to this embodiment of our invention, we teach the use of actuators with such a cluster which is further shown in a novel manner with a unique selection and arrangement of actuators to operate in accordance with this invention.

The cluster 300 includes a side-to-side guide roller 302 and front-to-back guide rollers 304 and 306. The roller cluster 300 is mounted on a base plate 308 which is fixed to an elevator cab frame crosshead (not shown). The guide rail 301 will be a conventional, generally T-shaped structure having basal flanges 310 for securement to the hoistway walls 312, and a blade 314 which projects into the hoistway toward the rollers 302, 304 and 306. The blade 314 has a distal face 316 which is engaged by the side-to-side roller 302, and side faces 318 which are engaged by the front-to-back rollers 304 and 306. The guide rail blade 314 extends through a slot 320 in the roller cluster base plate 308 so that the rollers 302, 304 and 306 can engage the blade 314.

As shown most clearly in FIG. 13, the side-to-side roller 302 is journaled on a link 322 which is pivotally mounted on a pedestal 324 via a pivot pin 326. The pedestal 324 is secured to the base plate 308. The link 322 includes a cup 328 which receives one end of a coil spring 330. The other end of the spring 330 is engaged by a spring guide 332 which is connected to the end of a telescoping ball screw adjustment device 334 by a bolt 336. The adjuster 334 can be extended or retracted to vary the force exerted on the link 322, and thus on the roller 302, by the spring 330. The ball screw device 334 is mounted on a clevis 338 bolted to a platform 340 which in turn is secured to the base plate 308 by brackets 342 and 344. The use of the platform 340 and brackets 342 and 344 allows the assembly to be retrofitted on a conventional roller guide assembly directly on the existing base plate 308. The ball screw device 334 is powered by an electric motor 346. A ball screw actuator suitable for use in connection with this invention can be obtained from Motion Systems Corporation, of Box 11, Shrewsbury, N.J. 07702. The actuator motor 346 can be an AC or a DC motor, both of which are available from Motion Systems Corporation. The Motion systems Model 85151/85152 actuator has been found to be particularly suitable for use in this invention. These devices have the AC or DC motor 346 attached to a gear reducer 348 for motor speed reduction to drive the ball drive actuator which is an epicyclic ball screw 334, only the cover of which is shown. Or, a brushless DC motor may be provided. Although shown only schematically, a position sensor 349 such as a potentiometer or optical sensor may be attached to the car frame by attachment to the reducer 348 to a lip on the rear of the spring holder 332 in order to measure the linear extension of the screw. Such a position sensor fulfills the role of the sensor 127*a* shown in FIG. 9. Of course, other position sensors may be used as well.

The guide roller 302 is journaled on an axle 350 which is mounted in an adjustable receptor 352 in the upper end of the link 322. A pivot stop 354 is mounted on a threaded rod 356 which extends through a passage 358 in the upper end 360 of the pedestal 324. The rod 356 is screwed into a bore 362 in the link 322. The stop 354 is operable by selective engagement with the pedestal 324 to limit the extent of movement of the link 322 in the counter-clockwise direction about the pin 326, and therefore limit the extent of movement of the roller 302 in a direction away from the rail, which direction is indicated by an arrow D. The pedestal 324 is formed with a well 364 containing a magnetic button 366 which contains a rare earth compound. Samarium cobalt is a rare earth compound which may be used in the magnetic button 366. A steel tube 368 which contains a Hall effect detector (not shown) proximate its end 370 is mounted in a passage which extends through the link 322. The magnetic button 366 and the Hall effect detector form a proximity sensor which is operably connected to a switch controlling power to the electric motor 346. The proximity sensor detects the spacing between the magnetic button 366 and the steel tube 368, which distance mirrors the distance between the pivot stop 354 and the pedestal 324. Thus as the tube 368 and its Hall effect detector move away from the magnet 366, the pivot stop 354 moves toward the pedestal 324. The detector produces a signal proportional to the size of the gap between the detector and the magnetic button 366, which signal is used to control the electric motor 346 whereby the ball screw 334 jack is caused to move the link 322 and roller 302 toward or away from the rail, as the case may be. Depending on the type of control system employed, the stop 354 may be prevented from contacting or at least prevented from establishing prolonged contact with the pedestal 324. This ensures that roller 302 will continue to be damped by the spring 330 and will not be grounded to the base plate 308 by the stop 354 and pedestal 324. Side-to-side canting of the car by asymmetrical passenger loading or other direct car forces is also corrected. As mentioned, the electric motors 346 can be reversible motors whereby adjustments on each side of the cab can be coordinated in both directions, both toward and away from the rails.

Figure 14:
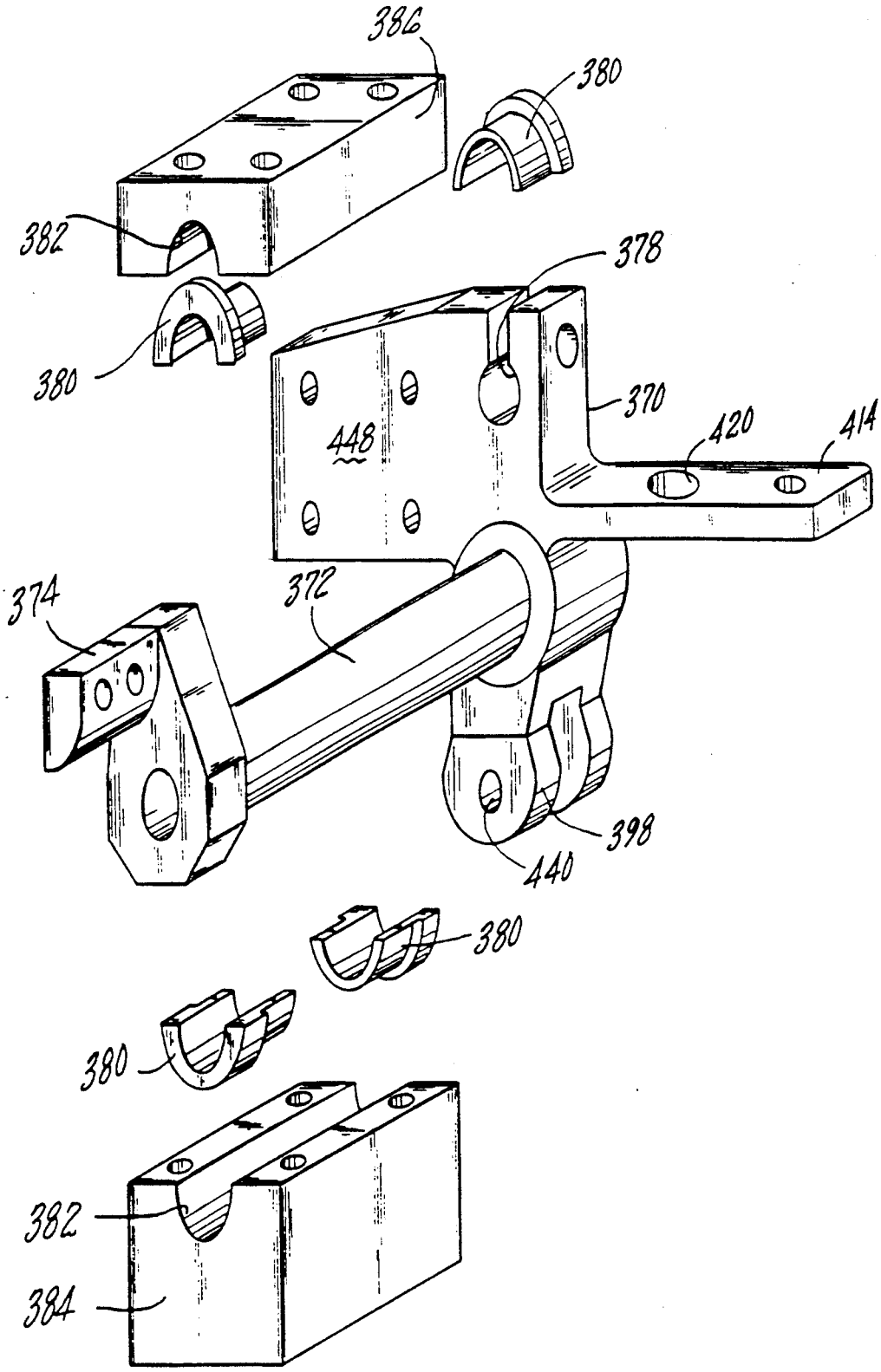
FIG. 14 is an exploded, schematic view of the front-to-back secondary suspension's roller adjustment crank to which the spring of FIG. 15 is connected.
Figure 15:
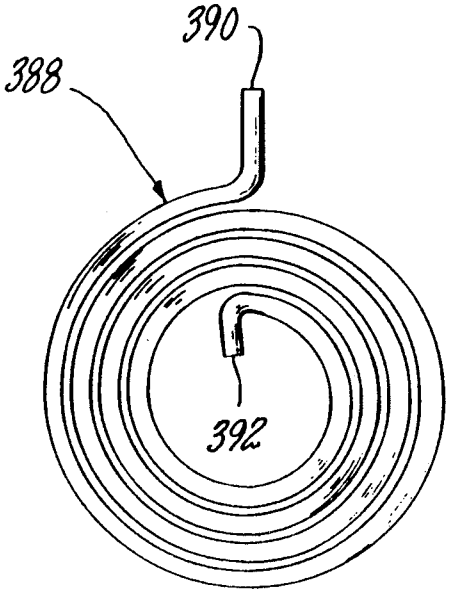
FIG. 15 is a plan view of the flat spiral spring used in the front-to-back secondary suspension for damping and adjusting the front and back primary suspension rollers in the cluster.

Referring now to FIGS. 12, 13 and 14, the mounting of the front and back rollers 304, 306 on the base plate 308 will be clarified. Each roller 304, 306 is mounted on a link 370 connected to a pivot pin 372 which carries a crank arm 374 on the end thereof remote from the roller 304, 306. Axles 376 of the rollers 304, 306 are mounted in adjustable recesses 378 in the links 370. The pivot pin 372 is mounted in split bushings 380 which are seated in grooves 382 formed in a base block 384 and a cover plate 386 which are bolted together on the base plate 308. A flat spiral spring 388 (see FIG. 15) is mounted in a space 389 (see FIG. 12) and has its outer end 390 connected to the crank arm 374, and its inner end 392 connected to a rotatable collar (not shown) which is rotated by a gear train (not shown) mounted in a gear box 394, which gear train is rotated in either direction by a reversible electric motor 396. The spiral spring 388 is the suspension spring for the roller 306, and provides the spring bias force which urges the roller 306 against the rail blade 318. The spiral spring 388, when rotated by the electric motor 396 also provides the recovery impetus to the roller 306 through crank arm 374 and pivot pin 372 to offset cab tilt in the front-to-back directions caused by front-to-back direct car forces such as asymmetrical passenger loading of the car.

A rotary position sensor (not shown) such as an RVDT, a rotary potentiometer or the like, may be provided for fulfilling the function of the sensor 127*a* of FIG. 9. Such sensor may be attached at one end to the crank arm 374 and on the other to the base 308.

Figure 16:
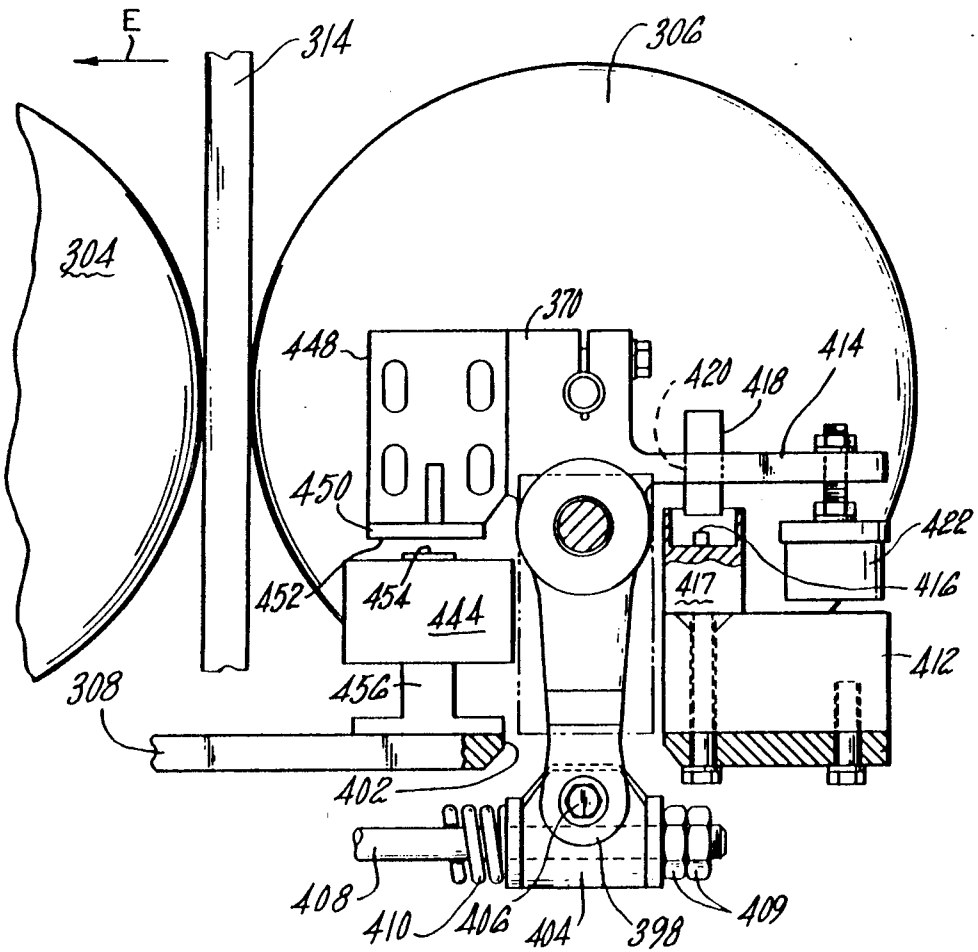
FIG. 16 is a front elevational view of the front and back guide, rollers of the primary suspension cluster.

Each roller 304 and 306 can be independently controlled, as shown below in FIG. 25, by respective electric motors and spiral springs if desired, or they can be mechanically interconnected and controlled by only one motor/spring set, as shown in FIGS. 10, 11, 12, and 16. Details of an operable interconnection for the rollers 304 and 306 are shown in FIG. 16. It will be noted in FIGS. 14 and 16 that the links 370 have a downwardly extending clevis 398 with bolt holes 400 formed therein. The link clevis 398 extends downwardly through a gap 402 in the mounting plate 308. A collar 404 is connected to the clevis 398 by a bolt 406. A connecting rod 408 is telescoped through the collar 404, and secured thereto by a pair of nuts 409 screwed onto threaded end parts of the rod 408. A coil spring 410 is mounted on the rod 408 to bias the collar 404, and thus the link 370 in a counter-clockwise direction about the pivot pin 372, as seen in FIG. 16. It will be understood that the opposite roller 304 has an identical link and collar assembly connected to the other end of the rod 408 and biased by the spring in the clockwise direction. It will be appreciated that movement of the link 370 in clockwise direction caused by the electric motor 396 will also result in movement of the opposite link in a counter-clockwise direction due to the connecting rod 408. At the same time, the spring 410 will allow both links to pivot in opposite directions if necessary due to discontinuities on the rail blade 318. A flexible and soft ride thus results even with the two roller links tied together by a connecting rod.

As shown in FIG. 16, a stop and position sensor assembly similar to that previously described is mounted on the link 370. A block 412 is bolted to the base plate 308 below an arm 414 formed on the link 370. A cup 416 is fixed to the block 412 and contains a magnetic button 416 formed from a rare earth element such as samarium cobalt. A steel tube 418 is mounted in a passage 420 in the link arm 414, the tube 418 carrying a Hall effect detector in its lower end so as to complete the proximity sensor which monitors the position of the link 370. A pivot stop 422 is mounted on the end of the link arm 414 opposite the block 412 so as to limit the extent of possible pivotal movement of the link 370 and roller 306 away from the rail blade 314. The distance between the pivot stop 422 and block 412 is proportional to the distance between the Hall effect detector and the magnetic button 416. The Hall effect detector is used as a feedback signal operable to activate the electric motor 396, for example, whenever the stop 422 comes within a preset distance from the block 412, whereupon the motor 112 will pivot the link 86 via the spiral spring 104 to move the stop 136 away from the block 124 or, as another example, in a proportional, proportional-integral, or proportional-integral-derivative type feedback loop so that the position signal is compared to a reference and the difference therebetween is more or less continually zeroed by the loop. The position sensor 127*a* of FIG. 9 may also be used to keep track of the position of the actuator with respect to the base 308 as described below in connection with FIG. 25. In any event, this movement will push the roller 306 against the rail blade 314 and will, through the connecting rod 408, pull the roller 304 in the direction indicated by the arrow E, in FIG. 16. The concurrent shifting of the rollers 304 and 306 will tend to rectify any cant or tilting of the elevator cab in the front-to-back direction caused, for example, by asymmetrical passenger loading.

Figure 17:
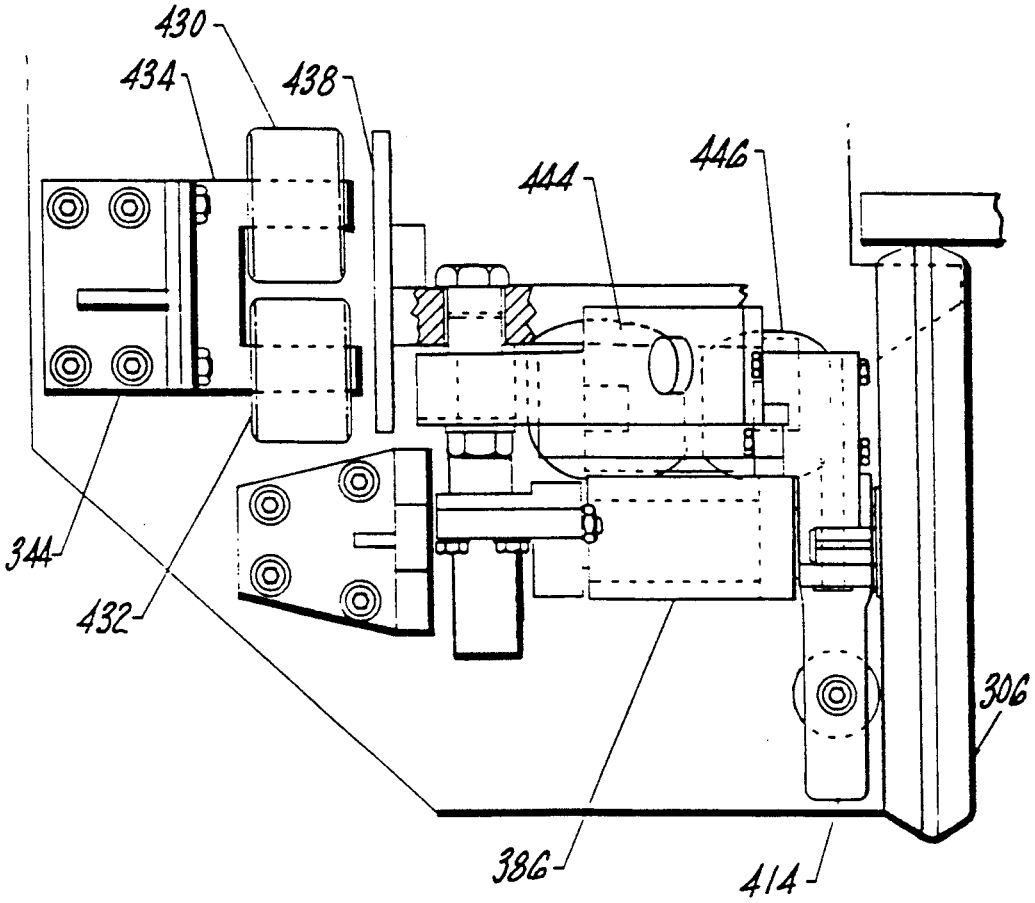
FIG. 17 is a partial plan view of the secondary suspension and one of the rollers of the guide rail cluster of the primary suspension of FIG. 12 showing the positioning of the electromagnets of a relative small-force actuator.

Referring now to FIGS. 12, 13 and 17, an electromagnet with coils 430, 432 is mounted on a U-shaped core 434 which is in turn mounted on the bracket 344. The bracket 344 is itself mounted on the base plate 308. As previously described, the shaft 334 of the ball drive exerts forces along the axis of the ball screw against the pivoted link 322. The link 322 pivots at the point 326 and extends down below the pivot point to the electromagnet coils 430, 432 and has a face 438 separated from the core faces of the electromagnet core 434 for receiving electromagnetic flux across a gap therebetween.

Figure 18:
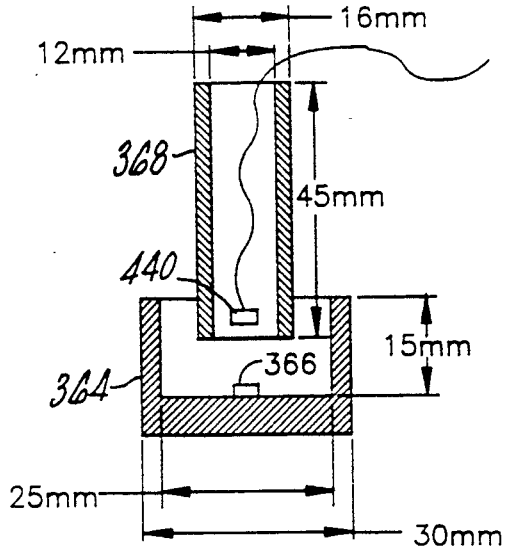
FIG. 18 PRIOR ART
FIG. 18 shows a gap sensor, according to the present invention.

FIG. 18 is an illustration of the cup 364, which should be of ferromagnetic material, with the rare earth magnet 366 mounted therein. The depression in the cup may be 15 mm deep and have an inside diameter of 25 mm and an outside diameter of 30 mm, as shown, for example. The sleeve 368 may have a length of 45 mm with an inside diameter of 12 mm and an outside diameter of 16 mm, for example. A hall cell 440 is shown positioned near the opening of the tube 368 so as to be in position to sense the flux from magnet 366. The composition of the tube is ferromagnetic, according to the teachings of the present invention, in order to enhance the ability of the hall cell to sense the flux from the magnet and also to provide shielding from flux generated by the electromagnets mounted elsewhere on the roller guide.

Specification for Position Transducers

1. Magnetic transducer may be used.
2. Operating Range: 10 mm
3. Repeatability: 0.1 mm
4. Temperature Range: 0°-55° C.
5. Temperature Coef.: <0.02%/C.
6. Magnetic Field Sensitivity: 100 Gauss at a distance of 30 mm should not affect transducer output by more than 0.5%.
7. Power Voltage: 9-15 VDC
8. Leads: Use separate signal and power grounds. Use twisted shielded pairs.

Figure 19:
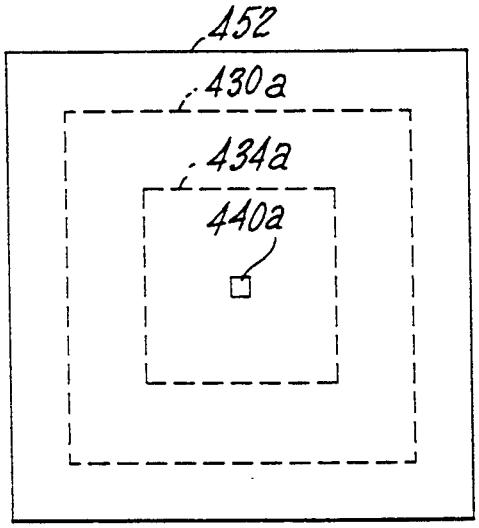
FIG. 19 PRIOR ART
FIG. 19 shows a flux sensor which may be used in the acceleration loop of FIG. 10, according to the present invention.

FIG. 19 shows such a hall cell 440*a* mounted on a face of the reaction plate 438 with a projection 434*a* of the electromagnet core 434 onto the plate 438 associated with coil 430 (shown also in a projection 430*a*) shown in FIGS. 12, 13 and 17. The sensor can also be mounted on the face of the core itself but could get overheated in that position. This sensor may be used on the electromagnet shown below in FIG. 22, in a manner similar to that shown in co-pending application Ser. No. 07/555,130 for flux feedback in a force actuator.

Specification for Hall Sensor Assembly

1. Application is on or opposite face of electromagnet.
2. Operation Range: 0.05 to 1.0 Telsa
3. Accuracy: 5% tolerable, 2% desired
4. Scale Factor: 10 V/Tesla
5. Temperature Range: 0°-55° C.
6. Temperature Coef.: <0.02%/C.
7. Thickness: Must not exceed 2.0 mm
8. Power Voltage: ±12 to 15 VDC
9. Leads: Use separate signal and power grounds. Use twisted shielded pairs.

Turning again now to the front-to-back roller 306, a pair of electromagnets 444, 446 is shown in FIG. 13. A block 448 portion of link 370, shown in FIG. 14 in perspective and in FIG. 16 in section, has an extension 450 shown in FIGS. 13 and 16 (not shown in FIG. 14) having a face 452 opposite a pair of core faces associated with a core 456 upon which coils 444, 446 are mounted, only one face 454 of which is shown in FIG. 16.

Figure 20:
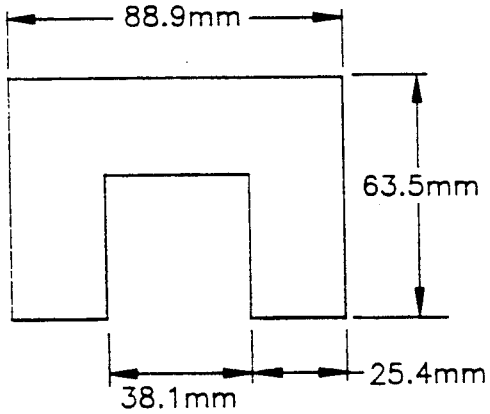
FIG. 20 PRIOR ART
FIG. 20 shows a side view of an electromagnet core, according to the present invention.
Figure 21:
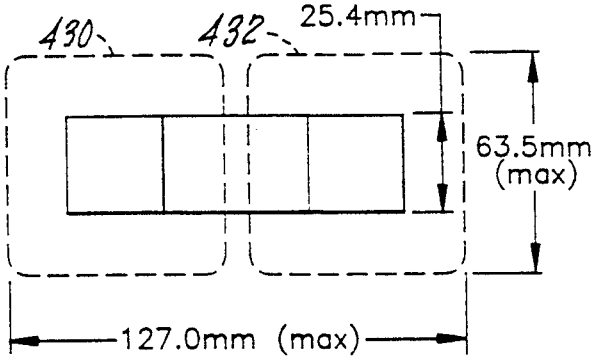
FIG. 21 PRIOR ART
FIG. 21 shows a top view of the core of FIG. 20 with coils in phantom, according to the present invention.

FIG. 20 is a side view of a ferromagnetic core such as is used for mounting the coils 430, 432 of FIG. 12 or the coils 444, 446 of FIG. 13. The dimensions shown are in millimeters. FIG. 21 shows a top view of the same core with the depth dimensions shown along with a pair of coils shown in dashed lines. The core of FIGS. 20 and 21 may be made of grain-oriented (M6) 29 gauge steel, mounted on an angle iron by means of a weld, for example. The coils 430, 432, for example, will be required in pairs, each having, for example, 350 turns of wire having a diameter of 1.15 mm. The coil connection should be series with the possibility made for parallel reconnection. The wire insulation can be heavy (double) build GP200 or equivalent rated at 200° C. The impregnation can be vacuum-rated at 180° C. or higher. The coil working voltage may be on the order of around 250 volts and the coil itself may be high potential to ground tested at 2.5 kilovolts or similar, as required. The coil leads for hookup may be stranded wire, having a diameter of 1.29 mm, and about 50 centimeters in length. The weight is approximately 2.0 kilograms, consisting of 0.8 kg of iron and 1.2 kg of copper. At an air gap of 2-10 mm with a flux density of about 0.6 Tesla, a force of about two hundred Newtons can be achieved. Such a design is adequate for the active roller guide disclosed above. It has a force capability reserve of more than twice needed.

Figure 22:
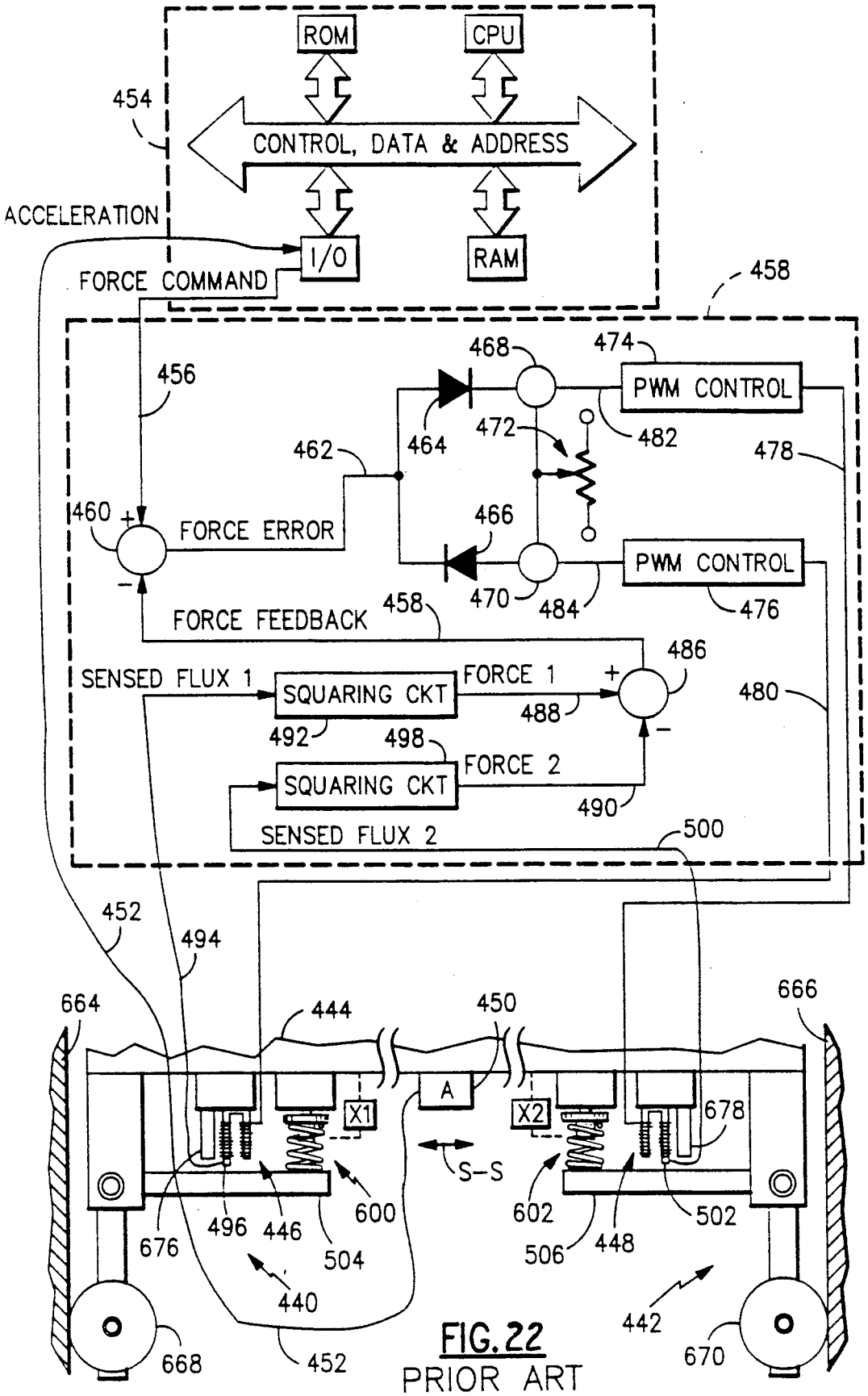
FIG. 22 PRIOR ART
FIG. 22 is a simplified block diagram of a steering circuit for controlling two active guides situated on opposite sides of an elevator car for side-to-side control but which may be used for front-to-back control of suspensions on opposite sides of a rail blade, according to the present invention.
Figure 23:
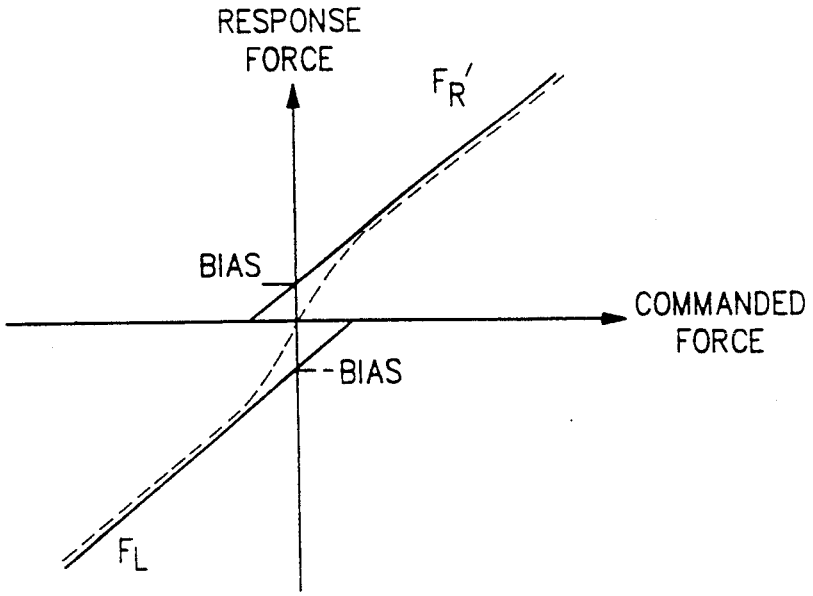
FIG. 23 PRIOR ART
FIG. 23 is a plot of a biasing technique for controlling a pair of opposite electromagnets wherein, for example, the force command for the righthand active guide of FIG. 22 is biased in a positive direction and the force command for the lefthand guide is biased in a negative direction to provide a composite response that avoids abrupt switching between the pair, according to the present invention.

FIG. 22 illustrates a pair of active roller guides 440, 442 mounted on the bottom of an elevator car 444 for side-to-side secondary suspension. FIG. 22 also illustrates a control for a corresponding pair of electromagnets 446, 448. Acceleration feedback is utilized in the described control circuit for the electromagnets, although other means of control may be used. Acceleration control will be described again (in more abstract form) in conjunction with position control of the high-force actuators in connection with FIG. 25. An accelerometer 450 measures the side-to-side acceleration at the bottom of the platform, and it may be positioned inbetween the two active roller guides 440, 442. The direction of sensitivity of the accelerometer is shown by an arrow labeled S—S and would be perpendicular to the hoistway walls. A sensed signal on a line 452 is provided to a signal processor 454 which, in response thereto, provides a force command signal on a line 456 to a second signal processor 458 which may be made up of discrete components in order to provide faster response. The force command signal on line 456 is summed with a force feedback signal on a line 458 in a summer 460 which provides a force error signal on a line 462 to a steering circuit comprising a pair of diodes 464, 466. A positive force error signal will result in conduction through diode 464 while a negative force error signal will result in conduction through diode 466. In order to prevent abrupt turn-on and turn-off, action of the two electromagnets 446, 448 near the crossover between positive force response and negative force response as shown in FIG. 23, a bias voltage is provided to bias the left and right signals provided to the PWM controls. This is done by means of a pair of summers 468, 470 from a potentiometer 472 which is biased with an appropriate voltage to provide the force summation technique illustrated in FIG. 23. This allows a smooth transition between the two electromagnets. A pair of pulse width modulated controls 474, 476 are responsive to summed signals from the summers 468, 470 and provide signals on lines 478, 480 having variable duty cycles according to the magnitudes of signals on line 482, 484 from the summers 468, 470, respectively.

The force feedback on line 458 is provided from a summer 486 responsive to a first force signal on a line 488 and a second force signal on a line 490. A squaring circuit 492 is responsive to a sensed flux signal on a line 494 from a Hall cell 496 and provides the first force signal on line 488 by squaring and scaling the flux signal on line 494. Similarly, a squaring circuit 498 is responsive to a sensed flux signal on a line 500 from a Hall call 502. The pair of Hall cells 496, 502 are mounted on one of the core faces of their respective electromagnets in order to be in a position to sense the flux between the electromagnet and the respective arms 504, 506 of the roller guides 440, 442.

The signal processor 454 of FIG. 22 will be programmed to carry out the compensation described in detail in connection with FIGS. 3, 4 and 5.

Figure 24A:
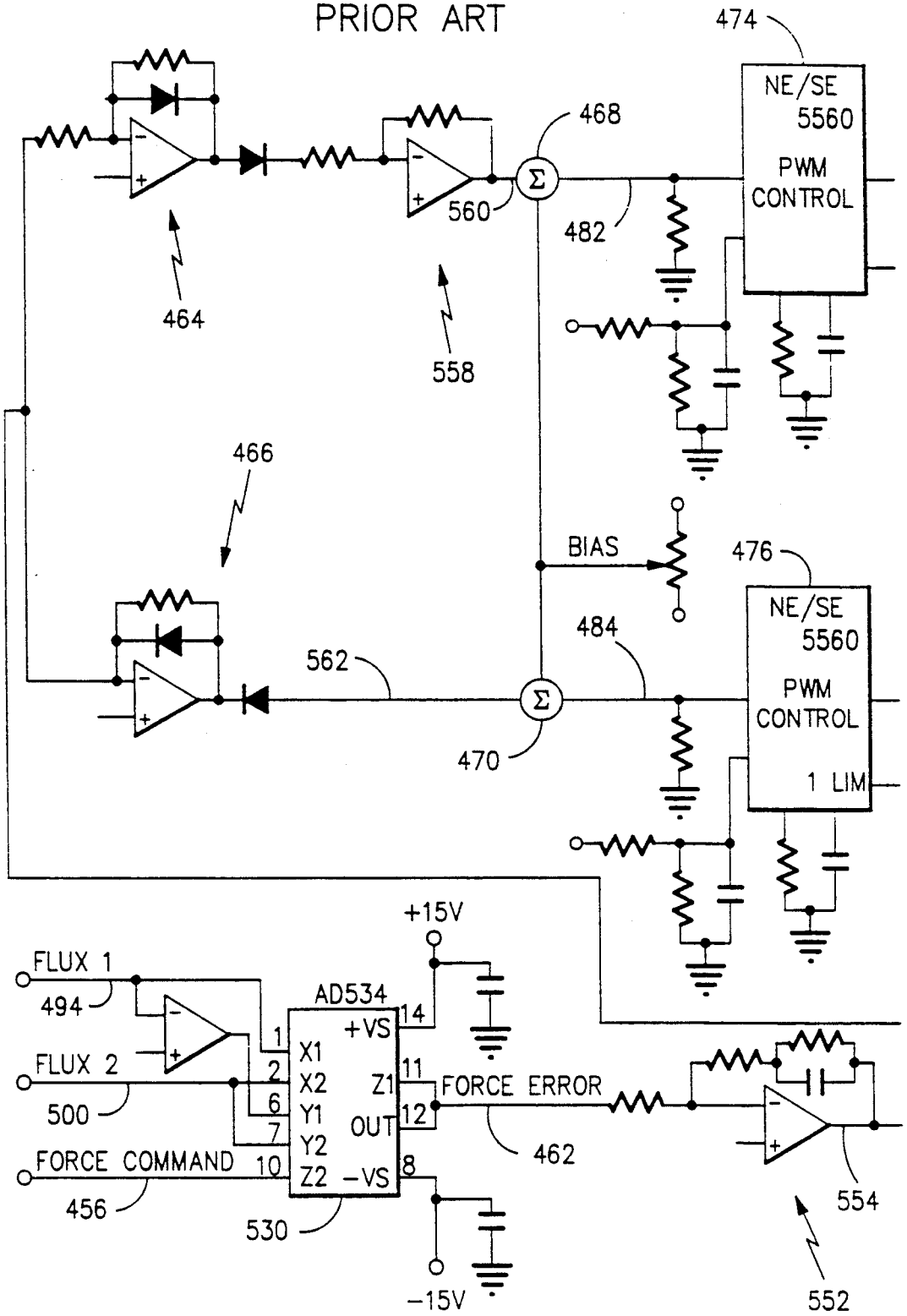
FIG.24A PRIOR ART
FIG. 24 is a more detailed illustration of the discrete signal processor of FIG. 22, according to the present invention.
Figures 24, 24B:
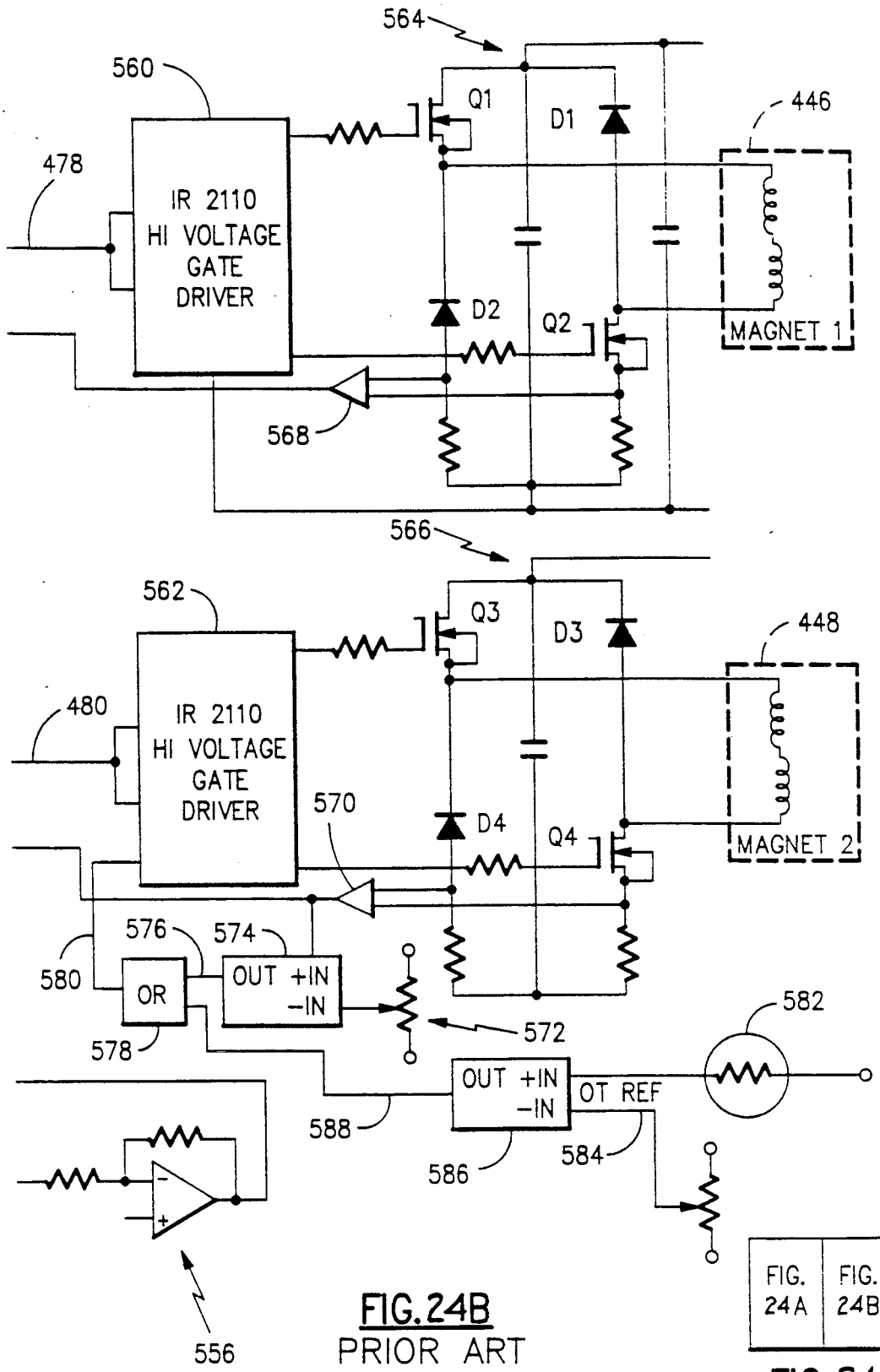
FIG. 24B PRIOR ART
FIG. 24 PRIOR ART

The signal processor 458 of FIG. 22 is shown in more detail in FIG. 24. There, an integrated circuit 530, which may be an Analog Device AD534, is responsive to the force command signal on line 456, the first flux signal on line 494, and the second flux signal on line 500 and provides the force error signal on line 462 as shown in FIG. 22. A PI controller 552 amplifies the force error signal and provides an amplified signal on a line 554 to a 100 volt per volt (gain of 100) circuit to the precision rectifier or diode steering circuits 464, 466, similar to that shown in simplified form in FIG. 22. An inverter 558 inverts the output of steering circuit 464 so that signals on lines 560, 562 applied to summers 468, 470 are of corresponding polarities. The summed signals on lines 482, 484 are provided to PWM controllers which may be a Signetics NE/SE 5560 type controllers. These provide variable duty cycle signals on the lines 478, 480, which are in turn provided to high voltage gate driver circuits 560, 562 which in turn provide gating signals for bridge circuits 564, 566 which provide current to the electromagnets 446, 448.

Amplifiers 568, 570 monitor the current in the bridge and provide a shutdown signal to the PWM controls 474, 476 in the presence of an overcurrent.

Also, a reference signal can be provided by a potentiometer 572 to a comparator 574 which compares the output of current sensor 570 to the reference signal and provides an output signal on a line 576 to an OR gate 578 which provides the signal on line 576 as a signal on a line 580 to the high voltage gate driver 562 in the case where the signal from the current sense 570 exceeds the reference from reference potentiometer 572. Also, a thermistor or thermocouple can be used on the heat sink of the circuit shown in order to be compared to an over-temperature reference signal on a line 584 in a comparator 586. The comparator 586 will provide an output signal on a line 588 to the OR gate 578 in cases where the temperature of the heat sink exceeds the over-temperature reference. In that case, the signal on the line 580 is provided to the high voltage gate driver to shut down the H-bridge. Although most of the above-described protective circuitry of a current and over-temperature is not shown for the H-bridge for magnet number 1 (446), it should be realized that the same can be equally provided for that bridge, but is not shown for purposes of simplifying the drawing.

Figure 25A:
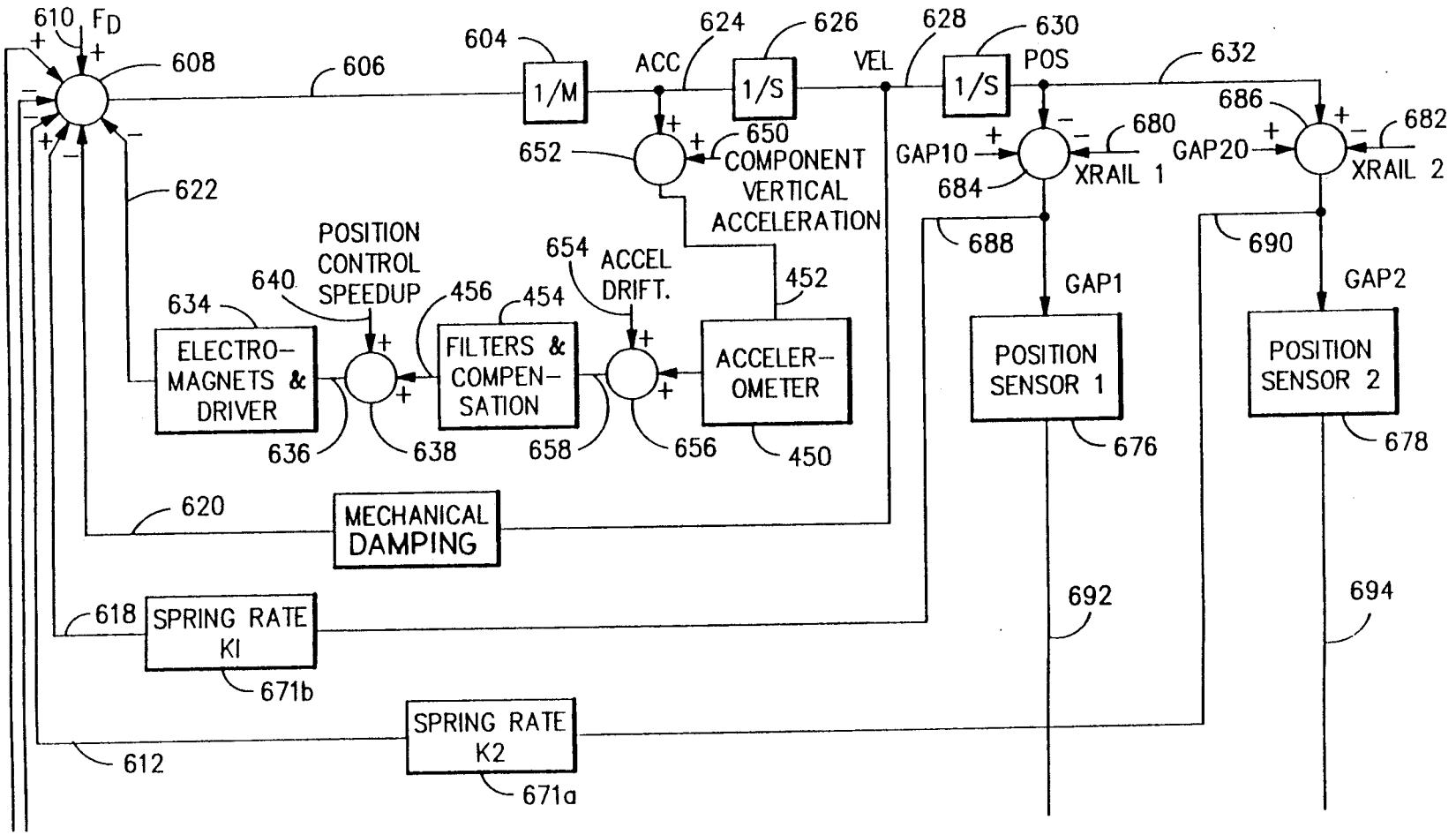
FIG. 25A PRIOR ART
FIG. 25 is a control scheme for a pair of active guides such as are shown in FIG. 22 including control of both the small actuators and the large actuators and including a steering arrangement for the large actuators, according to the present invention.
Figures 25, 25B:
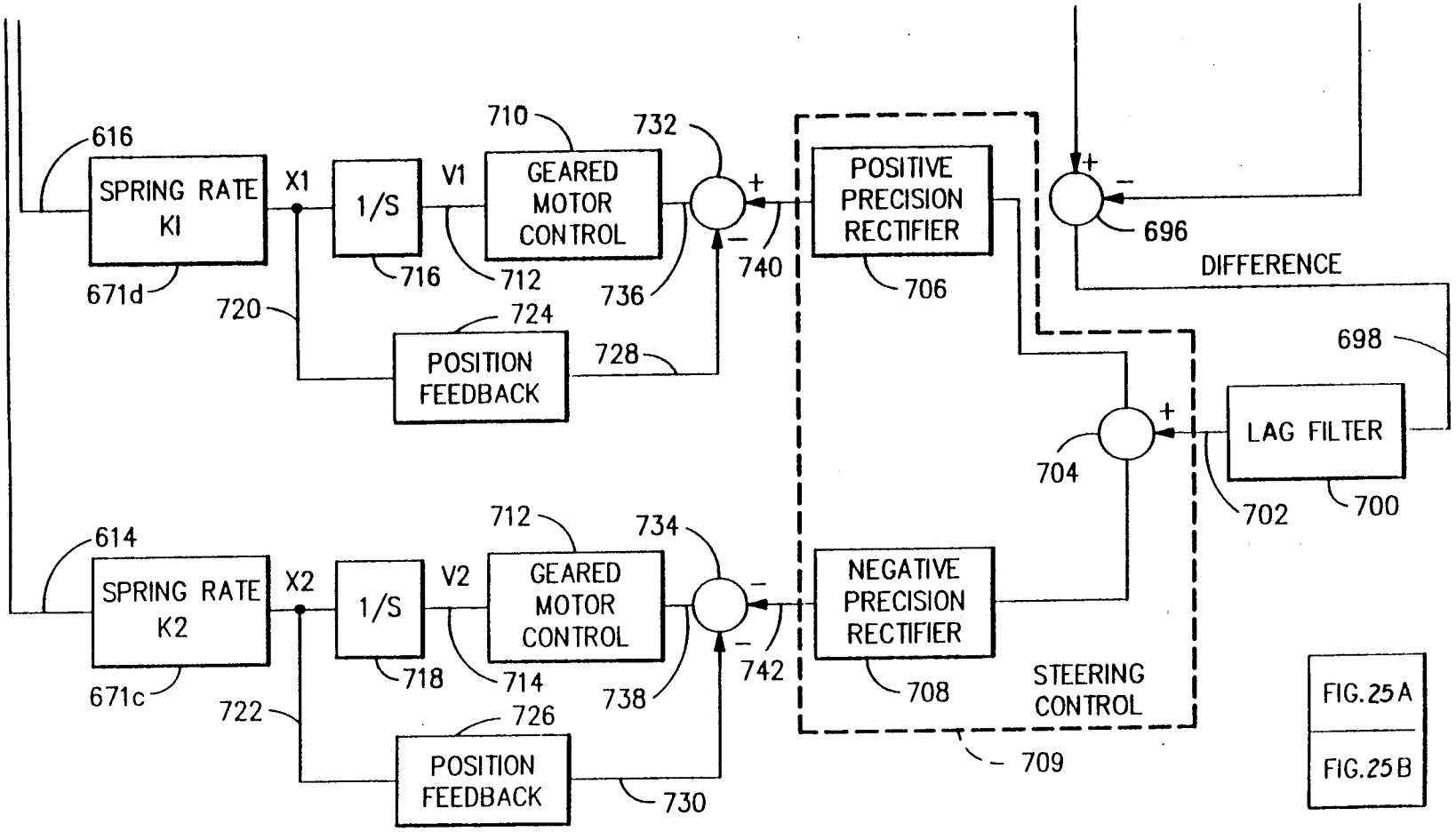
FIG.25 PRIOR ART
FIG.25B PRIOR ART

Turning now to FIG. 25, a system-level diagram is presented to show a control scheme for a pair of opposed secondary suspensions such as for the suspensions 30, 31*b* of FIG. 2A and such as the two side-to-side active roller guides 440, 442 of FIG. 22. The diagram includes both acceleration feedback as described, for example, in detail above for the pair of small actuators 446, 448 and position feedback for a pair of high-force actuators such as the screw actuators 600, 602. It should be understood that the scheme of FIG. 25 is also applicable to independently controlled opposed (on opposite sides of the same rail blade), front-to-back suspensions, i.e., for those not mechanically linked as in FIG. 16. The elevator car mass 604 is shown in FIG. 25 being acted on by a net force signal on line 606 from a summer 608 which is responsive to a disturbing force on a line 610 and a plurality of forces represented on lines 612, 614, 616, 618, 620, and 622, all for summation in the summer 608. The disturbing force on line 610 may represent a plurality of disturbing forces, all represented on one line 610. These disturbing forces may include direct car forces or rail-induced forces. The distinction between the two types of forces is that direct car forces tend to be higher force, but slower acting, such as wind, or even static, such as load imbalances, while rail-induced forces are low force disturbances at higher frequencies. The forces represented on lines 612–622 represent forces which counteract the disturbing forces represented on line 610. In any event, the net force on line 606 causes the elevator mass 604 to accelerate as manifested by an acceleration as shown on a line 624. The elevator system integrates the acceleration as indicated by an integrator 626 which is manifested by the car moving at a certain velocity as indicated by a line 628 which is in turn integrated by the elevator system as indicated by an integrator 630 into a position change for the elevator car mass as indicated by a line 632.

Both of the electromagnets 446, 448 and driver, as represented by the signal processor 458 of FIG. 22, are together represented in FIG. 25 as a block 634 responsive to a signal on a line 636 from a summer 638 which is in turn responsive to the force command signal on line 456 from the digital signal processor 454 of FIG. 22, represented in FIG. 25 as a "filters & compensation" block similarly numbered as 454. This block carries out the compensation and filtering described in detail in connection with FIGS. 4 and 5. A position control speed-up signal on a line 640 may be provided from the gap error signal on line 698. Suffice it to say that the speed-up signal may be used to permit the fast control to assist the slow control. Such assistance is also inherently provided by direct sensing by the accelerometer. The accelerometer 450 of FIG. 22 is shown in FIG. 24 being responsive to the elevator car acceleration, as represented on line 624 but as also corrupted by a vertical component of acceleration, as shown on a line 650, being summed with the actual acceleration in a summer 652. Thus, the side-to-side acceleration shown in FIG. 22 on the line labeled S—S may be corrupted by a small vertical component so that the signal on line 452 is not a completely pure side-to-side acceleration. Similarly, the accelerometer is subject to drift, as shown on a signal line 654 which may be represented as being summed with the output of the accelerometer 450 in a summer 656 to model a spurious acceleration signal. Finally, a sensed acceleration signal is provided on a line 658 to the processor 454. That finishes the description of the acceleration loop.

It will be appreciated that the two electromagnets 446, 448 of FIG. 22 do not present a problem of "opposition" or "fighting" each other because of the fact that control is steered between the two. For the case of two opposed, large size actuators, e.g., the two ball-screw actuators 600, 602, we have a similar problem in operating them independently since they may end up "fighting" each other. Now we shall present a concept for controlling the two high-force actuators 600, 602 of FIG. 22 by steering actuation to one or the other of the actuators.

The novel technique of developing a centering command signal and the steering of that signal to control two opposed actuators, as shown in FIG. 25, will be explained in conjunction with FIG. 26 which is similar to FIG. 11 but expanded to show both sides of the car and both guides at once. Reference points are marked by zeros. A pair of elevator hoistway walls 660, 662 has a corresponding pair of rails 664, 666 attached thereto. Upon the surface of each rail a primary suspension, such as a roller 668, 670 rolls on a surface of the corresponding rail at a distance respectively labeled XRAIL2 and XRAIL1. A spring constant K2, shown in FIG. 25 as a block 671*a*, acts between rollers 668 and actuator 600 while spring constant K1, shown in FIG. 25 as a block 671*b*, acts between roller 670 and actuator 602. The position of the actuator 600 with respect to the car 604 is indicated by a distance X2 while the distance between the car 604 and the centered position 671 is indicated by a distance POS with positive to the right and negative to the left of center. The distance between the elevator car 604 and the surface of the rail 664 is indicated by a distance GAP2, and thus the distance between the actuator 600 and the surface of the rail is GAP2—X2. GAP20 represents the distance between the hoistway wall 660 and the car 604 when the car is centered. Similar quantities are shown on the other side of the car.

Referring first back to FIG. 2A, a distance between one side of the secondary suspension 30 and the elevator car 27 is shown measured by a position (X1) sensor 27*c* for providing a signal indicative thereof. The quantity X1 is shown in FIG. 26 also in connection with the position of an actuator 602. Another position sensor 27*a* is shown in FIG. 2A for measuring the position (GAP1) between the elevator car 27 and the primary suspension 28 and for providing a signal indicative thereof. A similar quantity GAP1 is shown in FIG. 26.

On the other side of car 27 in FIG. 2A, a similar pair of sensors 27*d*, 27*b* measure the quantities X2 and GAP2, respectively, for providing signals indicative, respectively, of the distance between one side of the suspension 31*b* and the car 27 and the distance between the primary suspension 31 and the car 27.

In designing a control system for controlling the secondary suspensions 30, 31*b* of FIG. 2A to keep the car reasonably leveled and at the same time to prevent the two suspensions 30, 31*b* from "fighting" each other or running up against the limits of their permissible travel, one must devise a control strategy to prevent same from happening.

Figure 26:
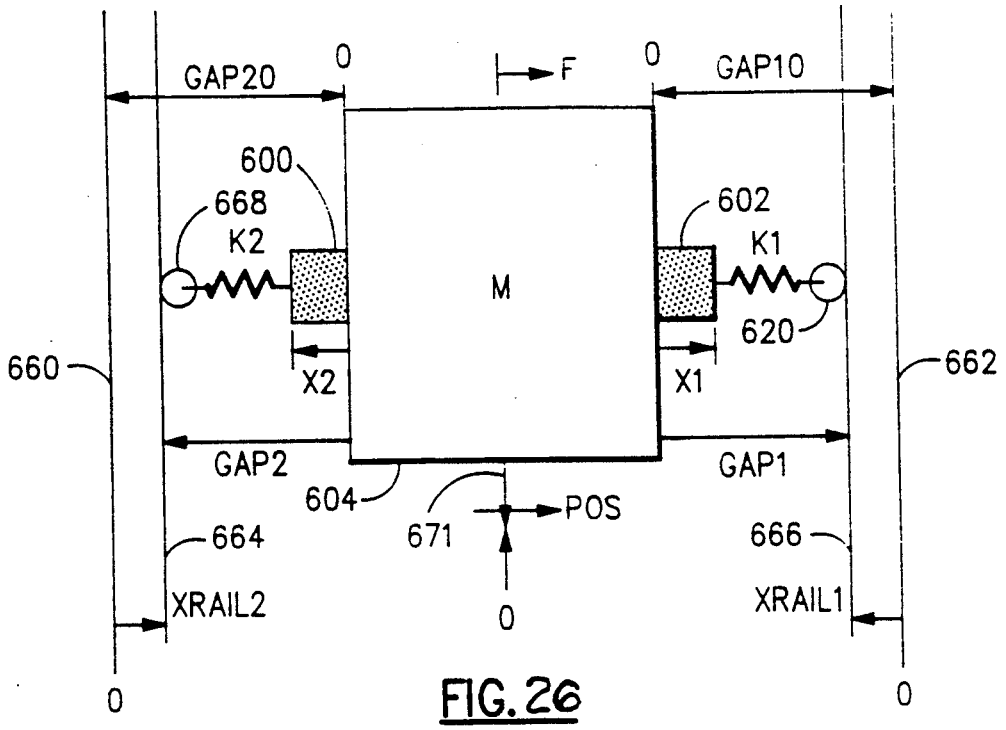
FIG. 26 is an illustration of some of the parameters illustrated in the control scheme of FIG. 25, according to the present invention.

Referring now back to FIG. 25, a position sensor similar to the sensor 126 of FIG. 9 is shown as a block 676 for measuring the distance GAP1 in FIG. 26. Similarly, a position sensor 678 measures the quantity GAP2 of FIG. 26. It should be understood that although a pair of sensors 676, 678 are shown in FIGS. 22 and 25, such function of measuring the gaps (GAP1 and GAP2) may be carried out by a single sensor albeit without the self centering quality of the signal obtained by taking the difference between two GAP signals. It will be realized by examination of FIG. 25 that the measured quantities are related to the quantities shown in FIG. 26 by the following equations:

$$GAP1 = -POS - XRAIL1 + GAP10, \text{ and}$$

$$GAP2 = POS - XRAIL2 + GAP20.$$

It will be noted that FIG. 25 is similar to FIG. 10 in many respects, except there are two position sensors 676, 678 responsive to the position (POS) of the cab, as indicated on the line 632 and also the additional inner loops having position sensors for retracting the large actuators back to the home or zero position whenever not being actively used as an actuator. In FIG. 26, two gap position lines (GAP10 and GAP20) represent the distances between the car and the hoistway walls when the car is centered. These are further represented as "signals" being injected into "summers" 684, 686 in producing the physical gaps indicated as GAP1 and GAP2 lines 688, 690. These are useful for understanding the system.

Output signals from position sensors 676, 678 are provided on respective signal lines 692, 694 to a summer 696 which takes the difference between the magnitudes of the two signals and provides a difference (centering control) signal on a line 698 to a lag filter 700 which provides a filtered centering control signal on a line 702 to a junction 704 which provides the filtered difference signal to each of a pair of precision rectifiers 706, 708 which together with the junction 704 comprise a steering control 709 for steering the filtered centering signal on the line 702 to one or the other at a time, i.e., not both at the same time. A pair of geared motor controls 710, 712 is shown, one of which will respond to the steered centering command signal by moving at a relatively slow velocity as indicated on a line 712 or 714 as integrated by the system as indicated by integration blocks 716 or 718 to an actuator position (X1 or X2) as indicated on a line 720 or 722 for actuating a spring rate 671*d* or 671*c* for providing the force indicated by line 616 or 614. It should be realized that in this control system diagram, the spring rates 671*b* and 671*a* are associated with the same spring which is actuated by actuator 710. Similarly, spring rates 671*a* and 671*c* are associated with the same spring, in this case actuated by actuator 712. A pair of position feedback blocks 720, 722 are responsive to the actuator positions indicated by lines 720, 722 and include position sensors for providing feedback position signals on lines 728, 730 indicative of the position of the actuator with respect to the car. These position signals may be subjected to signal conditioning which may comprise providing a low gain feedback path. A pair of summers 732, 734 are responsive to the feedback signals on the lines 728, 730 and the centering command signal on line 702 as steered by the steering control for providing difference signals on lines 736, 738 indicative of the difference therebetween. It should be understood that one signal of a pair of output signals on lines 740, 742 from the precision rectifiers 706, 708 will comprise the steered centering command signal on line 702 and the other will be zero. By zero we mean a command having a magnitude equal to that required to cause the actuator to return to its zero position which will be that position required to maintain at least the desired preload on the primary suspension.

Figure 27:
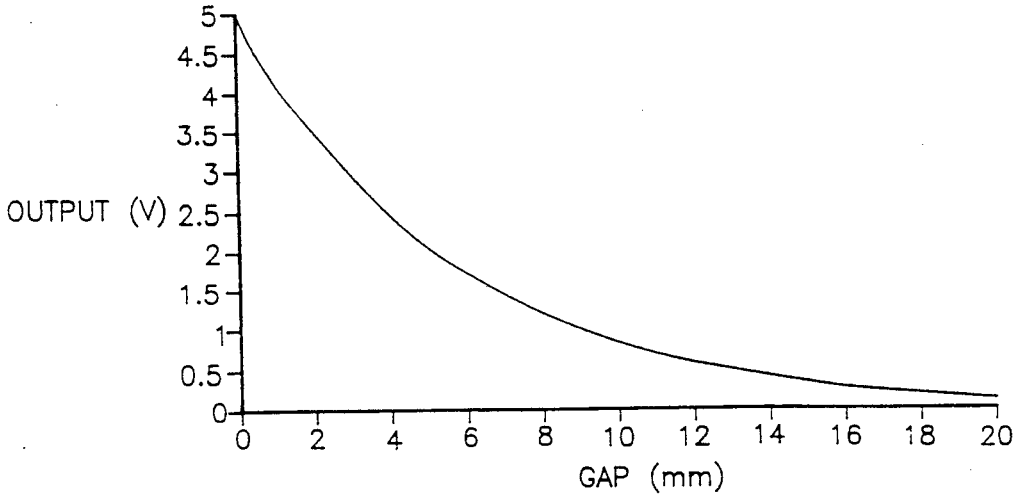
FIG. 27 PRIOR ART
FIG. 27 is an illustration of the response of a single position transducer associated with, for example, each one of the position transducers such as illustrated in FIG. 18, according to the present invention.
Figure 28:
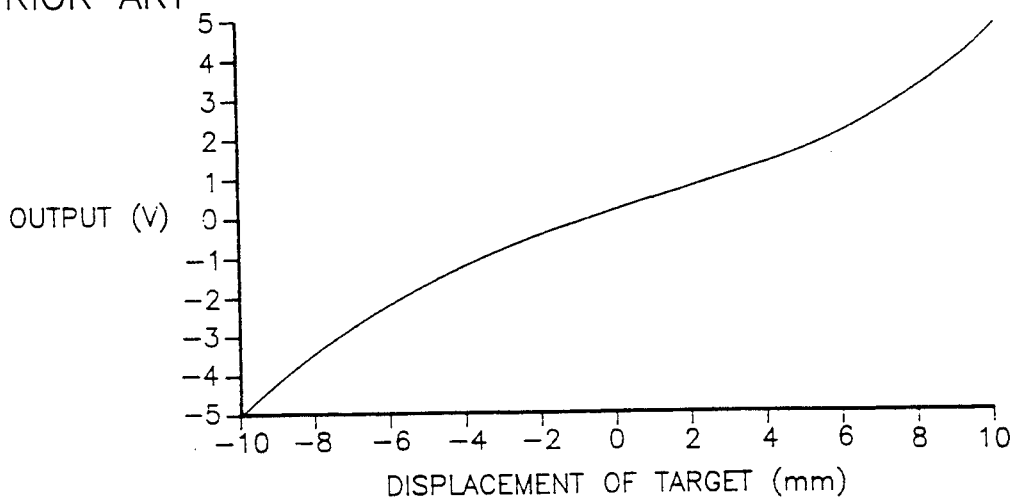
FIG. 28 PRIOR ART
FIG. 28 is an illustration of a composite of two such transducer responses such as might appear on line 698 of FIG. 25, according to the present invention.

Referring now to FIG. 27, the response of a position transducer, such as is shown in FIG. 18, is shown. This is an experimentally determined response. Although the response for a particular transducer is shown, it will be realized that any other suitable type of position sensor may be used, including linear position sensors. The summation of the two signals on the lines 692, 694 is shown in FIG. 26 over the whole range of displacement of the elevator car (scaled to the particular sensing arrangement we have shown). The positioning of the links on the active guides according to the embodiment shown is such that no more than ten millimeters of displacement is to be expected. Thus, it will be seen that the two position sensors for the corresponding two roller guides can be combined in a seamless response, such as shown in FIG. 28, for presentation to the lag filter 700 of FIG. 24.

Our Teachings Are Widely Applicable

It will be recalled that in FIG. 1, since the principles of the present invention are applicable to guides in general, we showed a plurality of guides 20, 22, 24, 26 which were described as guides in general. Subsequently, we showed an embodiment of the invention employing a roller type guide. We will now briefly show that the invention may be used for other types of guides as well.

Figure 29:
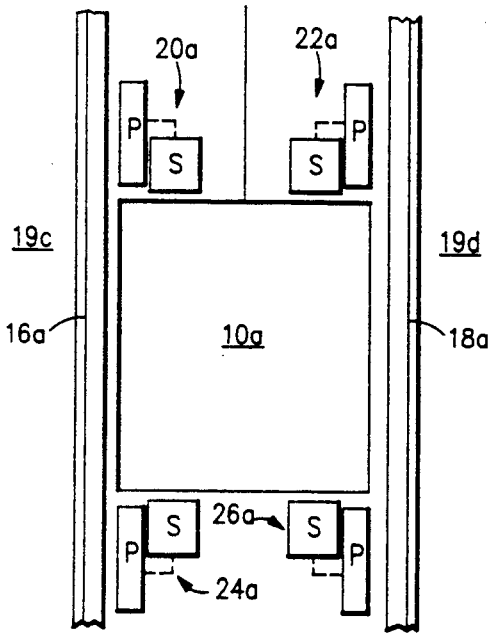
FIG. 29 is an illustration of an elevator car having a plurality of magnetic primary suspensions associated with secondary suspensions, according to the present invention.
Figure 30:
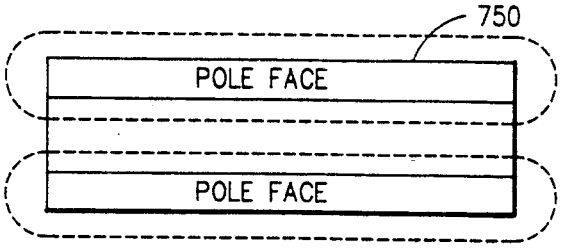
FIG. 30 is an illustration of a relatively long electromagnet core for orientation in a vertical manner, according to the present invention.
Figure 31:
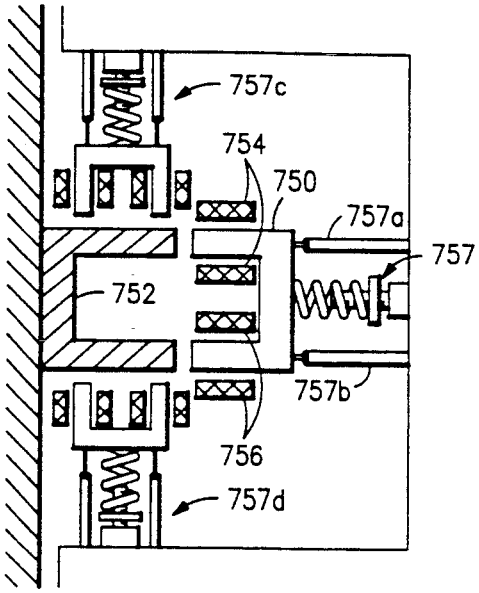
FIG. 31 is an illustration of a long core, such as shown in FIG. 30, oriented for interfacing with a C-shaped rail, according to the present invention.

Referring now to FIG. 29, guides 20*a*, 22*a*, 24*a*, 26*a* are shown for guiding a car 10*a* car 10*a* between a pair of hoistway rails 16*a*, 18*a* attached to hoistway walls 19*c*, 19*d*. Each of the guides has a primary suspension comprising an electromagnet labeled "P" and a secondary suspension labeled "S" to which the "P" primary is attached. As mentioned, the secondary suspensions may be similar to those in FIGS. 2A and 2B. The primary suspensions, on the other hand, might appear as shown in FIG. 30 each with a core 750 having a length considerably longer than its width. This provides good, high-speed performance and more front-to-back guidance force than provided in previously disclosed electromagnetic actuators, such as shown in Kokoku, No. 58-39753 or Kokai 60-36279, which show or suggest rather short cores. Regardless of the lengths of the cores, we teach that the primary suspension associated with the secondary suspension may be an electromagnet. Such may be oriented with respect to a C-shaped rail 752 interfacing with the core 750 having a coil 754 on one leg and a coil 756 on another leg for providing flux for the flux path comprising the C-shaped rail 750, the core 752, and the gaps therebetween. The core 752 is, of course, attached to a secondary suspension which is in turn attached to a car. In this case, we have shown a ball screw actuator 757 for pushing on the core with a spring similar to the setup shown in FIG. 2B. In addition, we have shown a pair of stabilization guides 757*a*, 757*b*, which may be passive or active, e.g., solenoid operated. If active, they may be used in parallel with the actuator 757 as an adjunct to add stability. Such a suspension would be used on the opposite hoistway rail as well as for side-to-side stabilization. An additional pair of opposed front-to-back suspensions 757*c*, 757*d* are shown as well. Such would also be used in a similar manner on the opposite rail.

Figure 32:
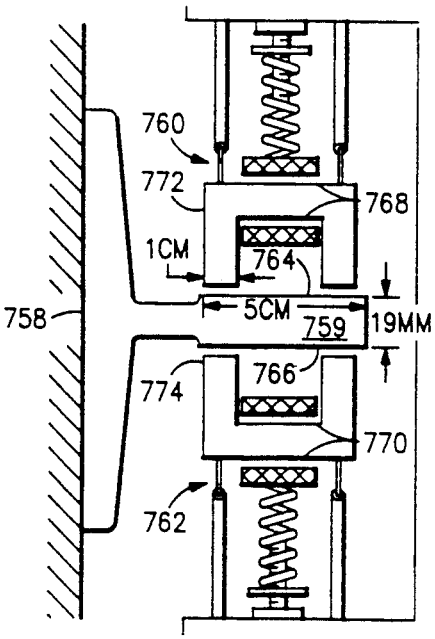
FIG. 32 is an illustration of a pair of long cores, such as shown in FIG. 30, for interface with a standard type rail, according to the present invention.

For a more conventional shaped rail 758, such as shown in FIG. 32, which may, for example, have a dimension of 19 mm for the distal surface of the blade which itself has a length of five centimeters, a pair of electromagnet actuators or electromagnet bearings 760, 762 are arranged opposite one another to face opposing surfaces 765, 766 of the blade 759. In this case, a pair of coils 768, 770 are wound around the piece that joins the two legs of the respective cores 772, 774. For this type of arrangement, the side-to-side control is provided by the natural reluctance of the electromagnets to move side-to-side.

One embodiment of the primary suspension shown in FIG. 32 uses core faces one centimeter wide. Assuming the cores themselves have a length of 25 cm and a flux of 0.6 Telsa, the force per core is approximately 716 Newton of attractive force. This is, of course, a front-to-back force, but the side-to-side force available is similar in magnitude without the need for additional electromagnets. If desired, one could use a third rail in the back of the car to help the side-to-side stabilization. A similar pair of cores would be used on that rail as well.

Thus, it will be observed that for the example given, the length of the core is five times longer than its width, although such should not be considered a limitation since this is merely an example, and the intent is to provide a teaching that shows a pole having a length significantly greater than its width. As previously mentioned, the type of electromagnet used is not essential, since various types of primary suspensions have been disclosed, not for the purpose of limitation but for the purpose of showing the wide applicability of the general concepts disclosed.

Similarly, the primary suspension 28 of FIG. 2A or 2B or of FIG. 1 may be a slide guide for running along guide rails such as shown in FIG. 2*a* and FIG. 2*b* of U.S. Pat. No. 4,750,590 where the guide shoes are laterally controllable using hydraulic cylinders mounted to the elevator car.

Figure 33:
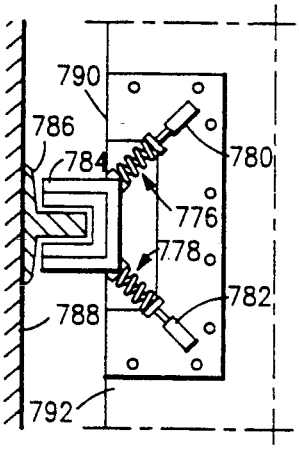
FIG.33 PRIOR ART
FIG. 33 is an illustration of a sliding guide shoe used as a primary suspension and interfaced with, for example, a plurality of hydraulic actuators, according to the present invention.
Figure 1:
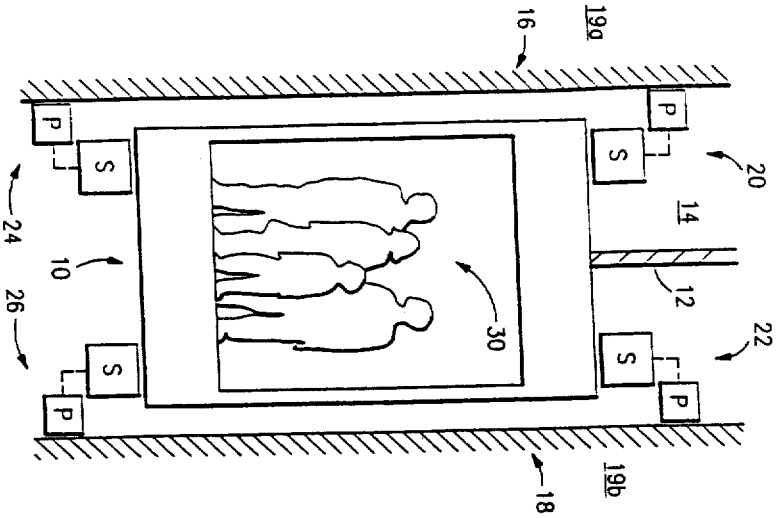
Figure 2B:
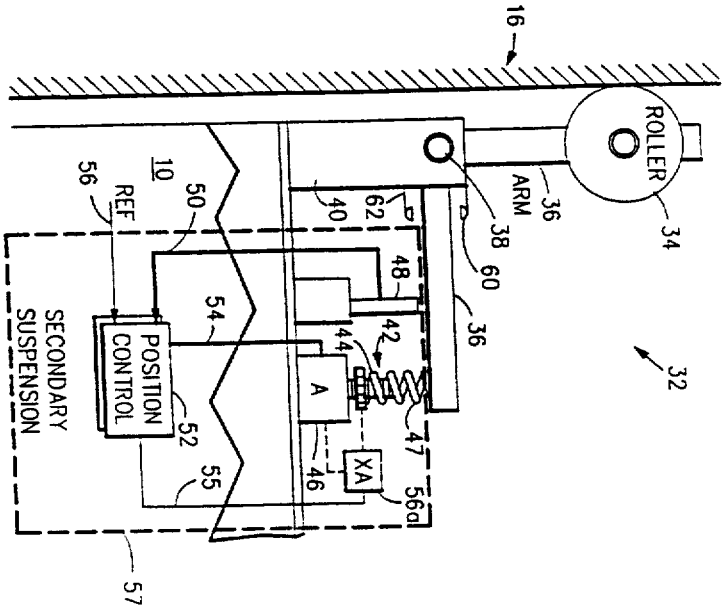
Figure 2A:
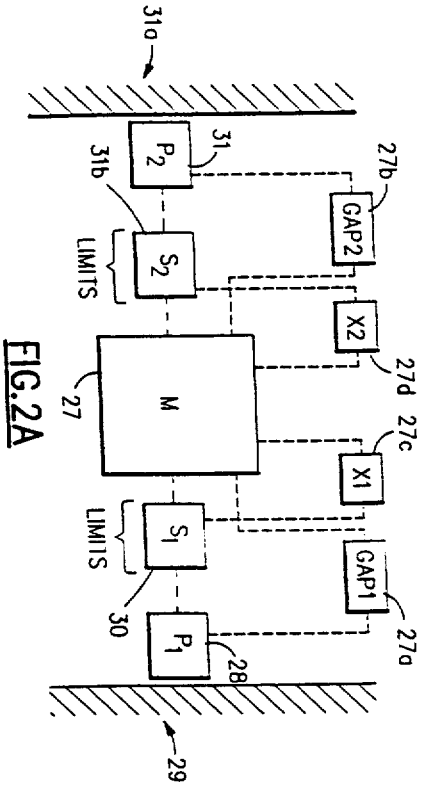
Figure 3:
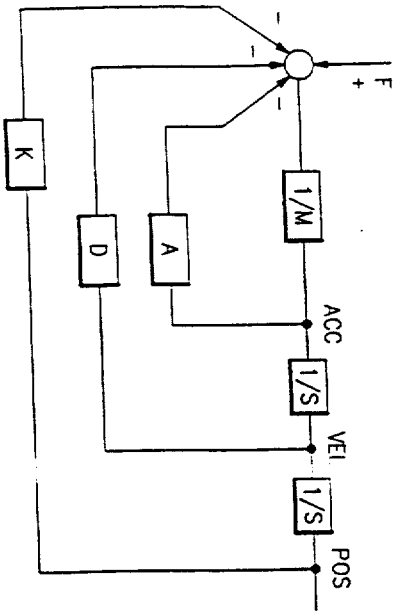
Figure 11:
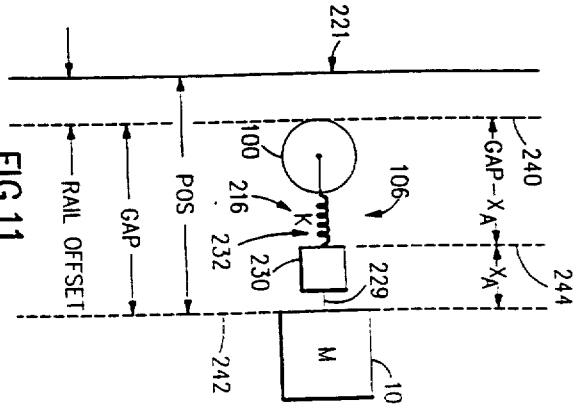
Figure 4:
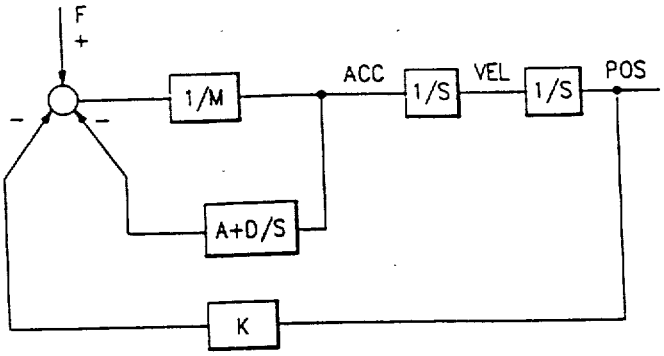
Figure 5:
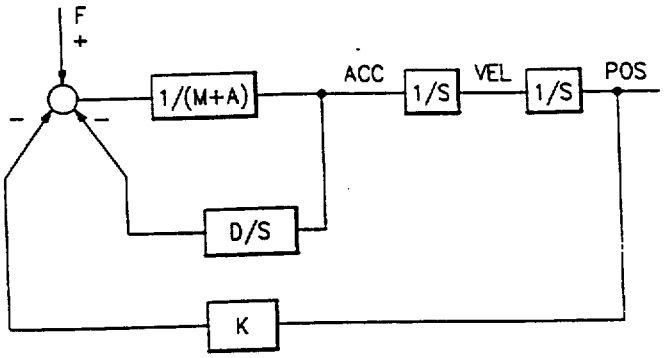
Figure 6:
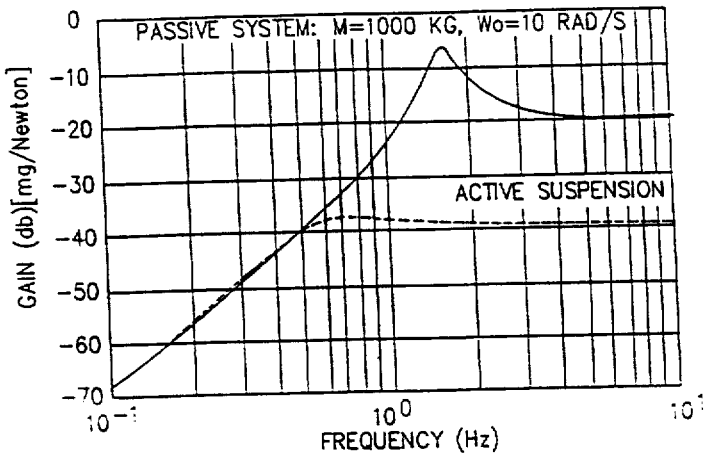
Figure 7:
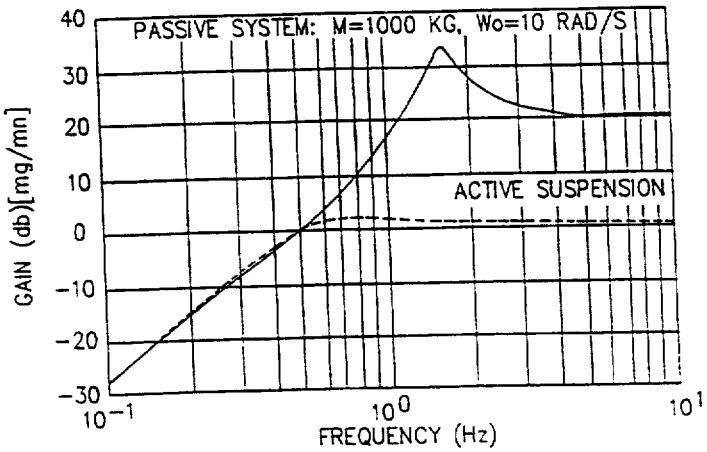
Figure 8:
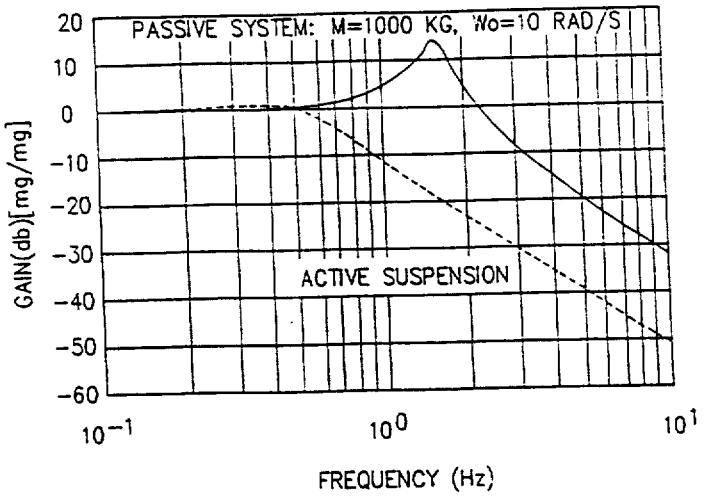
Figure 9:
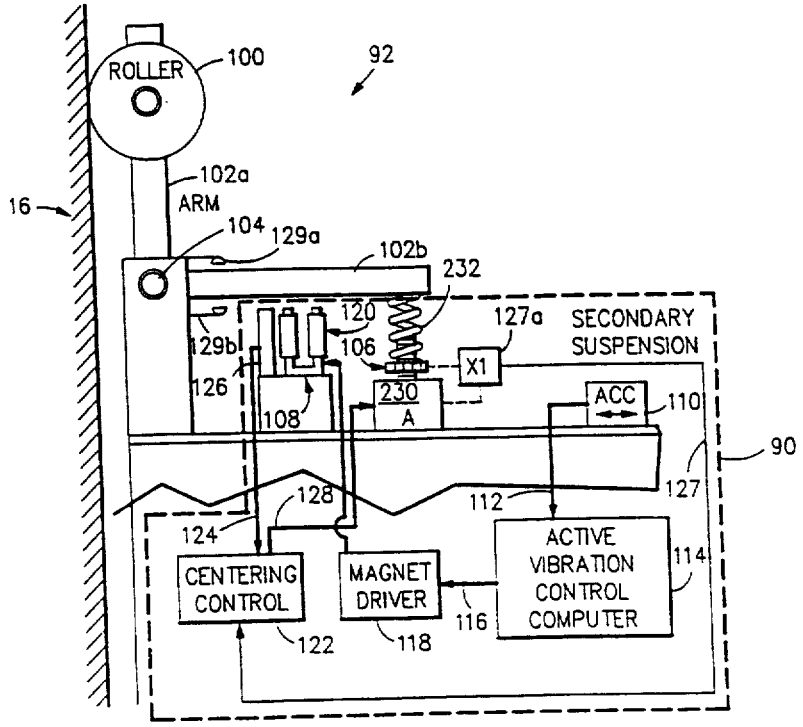
Figure 10:
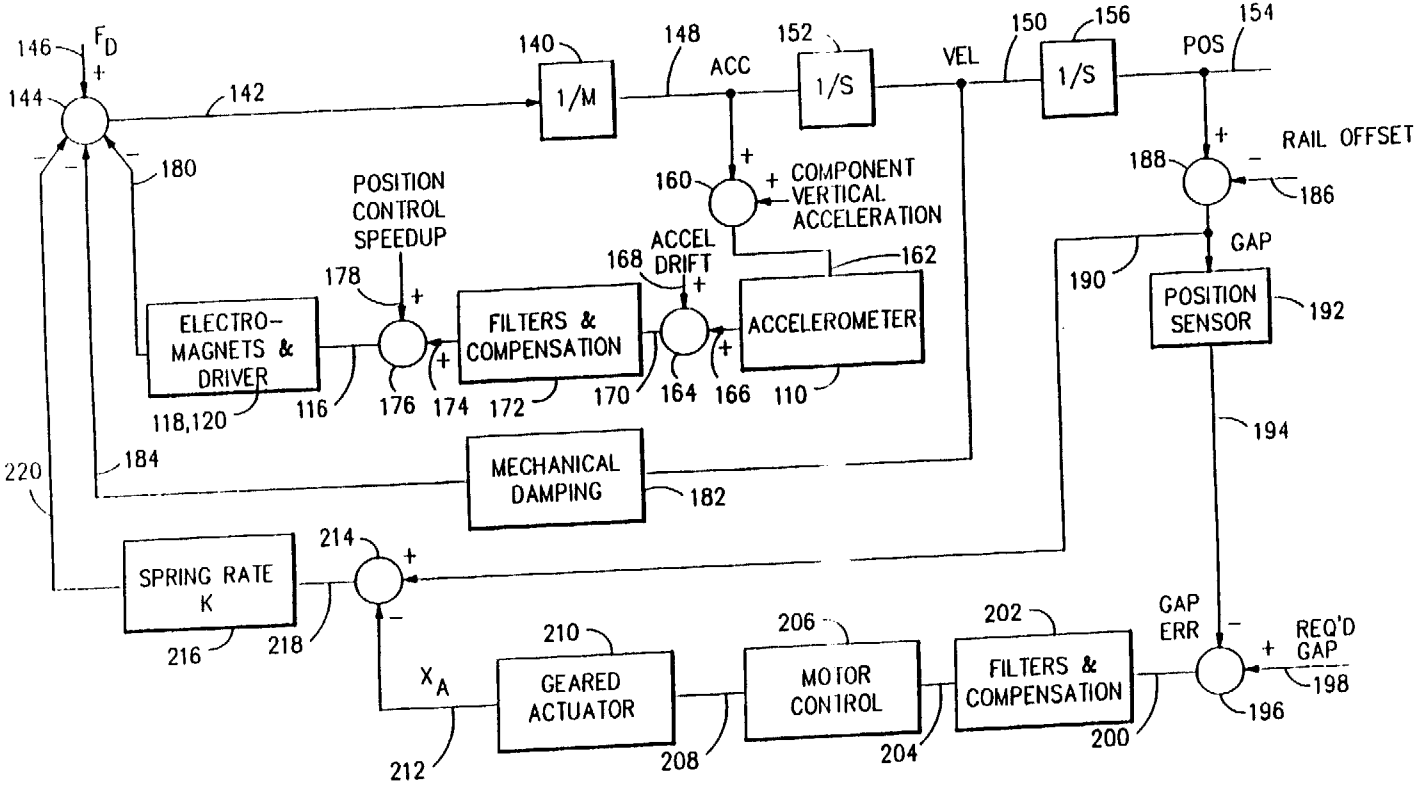
Figure 12:
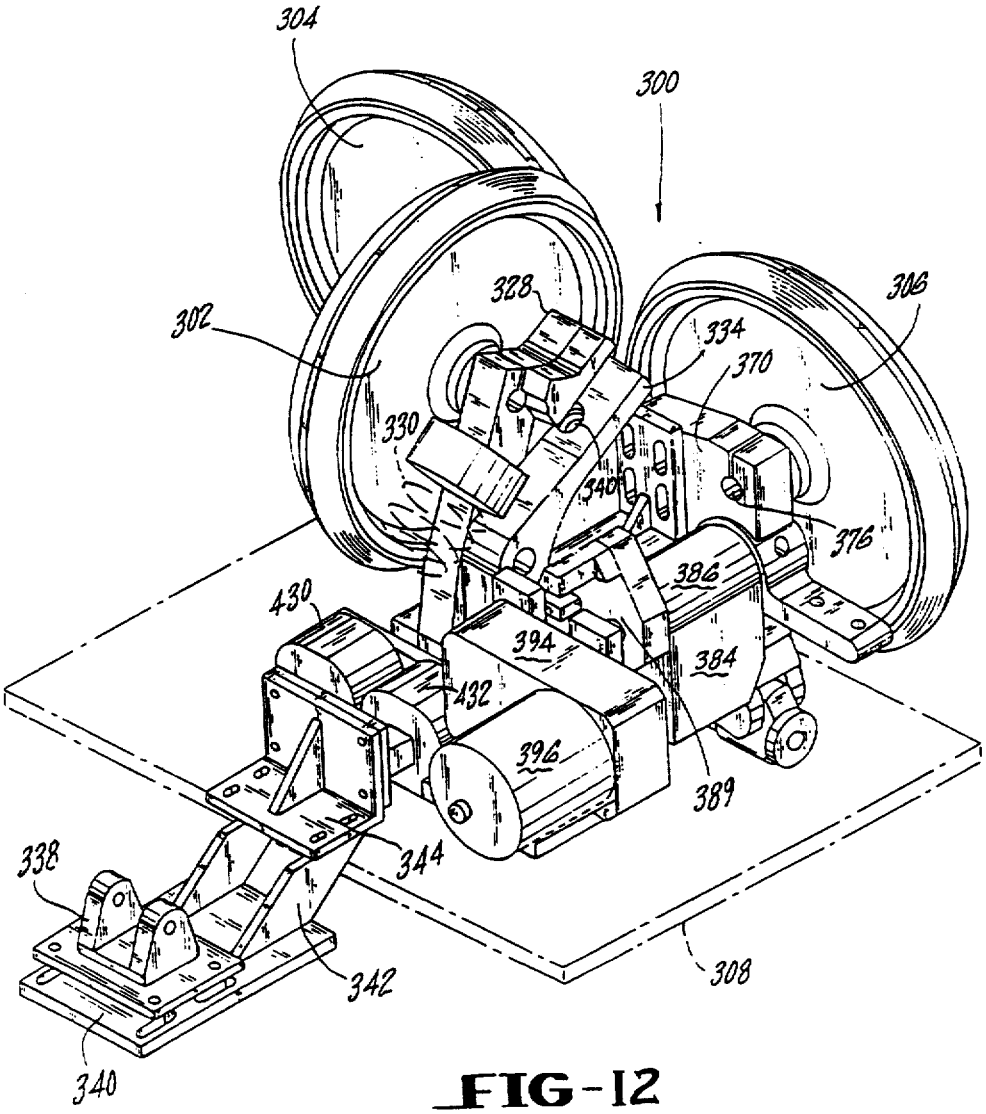
Figure 13:
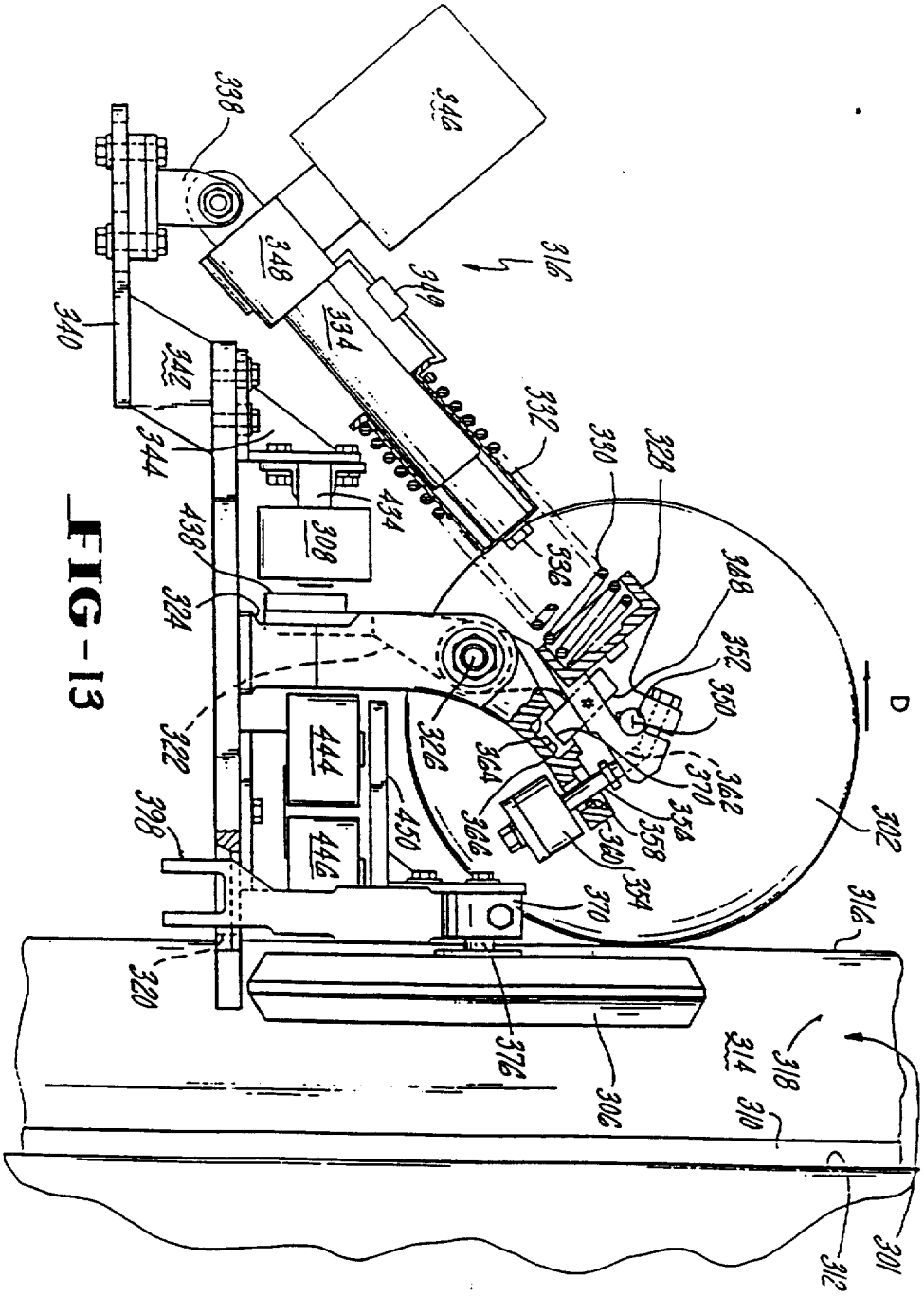
Figure 14:
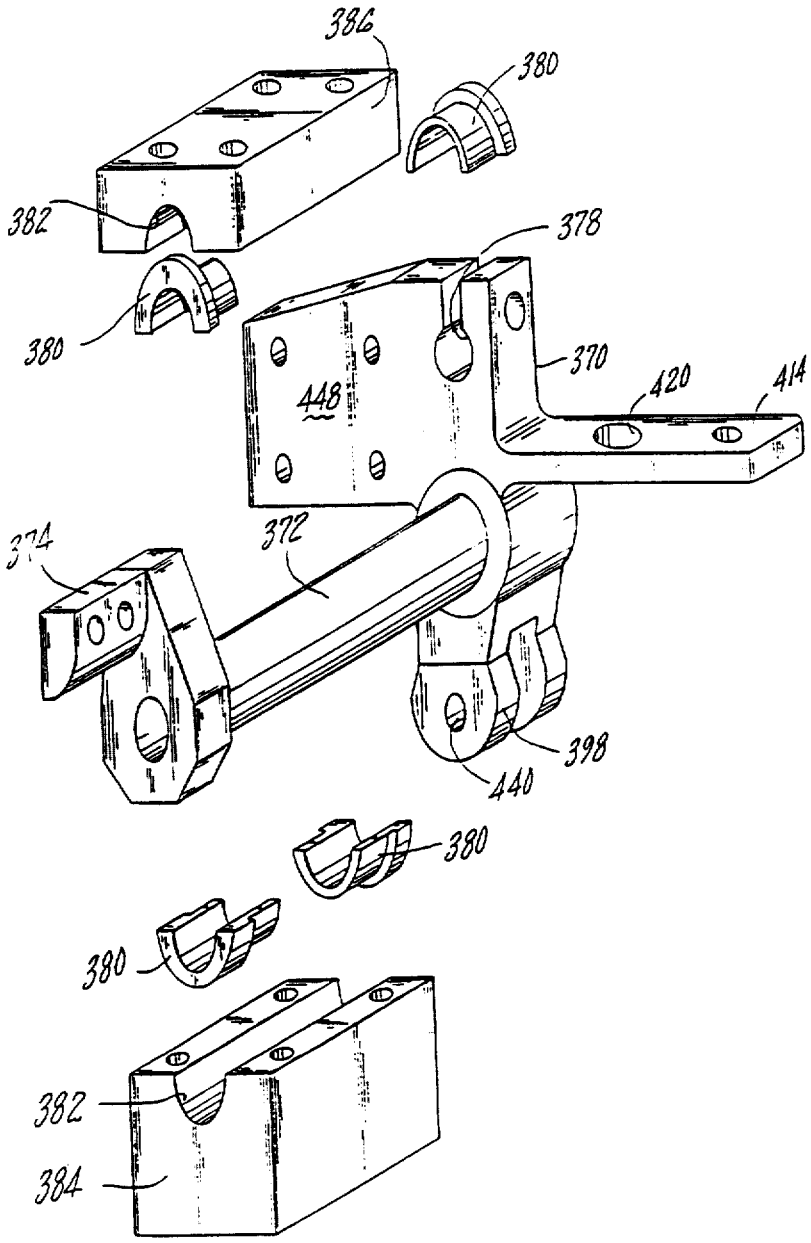
Figure 15:
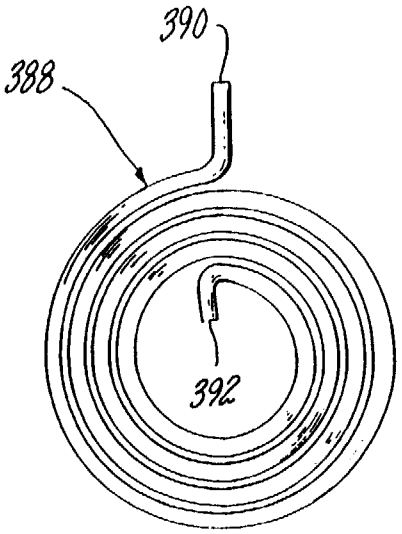
Figure 16:
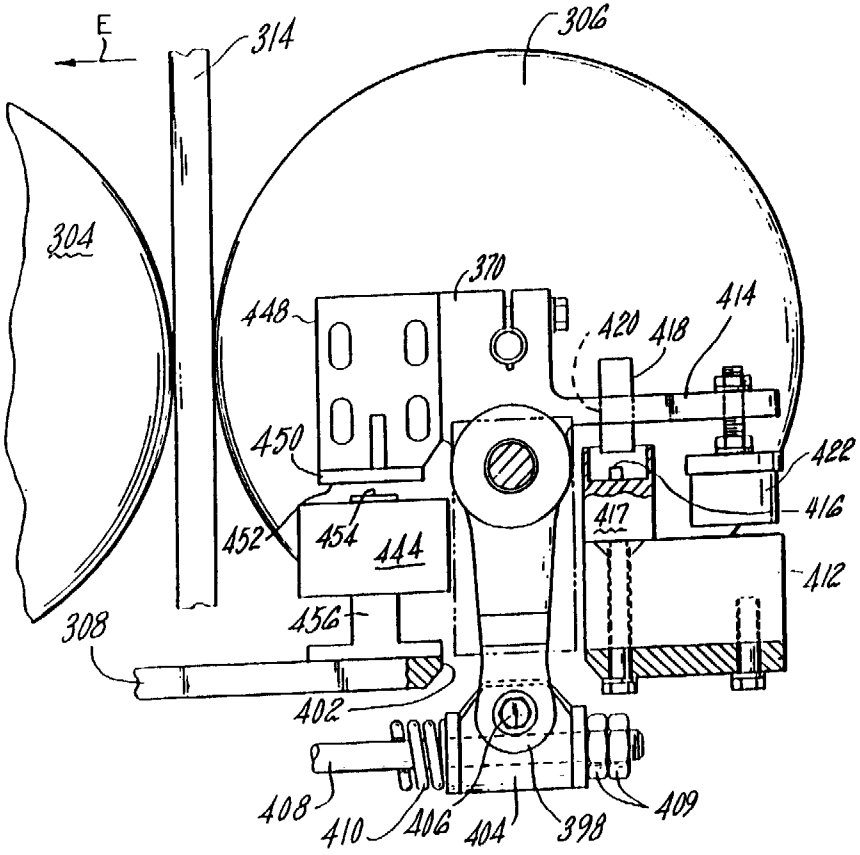
Figure 17:
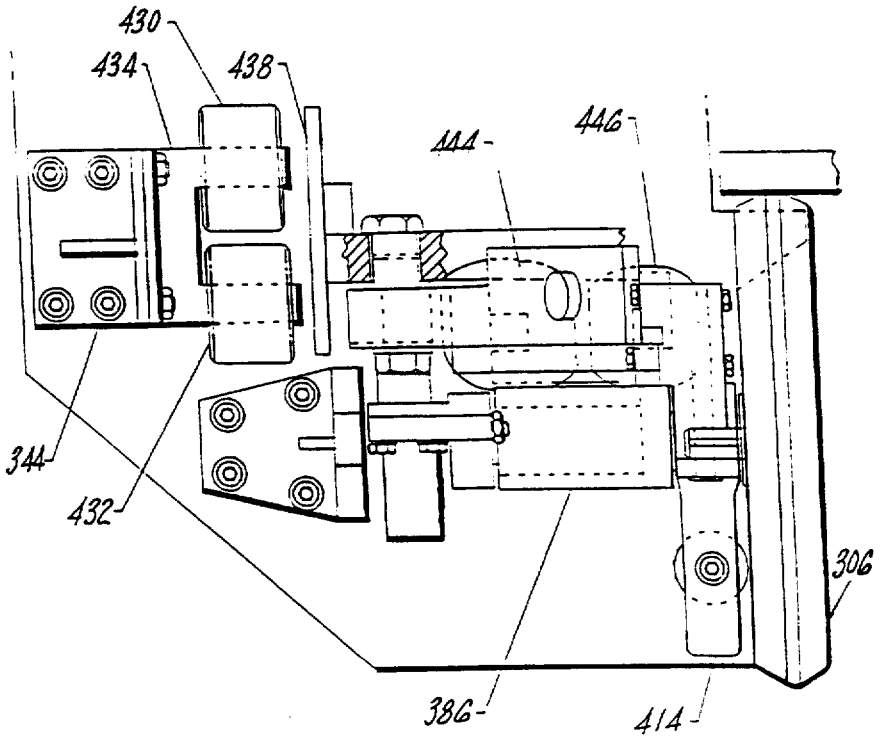
Figure 18:
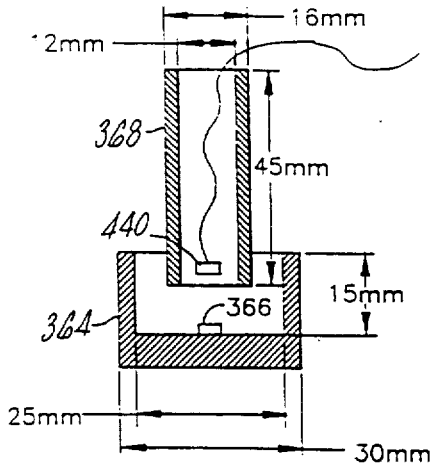
Figure 19:
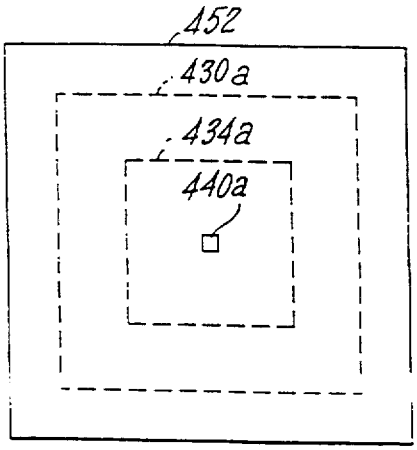
Figure 20:
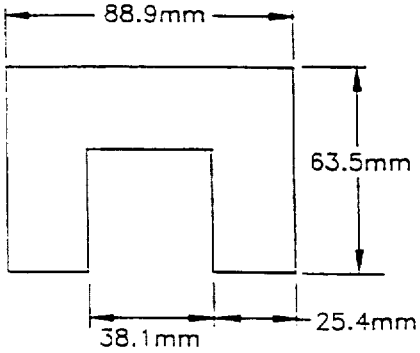
Figure 21:
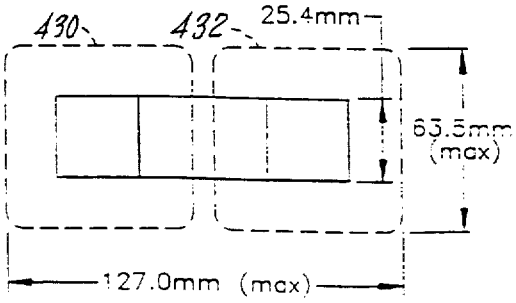
Figure 22:
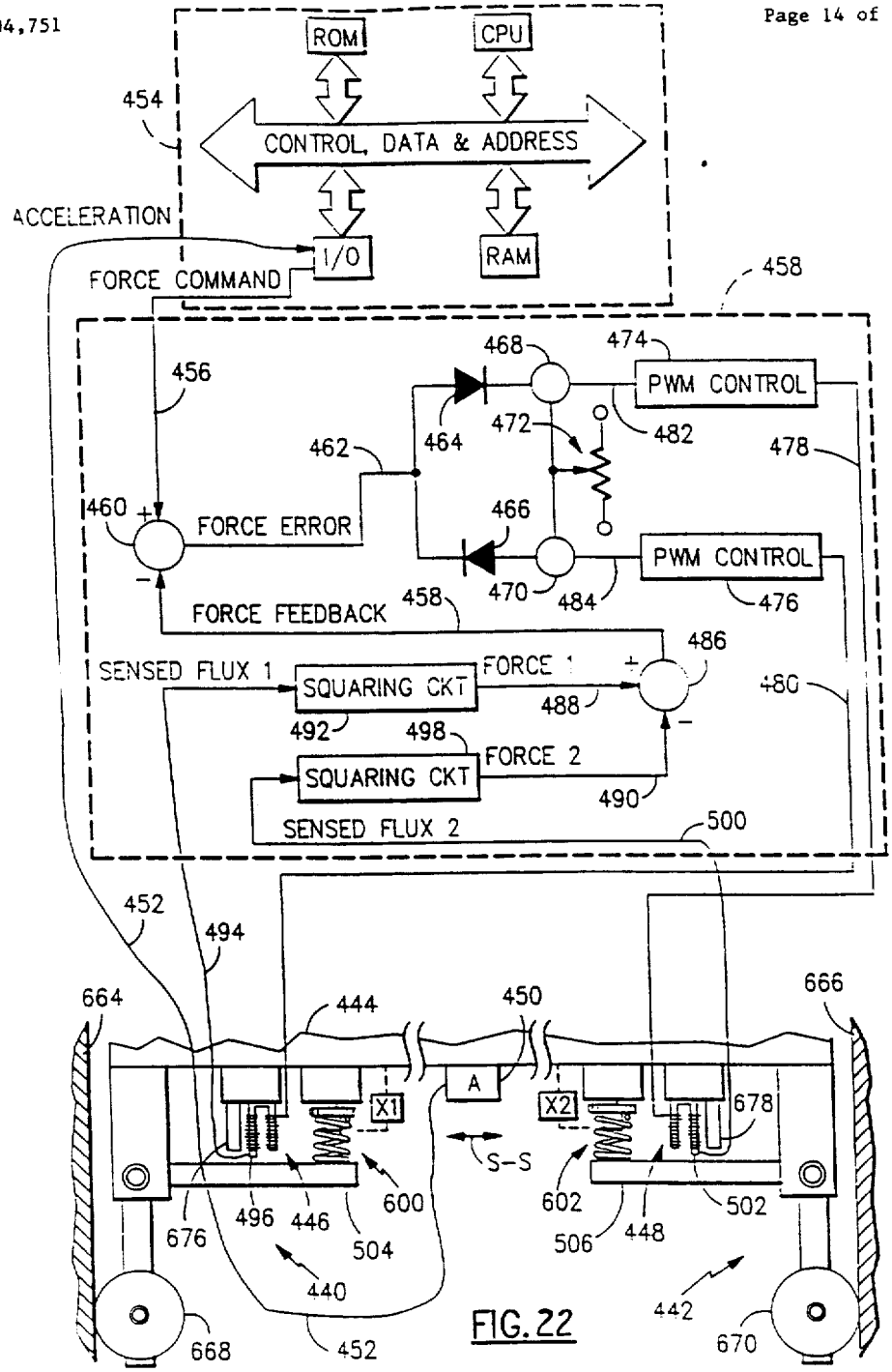
Figure 26:
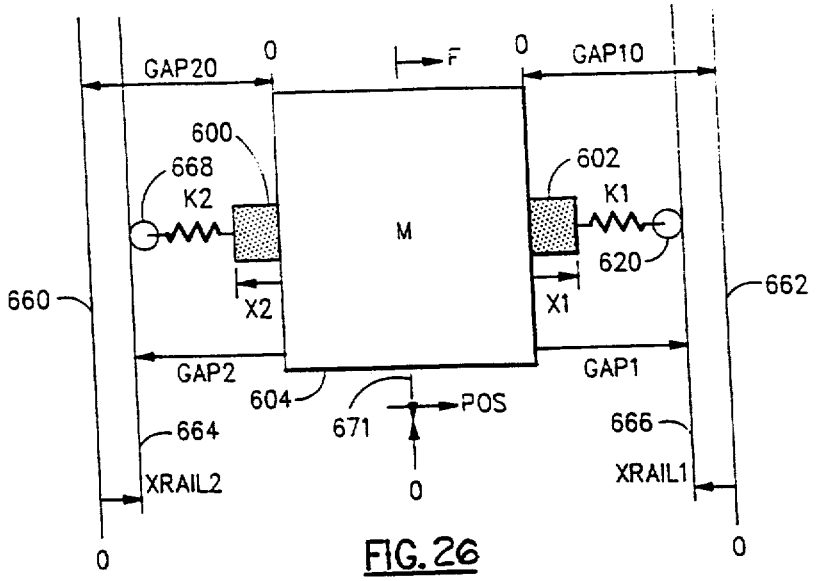
Figure 23:
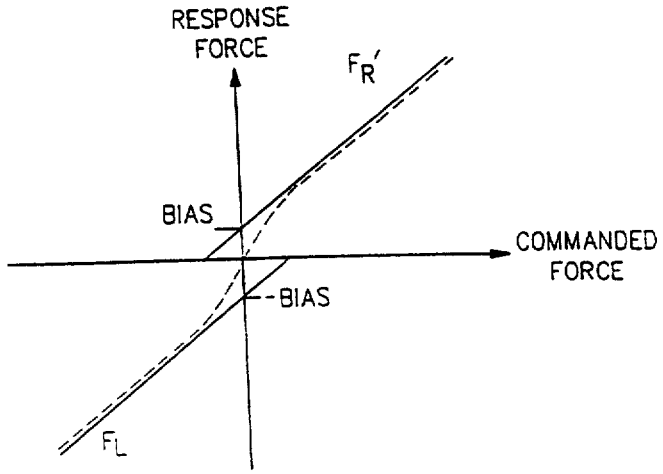
Figure 24A:
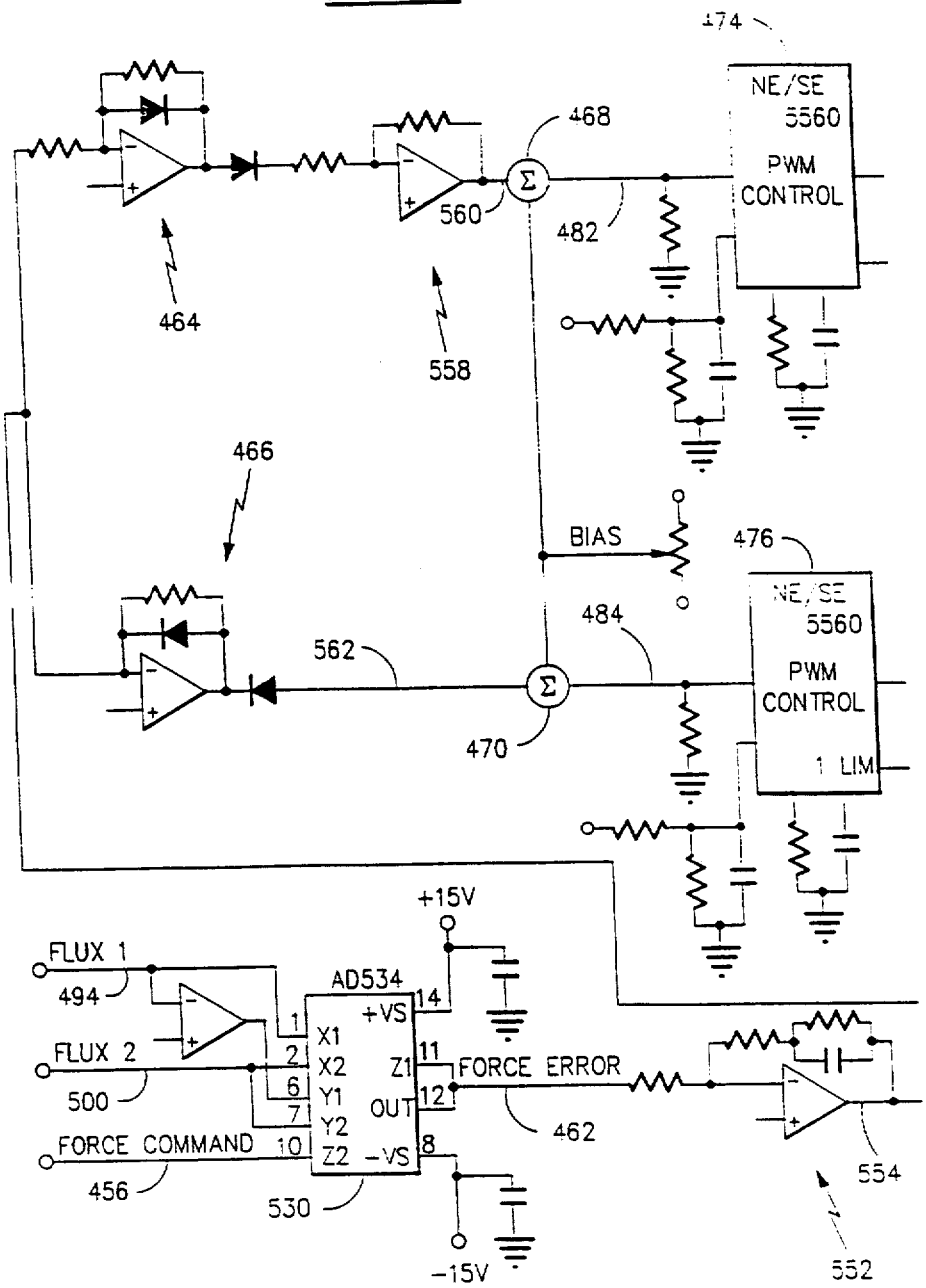
Figures 24, 24B:
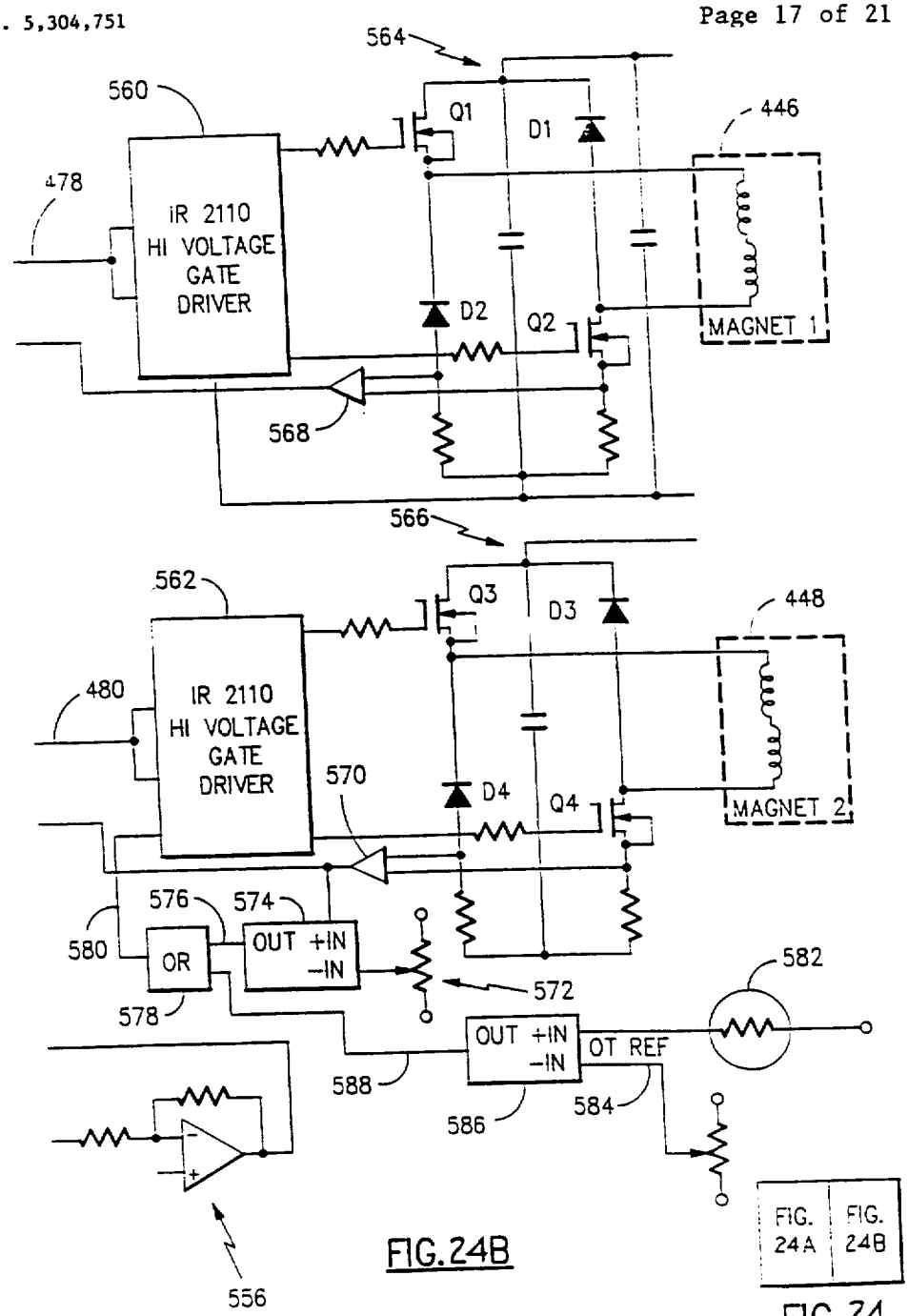
Figure 25A:
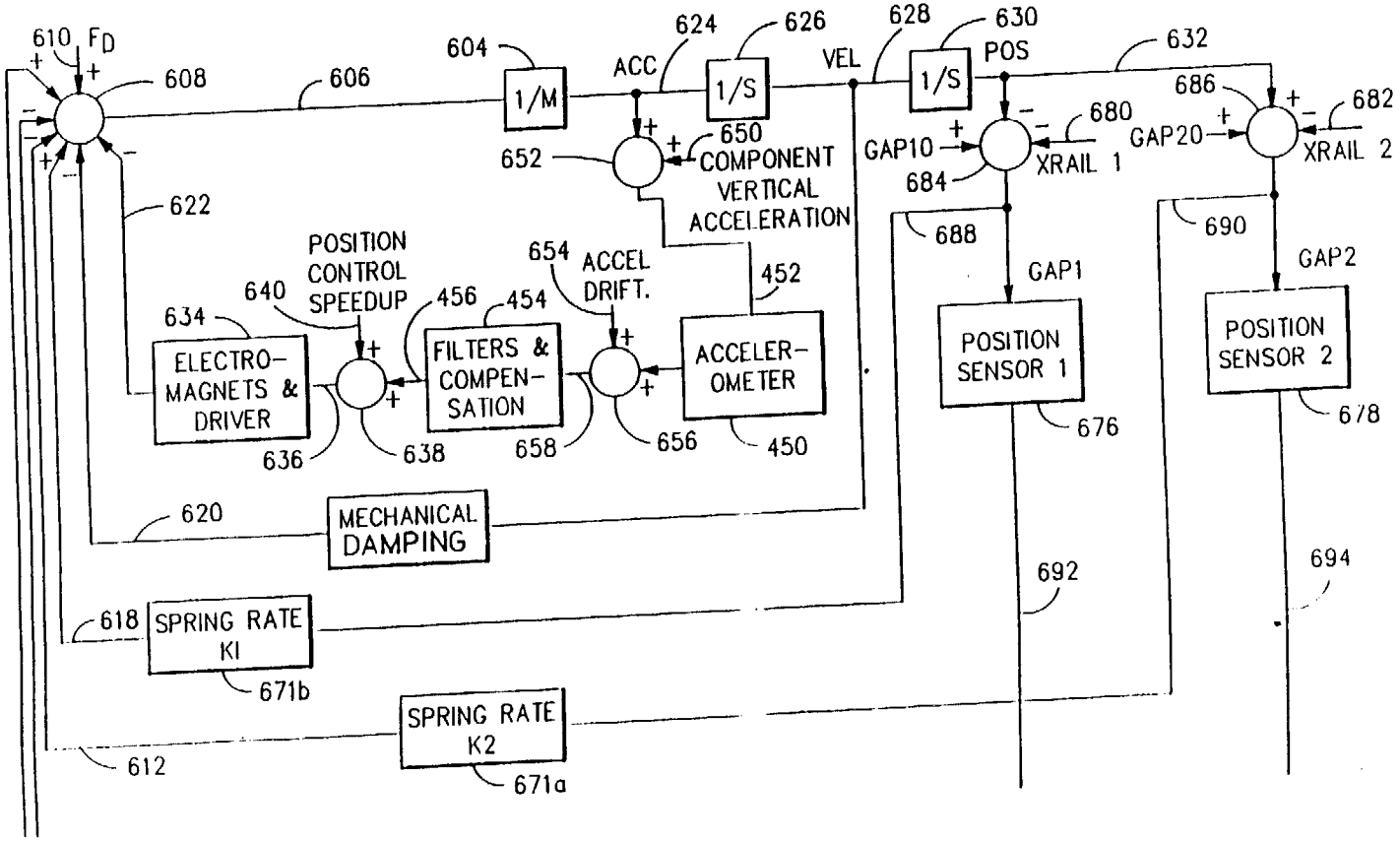
Figures 25, 25B:
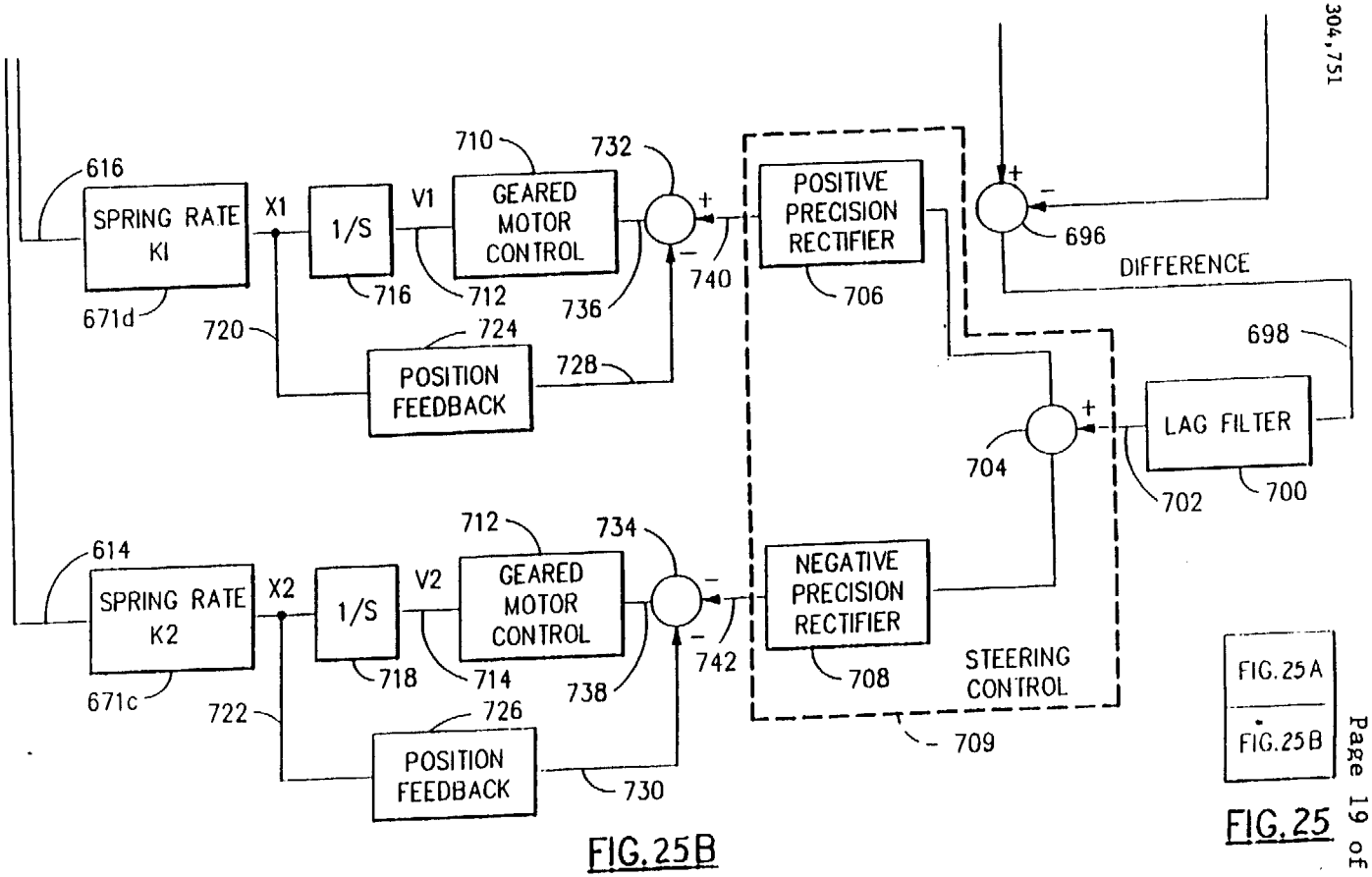
Figure 27:
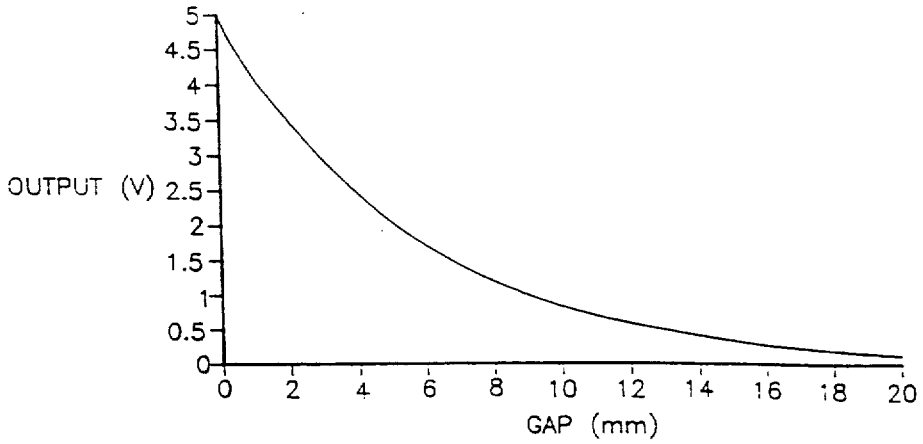
Figure 28:
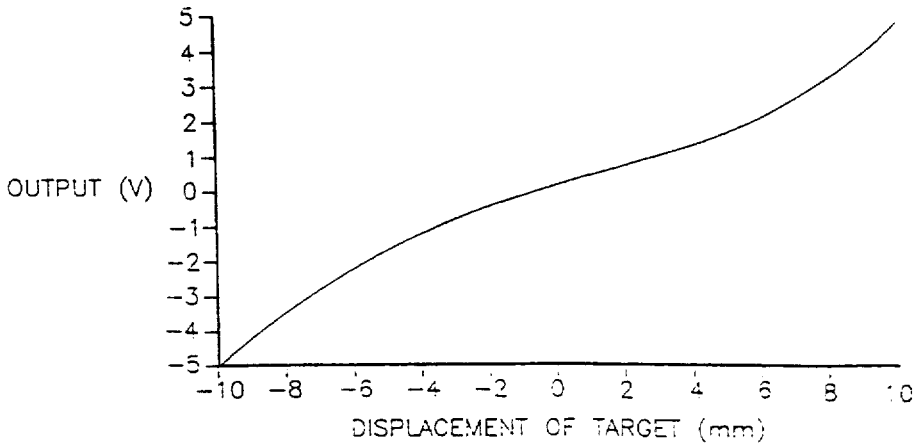
Figure 29:
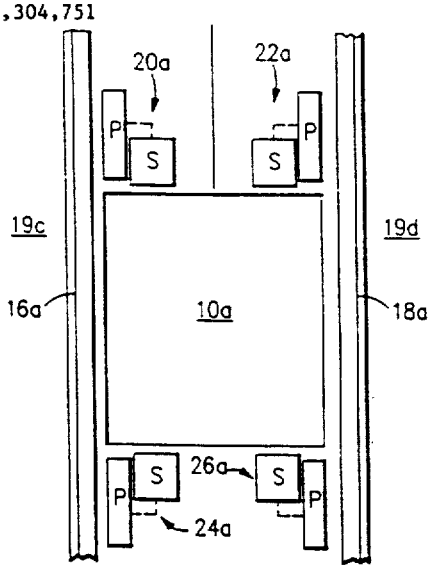
Figure 30:
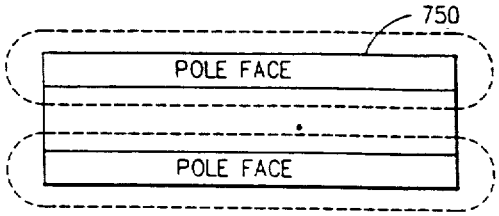
Figure 31:
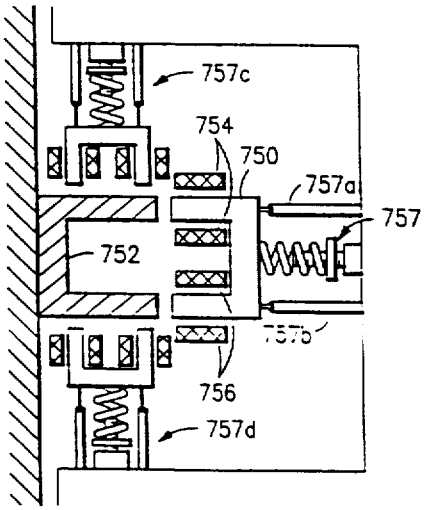
Figure 32:
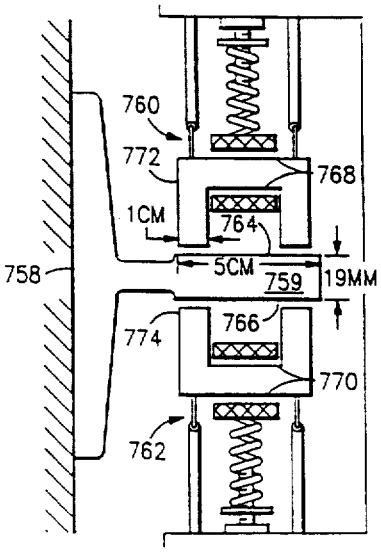
Figure 33:
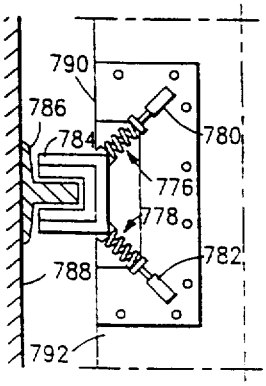

FIG. 33 shows an alternate primary suspension comprising a guide shoe with actuators canted at 45 similar to Otala's actuators, as shown in U.S. Pat. No. 4,750,590, except having a pair of springs 776, 778 inserted inbetween the corresponding pair of hydraulic cylinder 780, 782 for actuating a guide shoe 784 which rides on a guide rail 786 mounted on a hoistway wall 788. A base or cartridge 790 is mounted on an elevator car 792. If the designer wishes to avoid the complexities introduced by using nonorthogonal force actuators and is willing to pay the added cost of an additional actuator per rail, he may used three actuators oriented orthogonally in a manner shown previously. For that case, it should be understood that the slide guide shoe 784 may, but need not, comprise independent front-to-back and side-to-side shoes as opposed to the integral shoe shown.

It will be readily appreciated that the guidance system and controls of this invention will provide an improved quality ride for the passengers in the elevator cab. Since many changes and variations of the disclosed embodiments of this invention may be made without departing from the inventive concept, it is not intended to limit the invention otherwise than as required by the appended claims.

We claim:

1. A control for an elevator horizontal suspension having a primary suspension for guiding said elevator along a hoistway rail and a secondary suspension for attaching said elevator to said primary suspension, comprising:

a first position sensor, responsive to the position of said elevator with respect to said primary suspension, for providing a first position signal having a magnitude indicative thereof;

a second position sensor, responsive to the position of an actuable part of said secondary suspension with respect to a referent, for providing a second position signal having a magnitude indicative thereof; and control means responsive to said first position signal, for providing a first control signal for controlling the position of said elevator with respect to said primary suspension and responsive to said second position signal, for providing a second control signal for maintaining at least a selected force on said primary suspension.

2. The control of claim 1, further comprising:

an accelerometer, responsive to horizontal acceleration of said elevator, for providing an acceleration signal having a magnitude indicative thereof; and wherein said control means is responsive to said acceleration signal, for providing a third control signal for controlling motion of said elevator car.

3. The control of claim 1, wherein said first position sensor comprises:

a ferromagnetic tube having a Hall cell positioned at one end thereof for sensing flux and for providing said first position signal as a sensed flux signal;

a ferromagnetic cup having a depression for receiving said end of said tube; and a magnet positioned in said cup for providing said flux to be sensed by said Hall cell wherein the magnitude of the sensed flux will increase with closer proximity of said Hall cell to said magnet.

4. A control for providing control signals for controlling the horizontal position of an elevator car by mean of an actuable horizontal suspension between said car and a hoistway rail, comprising:

car position sensing means, responsive to the distance between a pair of reference positions indicative of the position of said car with respect to a primary part of said suspension, for providing a position signal having a magnitude indicative thereof;

control means, alternately responsive to said position signal and the absence thereof, for respectively (a) controlling said distance between said reference positions by means of an actuable secondary part of said suspension and (b) restoring said actuable secondary part to maintain a selected force on said primary part;

an accelerometer, responsive to horizontal acceleration of said elevator car, for providing an acceleration signal having a magnitude indicative thereof; and second control means, responsive to said acceleration signal, for providing a control signal for controlling motion of said elevator car.

5. A control for providing control signals for controlling the horizontal position of an elevator car by means of an actuable horizontal suspension between said car and a hoistway rail, comprising:

car position sensing means, responsive to the distance between a pair of reference positions indicative of the position of said car with respect to a primary part of said suspension, for providing a position signal having a magnitude indicative thereof; and control means, alternately responsive to said position signal and the absence thereof, for respectively (a) controlling said distance between said reference positions by means of an actuable secondary part of said suspension and (b) restoring said actuable secondary part to maintain a selected force on said primary part, wherein said position sensing means comprises:

a ferromagnetic tube having a Hall cell positioned at one end thereof for sensing flux and for providing a sensed flux signal;

a ferromagnetic cup having a depression for receiving said end of said tube; and a magnet positioned in said cup for providing said flux to be sensed by said Hall cell wherein the magnitude of the sensed flux will increase with closer proximity of said Hall cell to said magnet.

6. A hoistway rail guide for an elevator, comprising:

a primary suspension for guiding said elevator with respect to said hoistway rail; and a secondary suspension, comprising:

a first actuator attached between said primary suspension and said elevator, responsive to a position control signal, for actuating said primary suspension with respect to said elevator;

position control means, responsive to a sensed position signal, for providing said position control signal;

position sensing means, responsive to the position of said primary suspension with respect to said elevator, for providing said sensed position signal having a magnitude indicative thereof;

a second actuator, only capable of exerting forces less than those of said first actuator, attached between said primary suspension and said elevator, responsive to an acceleration control signal, for actuating said primary suspension with respect to said elevator;

acceleration sensing means, responsive to acceleration of said elevator, for providing a sensed acceleration signal having a magnitude indicative of the magnitude of said acceleration of said elevator; and vibration control means, responsive to said sensed acceleration signal, for providing said acceleration control signal.

7. The guide of claim 6, further comprising second position sensing means, responsive to the position of said first actuator for providing a second sensed position signal having a magnitude indicative thereof, and wherein said position control means is responsive to said second sensed position signal for controlling said position of said first actuator.

8. The control of claim 6, wherein said position sensing means comprises:

a ferromagnetic tube having a Hall cell positioned at one end thereof for sensing flux and for providing a sensed flux signal;

a ferromagnetic cup having a depression for receiving said end of said tube; and a magnet positioned in said cup for providing said flux to be sensed by said Hall cell wherein the magnitude of the sensed flux will increase with closer proximity of said Hall cell to said magnet.

9. A second horizontal suspension having a pair of secondary suspensions, each for connection to an elevator car and to an associated one of a pair of opposed primary suspensions for guiding said car with respect to an associated pair of opposed hoistway rails, comprising:

first and second gap sensors for respectively providing first and second gap signals having magnitudes indicative of the distance of said car from said rails;

means responsive to said first and second gap signals for providing a first difference signal having a magnitude and sign indicative of the difference therebetween;

steering means, responsive to said first difference signal for providing said first difference signal and a return to zero signal, respectively, at first and second output signal ports in the presence of a positive difference signal and for providing said return to zero signal and said difference signal, respectively at said first and second output signal ports in the presence of a negative difference signal;

first and second position sensors, respectively responsive to the positions of first and second actuators for providing first and second position signals having magnitudes indicative thereof;

first and second summing means, respectively responsive to output signals from said first and second output ports and respectively responsive to said first and second position signals for respectively providing first and second actuation signals; and wherein said first and second actuators are respectively responsive to said first and second actuation signals for alternately being positioned for actuation or being restored to a selected position for maintaining at least a selected force on an associated one of said primary suspensions.

10. The suspension of claim 9, wherein each of said gap sensors comprises:

a ferromagnetic tube having a Hall cell positioned at one end thereof for sensing flux and for providing a sensed flux signal;

a ferromagnetic cup having a depression for receiving said end of said tube; and a magnet positioned in said cup for providing said flux to be sensed by said Hall cell wherein the magnitude of the sensed flux will increase with closer proximity of said Hall cell to said magnet.

11. A horizontal suspension for suspending an elevator car between a pair of opposite hoistway rails, comprising:

first and second primary suspensions on opposite sides of said car for guiding said car along said rails; and first and second secondary suspensions, comprising:

first and second actuable springs, respectively connected between said first and second primary suspensions and said elevator car, respectively responsive to first and second control signals, for controlling the position of said actuable springs within positional ranges thereof;

sensor means, responsive to the position of said car with respect to one or both of said primary suspensions, for providing one or a corresponding pair of sensed position signals having magnitudes indicative thereof; and control means, responsive to said one or said pair of sensed position signals for providing said first and second control signals having magnitudes within control ranges corresponding to said positional ranges of said actuable springs; said horizontal suspension further comprising:

means responsive to a sensed acceleration signal having a magnitude indicative of the horizontal acceleration of said car wherein said control means is responsive to said acceleration signal for controlling motion between said car and one or both of said primary suspensions.

12. A horizontal suspension for suspending an elevator car between a pair of opposite hoistway rails, comprising:

first and second primary suspensions on opposite sides of said car for guiding said car along said rails; and first and second secondary suspensions, comprising:

first and second actuable springs, respectively connected between said first and second primary suspensions and said elevator car, respectively responsive to first and second control signals, for controlling the position of said actuable springs within positional ranges thereof;

sensor means, responsive to the position of said car with respect to one or both of said primary suspensions, for providing one or a corresponding pair of sensed position signals having magnitudes indicative thereof; and control means, responsive to said one or said pair of sensed position signals for providing said first and second control signals having magnitudes within control ranges corresponding to said positional ranges of said actuable springs; said horizontal suspension further comprising third and fourth sensors, respectively responsive to the positions of said actuable springs with respect to one or more reference positions, for providing corresponding third and fourth position signals having magnitudes indicative thereof, and wherein said control means is responsive to said third and fourth position signals for controlling said positions of said actuable springs of said secondary suspensions with respect to said one or more reference positions.

13. A horizontal suspension for suspending an elevator car between a pair of opposite hoistway rails, comprising· first and second primary suspensions on opposite sides of said car for guiding said car along said rails; and first and second secondary suspensions, comprising:

first and second actuable springs, respectively connected between said first and second primary suspensions and said elevator car, respectively responsive to said first and second control signals, for controlling the position of said actuable springs within positional ranges thereof;

sensor means, responsive to the position of said car with respect to one or both of said primary suspensions, for providing one or a corresponding pair of sensed position signals having magnitudes indicative thereof; and control means, responsive to said one or said pair of sensed position signals for providing said first and second control signals having magnitudes within control ranges corresponding to said positional ranges of said actuable springs, wherein said sensor means comprises:

a ferromagnetic tube having a Hall cell positioned at one end thereof for sensing flux and for providing a sensed flux signal;

a ferromagnetic cup having a depression for receiving said end of said tube; and a magnet positioned in said cup for providing said flux to be sensed by said Hall cell wherein the magnitude of the sensed flux will increase with closer proximity of said Hall cell to said magnet.

14. A secondary horizontal suspension connected to a primary suspension for guiding an elevator car along a hoistway rail, comprising:

spring means connected between said primary suspension and said car;

actuator means connected to said spring means and between said elevator car and said primary suspension, responsive to a control signal, for controlling the position of said car with respect to said primary suspension;

control means, responsive to a car position error signal, for providing said control signal;

summing means, responsive to a sensed car position signal and a reference position signal, for providing said car position error signal;

first sensor means, responsive to said position of said primary suspension with respect to said car, for providing said sensed car position signal; and second sensor means, responsive to the position of said actuator with respect to a referent for providing a sensed actuator position signal having a magnitude indicative thereof, and wherein said control means is responsive to said sensed actuator position signal for providing said control signal for controlling said position of said actuator with respect to said referent.

15. The secondary suspension of claim 14, wherein said primary suspension is a roller cluster and said secondary suspension comprises a linear actuator for a side-to-side roller and a rotary actuator for at least one front-to-back roller.

16. The secondary suspension of claim 14 wherein a pair of front-to-back rollers are connected by a rigid, self-adjusting linkage.

17. The secondary suspension of claim 14 wherein said actuator is for actuating said spring connected to a sliding guide shoe primary suspension.

18. The secondary suspension of claim 14 wherein said actuator is for actuating said spring connected to an electromagnet primary suspension.

19. The secondary suspension of claim 14, further comprising an acceleration sensor, responsive to acceleration of said elevator car, for providing a sensed acceleration signal and wherein said control means is responsive to said sensed acceleration signal for providing an acceleration-based control signal and wherein said actuator means comprises a relatively small-force actuator, responsive to said acceleration-based control signal, and a relatively large-force actuator, responsive to said position-based control signal.

20. The suspension of claim 14, wherein said sensor means comprises:

a ferromagnetic tube having a Hall cell positioned at one end thereof for sensing flux and for providing a sensed flux signal;

a ferromagnetic cup having a depression for receiving said end of said tube; and a magnet positioned in said cup for providing said flux to be sensed by said Hall cell wherein the magnitude of the sensed flux will increase with closer proximity of said Hall cell to said magnet.

21. A horizontal suspension for suspending an elevator car between a pair of opposite hoistway rails, comprising:

first and second primary suspensions on opposite sides of said car for guiding said car along said rails; and first and second secondary suspensions, comprising:

first and second actuable springs, respectively connected between said first and said second primary suspensions and said elevator car, respectively responsive to first and second control signals, for controlling the position of said actuable springs within positional ranges thereof;

sensor means, responsive to the position of said car with respect to one or both of said primary suspensions, for providing one or a corresponding pair of sensed position signals having magnitudes indicative thereof; and control means, responsive to said one or said pair of sensed position signals for providing said first and second control signals having magnitudes within control ranges corresponding to said positional ranges of said actuable springs, wherein only one at a time of said first and second control signals is effective for controlling the position of said respective actuable spring.

22. A control for an elevator secondary horizontal suspension connected between a primary suspension and said elevator for guiding said elevator in a hoistway along a hoistway rail, comprising:

a first control loop, responsive to a sensed signal, for controlling said elevator with respect to said rail to keep said elevator centered in said hoistway; and a second control loop, responsive to a sensed signal having a magnitude indicative of a parameter of an actuable part of said secondary suspension, for maintaining at least a selected force on said primary suspension.

23. A horizontal suspension for guiding an elevator car along a hoistway rail, comprising:

actuable guide means having first actuating means for controlling said elevator car along said rail in response to centering or canting of said elevator car in said hoistway and having second actuating means for selectively retarding transverse movement of said elevator car along said rail in response to forces acting on said elevator car.

* * * * *

UNITED STATES PATENT AND TRADEMARK OFFICE
CERTIFICATE OF CORRECTION

PATENT NO. : 5,304,751

DATED : April 19, 1994

INVENTOR(S) : Skalski and Traktovenko

It is certified that error appears in the above-identified patent and that said Letters Patent is hereby corrected as shown below:

The sheets of drawings, consisting of figures 1-33, should be delete to appear as per attched sheets.

Signed and Sealed this

Eleventh Day of October, 1994

*Attest:*

Bruce Lehman

BRUCE LEHMAN

*Attesting Officer*

*Commissioner of Patents and Trademarks*

| FIG. 24A | FIG. 24B |
|---|---|